US010352285B2

(12) United States Patent
Noguchi

(10) Patent No.: US 10,352,285 B2
(45) Date of Patent: Jul. 16, 2019

(54) NOZZLE PLATE FOR FUEL INJECTION DEVICE

(71) Applicant: Enplas Corporation, Saitama (JP)

(72) Inventor: Koji Noguchi, Saitama (JP)

(73) Assignee: ENPLAS CORPORATION, Saitama (JP)

( * ) Notice: Subject to any disclaimer, the term of this patent is extended or adjusted under 35 U.S.C. 154(b) by 212 days.

(21) Appl. No.: 14/890,734

(22) PCT Filed: May 2, 2014

(86) PCT No.: PCT/JP2014/062148
§ 371 (c)(1),
(2) Date: Nov. 12, 2015

(87) PCT Pub. No.: WO2014/185290
PCT Pub. Date: Nov. 20, 2014

(65) Prior Publication Data

US 2016/0097361 A1 Apr. 7, 2016

(30) Foreign Application Priority Data

May 13, 2013 (JP) ..... 2013-101268
Jul. 23, 2013 (JP) ..... 2013-152629
(Continued)

(51) Int. Cl.
*F02M 61/18* (2006.01)
*F02M 61/16* (2006.01)

(52) U.S. Cl.
CPC ..... *F02M 61/1853* (2013.01); *F02M 61/162* (2013.01); *F02M 61/168* (2013.01); *F02M 61/184* (2013.01); *F02M 61/1826* (2013.01)

(58) Field of Classification Search
CPC ..... F02M 61/1853; F02M 61/1813; F02M 61/162; F02M 61/168; F02M 61/166;
(Continued)

(56) References Cited

U.S. PATENT DOCUMENTS 5,244,154 A * 9/1993 Buchholz ..... B05B 1/042 239/533.12
6,089,473 A * 7/2000 Keim ..... F02M 61/162 239/466
(Continued)

FOREIGN PATENT DOCUMENTS

JP 4-303172 10/1992
JP 10-122097 5/1998
(Continued)

OTHER PUBLICATIONS

International Search Report dated Aug. 12, 2014 in corresponding International Application No. PCT/JP2014/062148 (with English translation).
(Continued)

*Primary Examiner* — Alexander M Valvis
*Assistant Examiner* — Qingzhang Zhou
(74) *Attorney, Agent, or Firm* — Wenderoth, Lind & Ponack, L.L.P.

(57) ABSTRACT

In a nozzle plate, a portion of fuel flowing out from a fuel injection port of the fuel injection device is atomized by impinging on an interference body. At the same time, the flow of the portion of fuel is sharply bent and impinges on fuel which straightly advances and passes through a nozzle hole and an orifice thus turning the flow of fuel into a turbulent flow. Further, both end portions of the orifice form non-rounded sharpened corner portions. Hence, a liquid film of fuel injected from the corner portions and areas in the vicinity of the corner portions of the orifice is formed into a
(Continued)

thin sharpened and pointed state whereby an end portion of the liquid film of fuel injected from the orifice is easily atomized due to a friction between the end portion of the liquid film of fuel and air.

22 Claims, 35 Drawing Sheets

(30) Foreign Application Priority Data

| | | |
|---|---|---|
| Oct. 17, 2013 | (JP) ..... | 2013-216186 |
| Dec. 12, 2013 | (JP) ..... | 2013-256822 |
| Feb. 12, 2014 | (JP) ..... | 2014-024846 |

(58) Field of Classification Search
CPC ... F02M 2200/9015; F02M 2200/8046; F02M 2200/9092
USPC ..... 239/491, 494, 461, 533.11, 533.12, 596, 239/584, 585.1
See application file for complete search history.

(56) References Cited

U.S. PATENT DOCUMENTS

| | | | | |
|---|---|---|---|---|
| 6,170,763 | B1 * | 1/2001 | Fuchs | F02M 61/162 239/533.11 |
| 2002/0092930 | A1 | 7/2002 | Itatsu | |
| 2003/0141387 | A1 * | 7/2003 | Xu | F02M 61/162 239/533.12 |
| 2010/0320293 | A1 | 12/2010 | Ogura et al. | |

FOREIGN PATENT DOCUMENTS

| | | |
|---|---|---|
| JP | 2000-508739 | 7/2000 |
| JP | 2002-115627 | 4/2002 |
| JP | 2002-210392 | 7/2002 |
| JP | 2006-112391 | 4/2006 |
| JP | 2011-1864 | 1/2011 |

OTHER PUBLICATIONS

International Preliminary Report on Patentability dated Nov. 17, 2015 in corresponding International Application No. PCT/JP2014/062148.

* cited by examiner

NOZZLE PLATE FOR FUEL INJECTION DEVICE

TECHNICAL FIELD

This invention relates to a nozzle plate for a fuel injection device which is mounted on a fuel injection port of a fuel injection device, and injects fuel flowed out from the fuel injection port in an atomized manner.

BACKGROUND ART

An internal combustion engine (hereinafter, abbreviated as "engine") of an automobile or the like is configured such that combustible air-fuel mixture is formed by mixing fuel injected from a fuel injection device and air introduced into the engine through a suction pipe, and the combustible air-fuel mixture is burnt in a cylinder. It has been known that, in such an engine, a mixture state of fuel injected from the fuel injection device and air largely influences performance of the engine. Particularly, it has been known that atomization of fuel injected from the fuel injection device is an important factor which influences performance of the engine.

FIG. 54 illustrates views showing a nozzle plate 1002 mounted in a fuel injection port 1001 of a fuel injection device 1000. The nozzle plate 1002 is formed such that a nozzle hole 1003 having a quadrangular shape as viewed in a plan view gradually increases a size thereof toward the other end side from one end side in the plate thickness direction, and is mounted in the fuel injection port 1001 of the fuel injection device 1000 such that one end side of the nozzle plate 1002 in the plate thickness direction is positioned on a fuel injection port 1001 side of the fuel injection device 1000. An interference body 1005 is formed on a nozzle hole opening edge 1004 on the other end side of the nozzle plate 1002 in the plate thickness direction, and the interference body 1005 is configured to partially close the nozzle hole 1003.

In the fuel injection device 1000 provided with such a nozzle plate 1002, when fuel flows out from the fuel injection port 1001, atomized fuel F2 which impinges on the interference body 1005 and flows along a surface 1008 of the interference body 1005 impinges on fuel F1 which flows along an inner wall surface 1006 of the nozzle hole 1003 so that fuels F1 and F2 are atomized and are injected into the inside of a suction pipe from the nozzle hole 1003 (see JP-A-10-122097).

However, in the nozzle plate 1002 shown in FIG. 54, an inlet-side nozzle hole portion 1003*a* positioned on a fuel injection port 1001 side of the fuel injection device 1000 and an outlet-side nozzle hole portion 1003*h* positioned downstream of the inlet-side nozzle hole portion 1003*a* along the fuel injection direction are formed by etching, and respective corner portions 1007 of the outlet-side nozzle hole portion 1003*b* are rounded. As a result, fuel injected from the nozzle hole 1003 formed in the nozzle plate 1002 minimally forms a sharpened liquid film and hence, atomization generated by friction of fuel with air becomes insufficient.

SUMMARY OF THE INVENTION

Accordingly, it is an object of the present invention to provide a nozzle plate for a fuel injection device which can inject fuel flowing out from a fuel injection port of a fuel injection device in a sufficiently atomized manner.

Solution to Problem

The present invention is directed to, as shown in FIG. 1 to FIG. 52, a nozzle plate 3 for a fuel injection device mounted on a fuel injection port 4 of a fuel injection device 1 and provided with a nozzle hole 7 through which fuel injected from the fuel injection port 4 passes. In the nozzle plate 3 for a fuel injection device, an outlet-side opening portion 15 of the nozzle hole 7 which is an opening of a fuel flow-out side is partially closed by interference bodies 16, 16', 16", 16*a*, 51, 65, 76 so that an orifice 8 which throttles the flow of fuel is formed by the outlet-side opening portion 15 and the interference bodies 16, 16', 16", 16*a*, 51, 65, 76. The interference bodies 16, 16', 16", 16*a*, 51, 65, 76 has an outer edge portion (21, 33, 33', 34, 54, 66, 77, 86) which forms a part of an opening edge of the orifice 8, a portion of fuel which passes through the nozzle hole 7 is atomized by making the portion of fuel which passes through the nozzle hole 7 impinge on the interference body 16, 16', 16", 16*a*, 51, 65, 76, and the flow of fuel is formed into a turbulent flow such that atomization of fuel which passes through the orifice 8 in air is facilitated by sharply bending the flow of a portion of fuel which passes through the nozzle hole 7 thus making the flow of the portion of fuel impinge on fuel which intends to straightly advance and pass through the nozzle hole 7 and the orifice 8. Further, a corner portion 22, 22' of the opening edge of the orifice 8 formed by the outlet-side opening portion 15 of the nozzle hole 7 and the interference body 16, 16', 16", 16*a*, 51, 65, 76 is formed into a non-rounded sharpened shape thus forming an end portion of a liquid film of fuel which passes through the orifice 8 into a sharpened shape which is easily atomized by a friction between the end portion of the liquid film of fuel and air.

Advantageous Effects of Invention

According to the present invention, a portion of fuel injected from the fuel injection port of the fuel injection device is atomized by impinging on the interference body and, at the same time, the flow of the portion of fuel is sharply bent and impinges on fuel which straightly advances and passes through the nozzle hole and the orifice thus turning the flow of fuel which straightly advances and passes through the nozzle hole and the orifice into a turbulent flow. Further, according to the present invention, both end portions of the orifice form non-rounded sharpened corner portions and hence, a liquid film of fuel injected from the corner portion of the orifice is formed into a thin sharpened and pointed state and hence, fuel injected from the corner portions of the orifice is easily atomized due to a friction between the liquid film and air. Accordingly, the nozzle plate according to the present invention can further improve the level of atomization of fuel compared to conventional nozzle plates.

BRIEF DESCRIPTION OF DRAWINGS

FIG. 2A is a longitudinal cross-sectional view of the distal end side of the fuel injection device (the cross-sectional view taken along a line B1-B1 in FIG. 2). FIG. 2B is a bottom plan view of the distal end side of the fuel injection device (the view showing a distal end surface of the fuel injection device as viewed from the direction A1 in FIG. 2A).

FIG. 5A is a plan view of a portion of the nozzle plate for a fuel injection device. FIG. 5B is a cross-sectional view taken along a line B3-B3 in FIG. 5A.

FIG. 6A is a plan view of a portion of the nozzle plate for a fuel injection device. FIG. 6B is a cross-sectional view taken along a line B4-B4 in FIG. 6A.

FIG. 7A is a plan view of a portion of the nozzle plate for a fuel injection device. FIG. 7B is a cross-sectional view taken along a line B5-B5 in FIG. 7A.

FIG. 8A is a plan view of a portion of the nozzle plate for a fuel injection device. FIG. 8B is a cross-sectional view taken along a line B6-B6 in FIG. 8A.

FIG. 9A is a plan view of a portion of the nozzle plate for a fuel injection device. FIG. 9B is a cross-sectional view taken along a line B7-B7 in FIG. 9A.

FIG. 10A is a plan view of a portion of the nozzle plate for a fuel injection device. FIG. 10B is a cross-sectional view taken along a line B8-B8 in FIG. 10A.

FIG. 11A is a plan view of a portion of the nozzle plate for a fuel injection device. FIG. 11B is a cross-sectional view taken along a line B9-B9 in FIG. 11A.

FIG. 12A is a plan view of a portion of the nozzle plate for a fuel injection device. FIG. 12B is a side view of a portion of the nozzle plate for a fuel injection device in FIG. 12A.

FIG. 13A is a plan view of a portion of the nozzle plate for a fuel injection device. FIG. 13B is a cross-sectional view taken along a line B10-B10 in FIG. 13A.

FIG. 14A is a plan view of a portion of the nozzle plate for a fuel injection device. FIG. 14B is a cross-sectional view taken along a line B11-B11 in FIG. 14A.

FIG. 15A is a plan view of a portion of the nozzle plate for a fuel injection device. FIG. 15B is a cross-sectional view taken along a line B12-B12 in FIG. 15A.

FIG. 16A is a plan view of a portion of the nozzle plate for a fuel injection device. FIG. 16B is a cross-sectional view taken along a line B13-B13 in FIG. 16A.

FIG. 17A is a plan view of a portion of the nozzle plate for a fuel injection device. FIG. 17B is a cross-sectional view taken along a line B14-B14 in FIG. 17A.

FIG. 18A is a plan view of a portion of the nozzle plate for a fuel injection device. FIG. 18B is a cross-sectional view taken along a line B15-B15 in FIG. 18A.

FIG. 19A is a plan view of a portion of the nozzle plate for a fuel injection device. FIG. 19B is a cross-sectional view taken along a line B16-B16 in FIG. 19A.

FIG. 20A is a plan view of a portion of the nozzle plate for a fuel injection device. FIG. 20B is a cross-sectional view taken along a line B17-B17 in FIG. 20A.

FIG. 21A is a plan view of a portion of the nozzle plate for a fuel injection device. FIG. 21B is a cross-sectional view taken along a line B18-B18 in FIG. 21A.

FIG. 22A is a plan view of a portion of the nozzle plate for a fuel injection device. FIG. 22B is a cross-sectional view taken along a line B19-B19 in FIG. 22A. FIG. 22C is a plan view of a center portion side of the nozzle plate for a fuel injection device according to this modification.

FIG. 23A is a plan view of a portion of the nozzle plate for a fuel injection device. FIG. 23B is a cross-sectional view taken along a line B20-B20 in FIG. 23A.

FIG. 24A is a plan view of a portion of the nozzle plate for a fuel injection device. FIG. 24B is a cross-sectional view taken along a line B21-B21 in FIG. 24A.

FIG. 25A is a plan view of a portion of the nozzle plate for a fuel injection device. FIG. 25B is a cross-sectional view taken along a line B22-B22 in FIG. 25A.

FIG. 26A is a plan view of a portion of the first nozzle plate. FIG. 26B is a cross-sectional view taken along a line B23-B23 in FIG. 26A.

FIG. 27A is a plan view of a portion of the second nozzle plate. FIG. 27B is a cross-sectional view taken along a line B24-B24 in FIG. 27A.

FIG. 28A is a front view of the nozzle plate. FIG. 28B is a cross-sectional view of the nozzle plate taken along a line B25-B25 in FIG. 28A. FIG. 28C is a back view of the nozzle plate.

FIG. 30A is a front view of the nozzle plate. FIG. 30B is a cross-sectional view of the nozzle plate taken along a line B27-B27 in FIG. 30A. FIG. 30C is a back view of the nozzle plate.

FIG. 32A is a front view of the nozzle plate. FIG. 32B is an enlarged view of a center portion of the nozzle plate shown in FIG. 32A, and FIG. 32C is a partial cross-sectional view of the nozzle plate taken along a line B29-B29 in FIG. 32A.

FIG. 46A is a front view of the nozzle plate according to the seventh embodiment, FIG. 46B is a cross-sectional view of the nozzle plate taken along a line B41-B41 in FIG. 46A, FIG. 46C is a cross-sectional view of the nozzle plate taken along a line B42-B42 in FIG. 46A, and FIG. 46D is a back view of the nozzle plate according to the seventh embodiment.

FIG. 47A is an enlarged view of a portion (center portion) of the nozzle plate in FIG. 46A, FIG. 47B is a partially enlarged view of the nozzle plate showing a nozzle hole and the vicinity thereof in an enlarge manner, and FIG. 47C is an enlarged cross-sectional view taken along a line B43-B43 in FIG. 47B.

FIG. 52A is a view which corresponds to FIG. 48A, and FIG. 52B is a view which corresponds to FIG. 48B.

FIG. 53A is a plan view of the center portion of the nozzle plate, and FIG. 53B is a cross-sectional view taken along a line B45-B45 in FIG. 53A.

FIG. 54A is a cross-sectional view of a distal end side of the fuel injection device on which the conventional nozzle plate is mounted. FIG. 54B is a plan view of the conventional nozzle plate. FIG. 54C is an enlarged view of a portion D in FIG. 54B (the plan view of a portion of the nozzle plate). FIG. 54D is a cross-sectional view taken along a line B46-B46 in FIG. 54C.

DESCRIPTION OF EMBODIMENTS

Hereinafter, embodiments of the present invention are described in detail with reference to drawings.

First Embodiment

Figure 1:
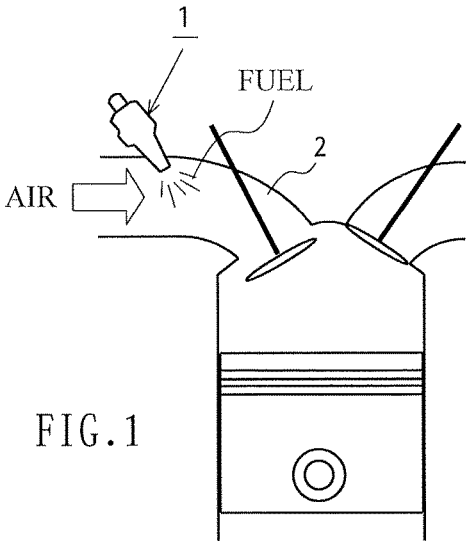
FIG. 1 is a view schematically showing a use state of a fuel injection device on which a nozzle plate for a fuel injection device according to a first embodiment of the present invention is mounted.

FIG. 1 is a view schematically showing a use state of a fuel injection device 1 on which a nozzle plate for a fuel injection device according to this embodiment is mounted. As shown in FIG. 1, the fuel injection device 1 of a port injection method is mounted on a middle portion of an intake pipe 2 of an engine, fuel is injected into the intake pipe 2, and air and fuel introduced into the intake pipe 2 are mixed thus forming combustible air-fuel mixture.

Figure 2A:
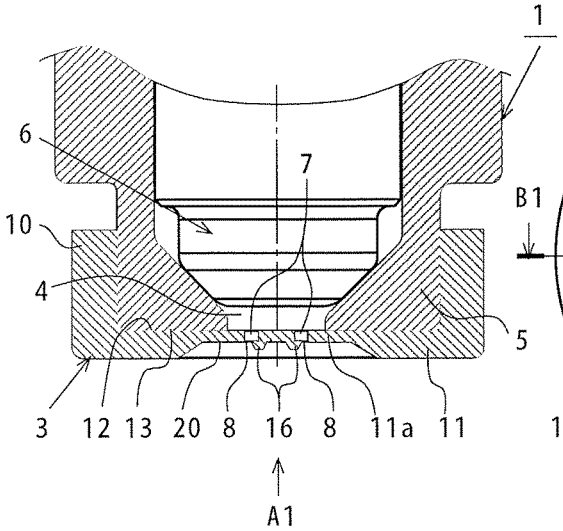
FIG. 2A and FIG. 2B are views showing a distal end side of the fuel injection device on which the nozzle plate for a fuel injection device according to the first embodiment of the present invention is mounted.
Figure 2B:
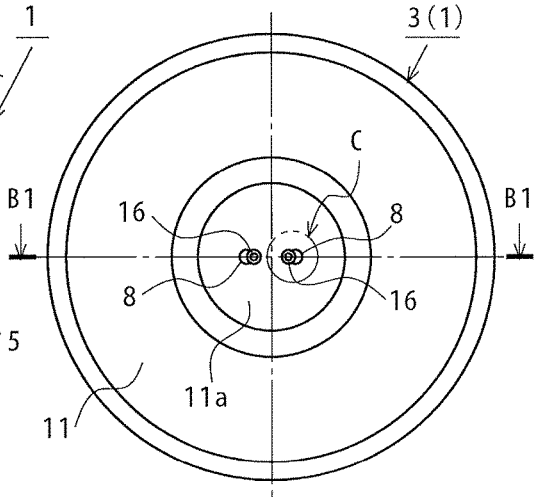
Figure 3A:
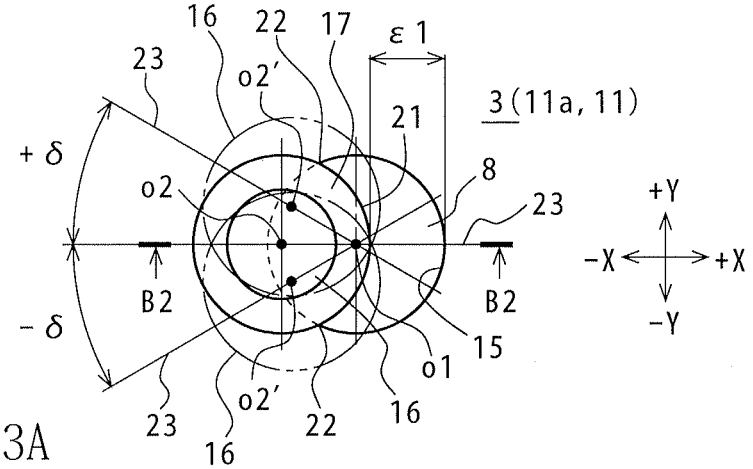
FIG. 3A is an enlarged view of a portion C in FIG. 2B (the plan view of a portion of the nozzle plate for a fuel injection device).
Figure 3B:
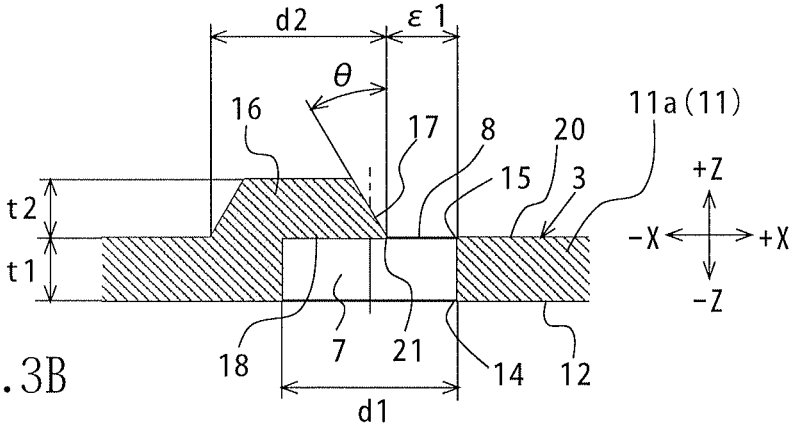
FIG. 3B is a cross-sectional view taken along a line B2-B2 in FIG. 3A.

FIG. 2 illustrates views showing a distal end side of the fuel injection device 1 on which a nozzle plate 3 for a fuel injection device (hereinafter referred to as "nozzle plate") is mounted. FIG. 2A is a longitudinal cross-sectional view of the distal end side of the fuel injection device 1 (the cross-sectional view taken along a line B1-B1 in FIG. 2B). FIG. 2B is a bottom plan view of the distal end side of the fuel injection device 1 (the view showing a distal end surface of the fuel injection device 1 as viewed from the direction A1 in FIG. 2A). FIG. 3A is an enlarged view of a portion C in FIG. 2B (the plan view of a portion of the nozzle plate 3). FIG. 3B is a cross-sectional view of the nozzle plate 3 taken along a line B2-B2 in FIG. 3A).

As shown in FIG. 2, in the fuel injection device 1, the nozzle plate 3 is mounted on a distal end side of a valve body 5 in which a fuel injection port 4 is formed. The fuel injection device 1 is configured such that a needle valve 6 is opened or closed by a solenoid not shown in the drawing. When the needle valve 6 is opened, fuel in the valve body 5 is injected from the fuel injection port 4, and fuel injected from the fuel injection port 4 passes through nozzle holes 7 and orifices 8 formed in the nozzle plate 3, and is injected to the outside.

As shown in FIG. 2 and FIG. 3, the nozzle plate 3 is a bottomed cylindrical body made of a synthetic resin material (for example, PPS, PEEK, POM, PA, PES, PEI, LEP) and is formed of a cylindrical wall portion 10 and a bottom wall portion 11 integrally formed on one end side of the cylindrical wall portion 10. The nozzle plate 3 is fixed to the valve body 5 in a state where the cylindrical wall portion 10 is fitted on an outer periphery of a distal end side of a valve body 5 with no gap formed therebetween, and an inner surface 12 of the bottom wall portion 11 is brought into contact with a distal end surface 13 of the valve body 5. A plurality of (a pair of) nozzle holes 7 which make the fuel injection port 4 formed in the valve body 5 communicate with the outside are formed in the bottom wall portion 11 of the nozzle plate 3. The nozzle hole 7 formed in the nozzle plate 3 is a straight circular hole which is orthogonal to the inner surface 12 of the bottom wall portion 11. The nozzle hole 7 is formed so as to introduce fuel injected from the fuel injection port 4 formed in the valve body 5 from an inlet-side opening portion 14 which faces the fuel injection port 4, and to inject fuel introduced from the inlet-side opening portion 14 from an outlet-side opening portion 15 side (an opening portion side from which fuel flows out) which faces the outside, in the nozzle plate 3, the outlet-side opening portion 15 of the nozzle hole 7 is formed into a circular shape. The nozzle hole 7 is formed in a thin wall portion 11*a* of the bottom wall portion 11 which is formed by counterboring.

As shown in FIG. 2 and FIG. 3, in the nozzle plate 3, a portion of the outlet-side opening portion 15 of the nozzle hole 7 is closed by an interference body 16. The interference body 16 has a frustoconical shape, wherein an outer diameter size of the interference body 16 is gradually decreased as the interference body 16 extends in the +Z axis direction shown in FIG. 3B from the outlet-side opening portion 15 of the nozzle hole 7, and a side surface 17 of the interference body 16 is formed into a tapered shape. The side surface 17 of the interference body 16 intersects with a fuel impinging surface 18 on which a portion of fuel passing through the nozzle hole 7 impinges at an acute angle. The fuel impinging surface 18 of the interference body 16 is formed so as to be positioned coplanar with an outer surface 20 of the bottom wall portion 11 (a surface positioned on a side opposite to the inner surface 12). The interference body 16 closes a portion of the outlet-side opening portion 15 of the nozzle hole 7 thus forming the orifice 8 which suddenly throttles fuel flowing in the nozzle hole 7 on the outlet-side opening portion 15 of the nozzle hole 7. An opening edge of the orifice 8 is formed into a crescent shape by the circular outlet-side opening portion 15 of the nozzle hole 7 and a portion (circular outer edge portion) of a circular outer edge portion (outer edge portion) 21 of the interference body 16 thus forming non-rounded sharpened and pointed corner portions 22 on both end portions of the orifice 8.

In FIG. 3, in the nozzle plate 3, a hole diameter of the nozzle hole 7 (a diameter of the outlet-side opening portion 15) d1, a diameter d2 of the circular outer edge portion 21 of the interference body 16, a ratio between the diameters (d1:d2), a maximum gap size ε1 of the orifice 8 (the maximum gap size ε1 of the orifice 8 on an extension 23 of a line which connects the center o1 of the nozzle hole 7 and the center o2 of the interference body 16), an inclination angle θ of the side surface 17 of the interference body 16 (an angle θ made by the side surface 17 of the interference body 16 and a direction along the +Z axis), an angle ±δ made by the extension 23 of the line which connects the center o2 (o2') of the interference body 16 and the center o1 of the nozzle hole 7 and an X axis (X axis positioned on a line which connects the centers o1 of the pair of nozzle holes 7,7), a plate thickness t1 of the thin wall portion 11*a* of the bottom wall portion 11 (a length of the nozzle hole 7), and a plate thickness t2 of the interference body 16 are determined to optimum numerical values corresponding to required fuel injection characteristics or the like. For example, an optimum numerical value of d1 is determined to be a value which falls within a range of 0.03 to 1.0 mm.

Figure 4:
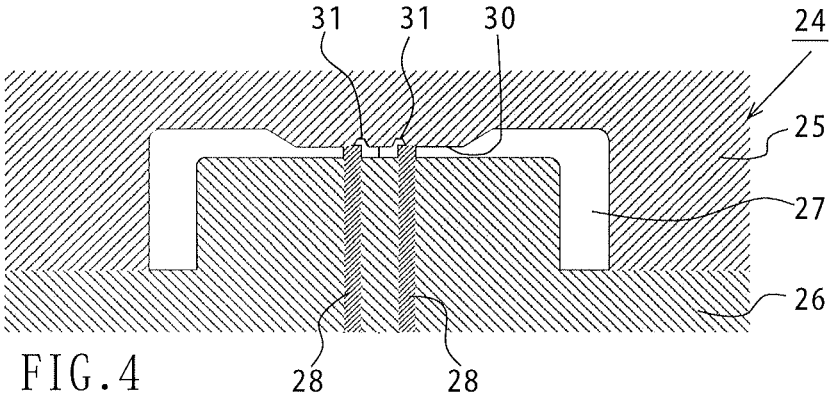
FIG. 4 is a view showing the structure of a die for injection molding used in the manufacture of the nozzle plate for a fuel injection device by injection molding.

FIG. 4 is a view showing the structure of an injection molding die 24 used for forming the nozzle plate 3 by injection molding. As shown in FIG. 4, in the injection molding die 24, a cavity 27 is formed between a first die 25 and a second die 26, and nozzle hole forming pins 28, 28 for forming the nozzle holes 7,7 project into the inside of the cavity 27. Distal ends of the nozzle hole forming pins 28, 28 are made to abut against a cavity inner surface 30 of the first die 25. Recessed portions 31, 31 for forming the interference bodies 16, 16 are formed in the vicinity of portions of the first die 25 against which the nozzle hole forming pins 28, 28 are made to abut. In such an injection molding die 24, when a molten resin is injected into the inside of the cavity 27 from a gate not shown in the drawing, the nozzle plate 3 which includes the interference bodies 16, 16 as integral parts thereof is formed (FIG. 2 and FIG. 3). In the nozzle plate 3 formed by injection molding using such an injection molding die 24, the fuel impinging surface 18 of the interference body 16 and the outer surface 20 of the bottom wall portion 11 are formed to be positioned on the same plane, and both end portions of the orifice 8 having a crescent shape are formed into the non-rounded sharpened corner portions 22, 22. The nozzle plate 3 formed by such injection molding exhibits high production efficiency compared to nozzle plates formed by etching or electric discharge machines and hence, a product unit price cart be reduced.

According to the nozzle plate 3 of this embodiment having the above-mentioned configuration, a portion of fuel injected from the fuel injection port 4 of the fuel injection device 1 is atomized by impinging on the fuel impinging surface 18 of the interference body 16 and, at the same time, the flow of the portion of fuel is sharply bent by the fuel impinging surface 18 and impinges on fuel which advances and passes through the nozzle holes 7 and the orifices 8 thus turning the fuel which advances and passes through the nozzle holes 7 and the orifices 8 into a turbulent flow. Further, in the nozzle plate 3 of this embodiment, both end portions of the orifice 8 form non-rounded sharpened corner portions 22, 22. As a result, according to the nozzle plate 3 of this embodiment, with respect to fuel injected from the orifice 8, a liquid film of fuel injected from both corner portions 22, 22 of the orifice 8 and areas in the vicinity of the corner portions 22, 22 is formed into a thin, sharpened and pointed state and hence, fuel injected from the corner portions 22, 22 of the orifice 8 and areas in the vicinity of the corner portions 22, 22 is easily atomized due to a friction between the liquid film and air in the vicinity of the orifice 8. Further, in the nozzle plate 3 according to this embodiment, the opening edge of the orifice 8 exhibits a crescent shape where the opening edge converges toward both corner portions 22, 22 from a center portion so that the opening edge of the orifice 8 is narrowed toward the corner portions 22, 22. Accordingly, fuel discharged from the orifice 8 is formed into a thin film shape (a curtain shape) having the maximum thickness ε1 in conformity with a shape of the opening edge of the orifice 8 whereby the atomization can be acquired more effectively.

Accordingly, the nozzle plate 3 according to this embodiment can further improve the level of atomization of fuel injected from the orifice 8 compared to conventional nozzle plates.

Further, according to the nozzle plate 3 of this embodiment, the side surface 17 of the interference body 16 is formed so as to intersect with the fuel impinging surface 18 of the interference body 16 at an acute angle, and an air layer is formed between fuel which passes through the orifice 8 and the side surface 17 of the interference body 16 and hence, fuel which passes through the orifice 8 is easily entrapped into air whereby the atomization of fuel which passes through the orifice 8 is accelerated thus facilitating the uniform dispersion of atomized fuel in the intake pipe 2 (see FIG. 1).

Further, according to the nozzle plate 3 of this embodiment, both end portions of the orifice 8 are formed into non-rounded sharpened corner portions 22, 22, an orifice width at a center portion of the opening edge of the orifice 8 is large, and the opening edge of the orifice 8 is narrowed in a converging manner toward both corner portions 22, 22 from the center portion. Accordingly, compared to the case where the orifice 8 is formed with a uniform width, it is possible to impart directivity to fuel to be injected from the orifice 8 such that density of fuel injected from the orifice 8 becomes maximum in a particular direction.

According to the nozzle plate 3 of this embodiment, an injection angle of fuel can be easily changed by suitably changing any one or a plurality of parameters selected from a group of parameters consisting of a hole diameter of the nozzle hole 7 (a diameter of the outlet-side opening portion 15) d1, a diameter d2 of the circular outer edge portion 21 of the interference body 16, a ratio between the diameters (d1:d2), a maximum gap ε1 of the orifice 8 (the maximum gap ε1 of the orifice 8 along an extension 23 of a line which connects the center o1 of the nozzle hole 7 and the center o2 of the interference body 16), an inclination angle θ of the side surface 17 of the interference body 16 (an angle θ made by the side surface 17 of the interference body 16 and a direction along the +Z axis), an angle ±δ made by the extension of the line which connects the center o2 (o2') of the interference body 16 and the center o1 of the nozzle hole 7 and an X axis (X axis positioned on a line which connects the centers o1 of the pair of nozzle holes 7,7), a plate thickness t1 of the thin wall portion 11*a* of the bottom wall portion 11 (a length of the nozzle hole 7) and a plate thickness t2 of the interference body 16.

First Modification of First Embodiment

Figure 5A:
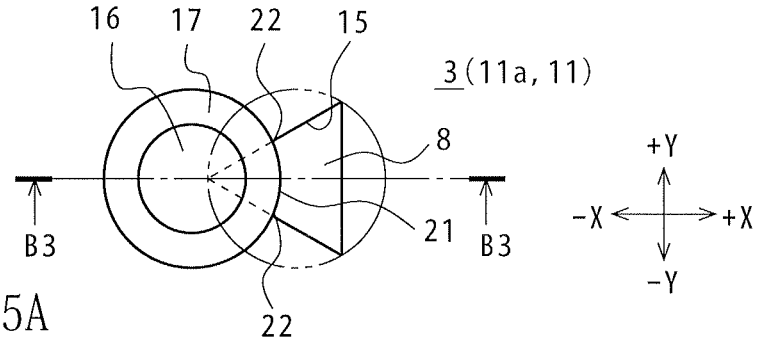
FIG. 5A and FIG. 5B are views showing an essential part of a nozzle plate for a fuel injection device according to a first modification of the first embodiment and views which correspond to FIG. 3A and FIG. 3B.
Figure 5B:
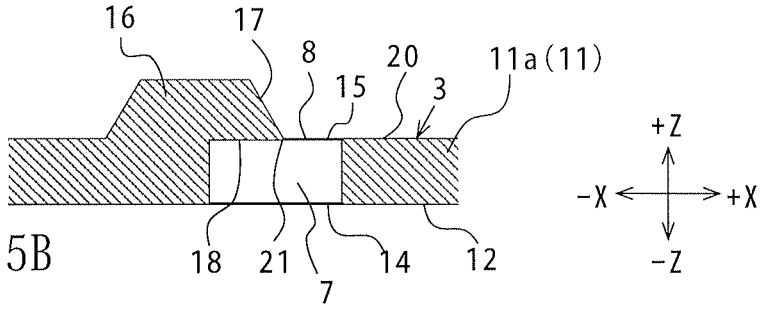

FIG. 5 illustrates views showing an essential part of a nozzle plate 3 according to a first modification of the first embodiment (corresponding to FIG. 3). In the nozzle plate 3 according to this modification, constitutional portions substantially equal to the constitutional portions of the nozzle plate 3 according to the first embodiment are given same symbols, and the explanations which overlap with the explanations of the nozzle plate 3 according to the first embodiment are omitted.

The nozzle plate 3 according to this modification differs from the nozzle plate 3 of the first embodiment with respect to a point that a nozzle hole 7 is formed of a triangular hole, and an outlet-side opening portion 15 of the nozzle hole 7 has a triangular shape. In this nozzle plate 3, corner portions 22, 22 of an opening edge of an orifice 8 formed by the outlet-side opening portion 15 of the nozzle hole 7 and a circular outer edge portion 21 of an interference body 16 are formed into a non-rounded sharpened shape and hence, an end portion of a liquid film of fuel which passes through the orifice 8 can be formed into a sharpened and pointed shape by which an end portion of a liquid film of fuel can be easily atomized due to a friction between the end portion of the liquid film of fuel and air.

Further, the nozzle plate 3 according to this modification can, in the same manner as the nozzle plate 3 according to the above-mentioned first embodiment, further improve the level of atomization of fuel compared to conventional nozzle plates.

Second Modification of First Embodiment

Figure 6A:
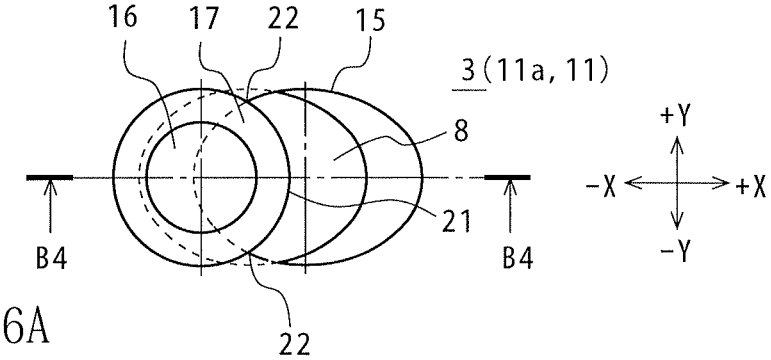
FIG. 6A and FIG. 6B are views showing an essential part of a nozzle plate for a fuel injection device according to a second modification of the first embodiment and views which correspond to FIG. 3A and FIG. 3B.
Figure 6B:
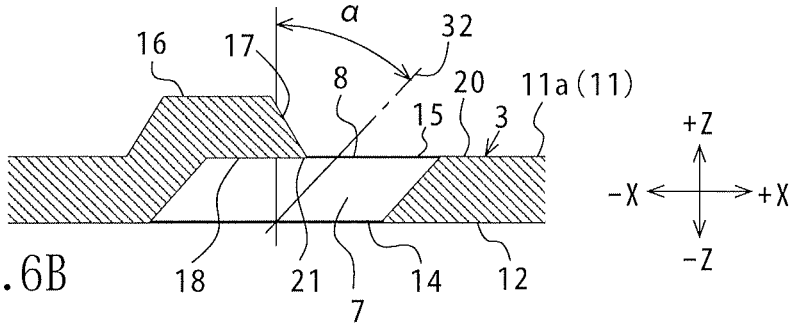

FIG. 6 illustrates views showing an essential part of a nozzle plate 3 according to a second modification of the first embodiment (corresponding to FIG. 3). In the nozzle plate 3 according to this modification, constitutional portions substantially equal to the constitutional portions of the nozzle plate 3 according to the first embodiment are given same symbols, and the explanations which overlap with the explanations of the nozzle plate 3 according to the first embodiment are omitted.

The nozzle plate 3 according to this modification differs from the nozzle plate 3 according to the first embodiment with respect to a point that a nozzle hole 7 which is a circular hole is formed obliquely with respect to a fuel impinging surface 18, and an outlet-side opening portion 15 of a nozzle hole 7 is formed into an elliptical shape. In this nozzle plate 3, corner portions 22, 22 of an opening edge of an orifice 8 formed by the outlet-side opening portion 15 of the nozzle hole 7 and a circular outer edge portion 21 of an interference body 16 are formed into a non-rounded sharpened shape and hence, an end portion of a liquid film of fuel which passes through the orifice 8 can be formed into a sharpened and pointed shape by which the end portion of the liquid film of fuel can be easily atomized due to a friction between the end portion of the liquid film of fuel and air.

The nozzle plate 3 according to this modification can, in the same manner as the nozzle plate 3 according to the above-mentioned first embodiment, further improve the level of atomization of fuel compared to conventional nozzle plates.

Further, in the nozzle plate 3 according to this modification, the nozzle hole 7 is disposed obliquely to the fuel impinging surface 18 and hence, an injection direction of fuel is determined corresponding to an angle made by a direction orthogonal to the fuel impinging surface 18 (a direction along a +Z axis) and a center line 32 of the nozzle hole 7 (an inclination angle of the nozzle hole 7) $\alpha$ whereby fuel can be accurately injected in a target direction.

Third Modification of First Embodiment

Figure 7A:
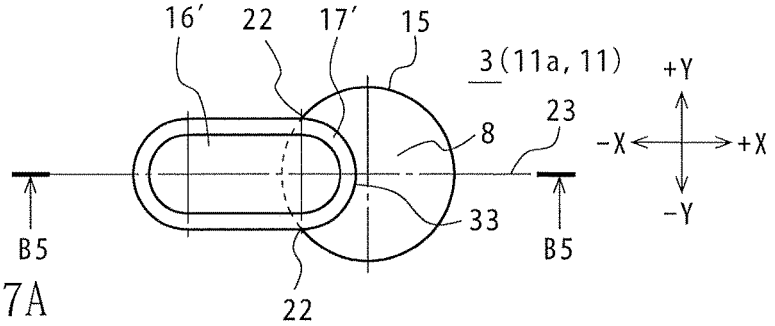
FIG. 7A and FIG. 7B are views showing an essential part of a nozzle plate for a fuel injection device according to a third modification of the first embodiment and views which correspond to FIG. 3A and FIG. 3B.
Figure 7B:
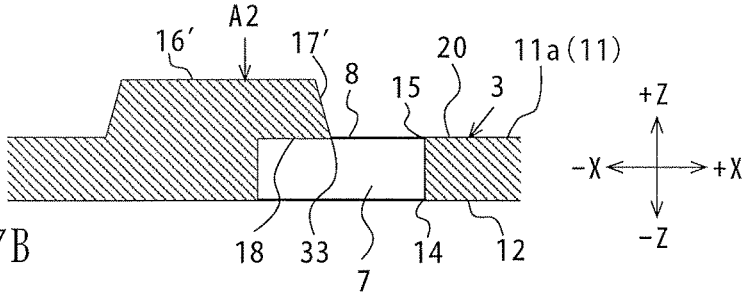

FIG. 7 illustrates views showing an essential part of a nozzle plate 3 according to a third modification of the first embodiment (corresponding to FIG. 3). In the nozzle plate 3 according to this modification, constitutional portions substantially equal to the constitutional portions of the nozzle plate 3 according to the first embodiment are given same symbols, and the explanations which overlap with the explanations of the nozzle plate 3 according to the first embodiment are omitted.

In the nozzle plate 3 according to this modification, a shape of an interference body 16' differs from the shape of the interference body 16 of the nozzle plate 3 according to the first embodiment. That is, in this modification, a shape of the interference body 16' of the nozzle plate 3 as viewed in a plan view (the shape of the interference body 16' as viewed from a direction A2 in FIG. 7) is formed into a shape where both end portions of a rectangular shape in a longitudinal direction are formed into a semicircular shape. The interference body 16' is formed such that the longitudinal direction of the interference body 16' follows an extension 23 (X-axis direction) of a line which connects the centers of a pair of nozzle holes 7, 7, and an orifice 8 is formed by a semicircular outer edge portion (circular outer edge portion, outer edge portion) 33 on one end side of the interference body 16' and a circular outlet-side opening portion 15 of the nozzle hole 7. Corner portions 22, 22 of an opening edge of the orifice 8 formed by the outlet-side opening portion 15 of the nozzle hole 7 and the semicircular outer edge portion 33 of the interference body 16' are formed into a non-rounded sharpened shape and hence, an end portion of a liquid film of fuel which passes through the orifice 8 can be formed into a sharpened and pointed shape by which the end portion of the liquid film of fuel can be easily atomized due to a friction between the end portion of the liquid film of fuel and air. In the nozzle plate 3 of this modification, the interference body 16' is, in the same manner as the inference body 16 having a frustoconical shape in the above-mentioned embodiment, formed such that a side surface 17' intersects with a fuel impinging surface 18 at an acute angle.

The nozzle plate 3 according to this modification can, in the same manner as the nozzle plate 3 according to the above-mentioned first embodiment, further improve the level of atomization of fuel compared to conventional nozzle plates.

Fourth Modification of First Embodiment

Figure 8A:
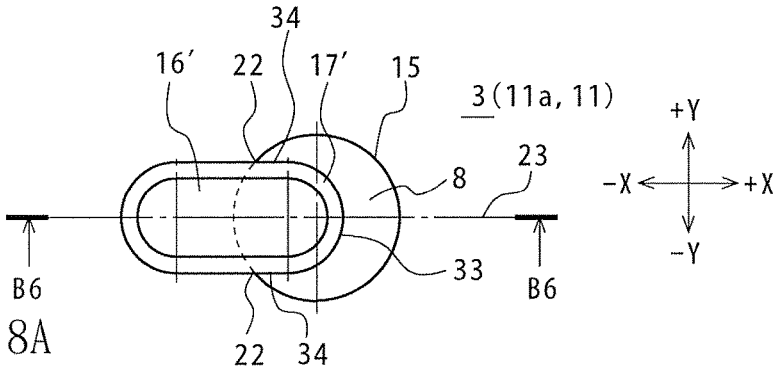
FIG. 8A and FIG. 8B are views showing an essential part of a nozzle plate for a fuel injection device according to a fourth modification of the first embodiment and views which correspond to FIG. 3A and FIG. 3B.
Figure 8B:
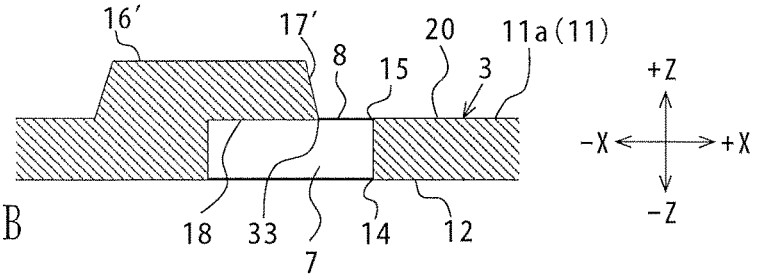

FIG. 8 illustrates views showing an essential part of a nozzle plate 3 according to a fourth modification of the first embodiment (corresponding to FIG. 3). The nozzle plate 3 according to the fourth modification is a nozzle plate obtained by partially changing the nozzle plate 3 according to the third modification. In the nozzle plate 3 according to this modification, constitutional portions substantially equal to the constitutional portions of the nozzle plates 3 according to the first embodiment and the third modification are given same symbols, and the explanations which overlap with the explanations of the nozzle plates 3 according to the first embodiment and the third modification are omitted.

The nozzle plate according to this modification includes an interference body 16' substantially equal to the interference body 16' of the nozzle plate 3 according to the above-mentioned third modification. However, an amount that the interference body 16' closes a nozzle hole 7 is larger than an amount that interference body 16' closes the nozzle hole 7 in the above-mentioned third modification, and an orifice 8 is formed by a semicircular outer edge portion 33 on one end side of the interference body 16', straight outer edge portions (outer edge portions) 34, 34 which are connected to the semicircular outer edge portion 33, and a circular outlet-side opening portion 15 of the nozzle hole 7. Corner portions 22, 22 of an opening edge of the orifice 8 formed by the outlet-side opening portion 15 of the nozzle hole 7 and the straight outer edge portions 34, 34 of the interference body 16' are formed into a non-rounded sharpened shape and hence, an end portion of a liquid film of fuel which passes through the corner portions 22 of the orifice 8 and areas in the vicinity of the corner portions 22 can be formed into a sharpened and pointed shape by which the end portion of the liquid film of fuel can be easily atomized due to a friction between the end portion of the liquid film of fuel and air. Further, in the nozzle plate 3 according to this modification, the corner portions 22, 22 of the opening edge of the orifice 8 are pointed in a narrower manner than the corresponding corner portions 22, 22 in the nozzle plate 3 of the third modification and hence, and an end portion of a liquid film of fuel which passes through the orifice 8 can be further easily atomized due to a friction between the end portion of the liquid film of fuel and air.

The nozzle plate 3 according to this modification can, in the same manner as the nozzle plate 3 according to the above-mentioned first embodiment, further improve the level of atomization of fuel compared to conventional nozzle plates.

Fifth Modification of First Embodiment

Figure 9A:
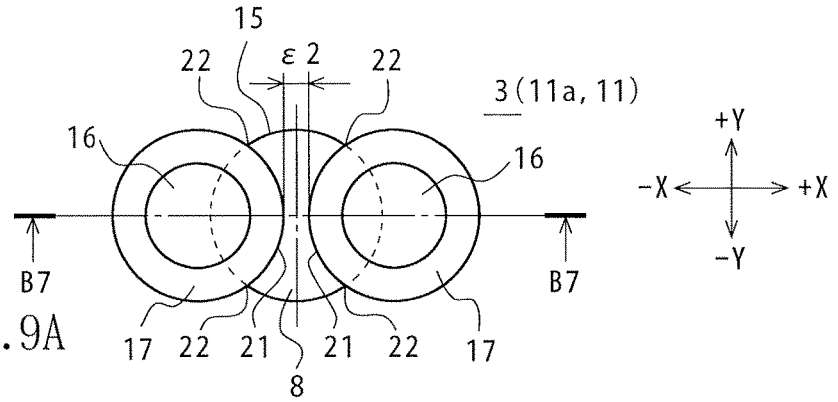
FIG. 9A and FIG. 9B are views showing an essential part of a nozzle plate for a fuel injection device according to a fifth modification of the first embodiment and views which correspond to FIG. 3A and FIG. 3B.
Figure 9B:
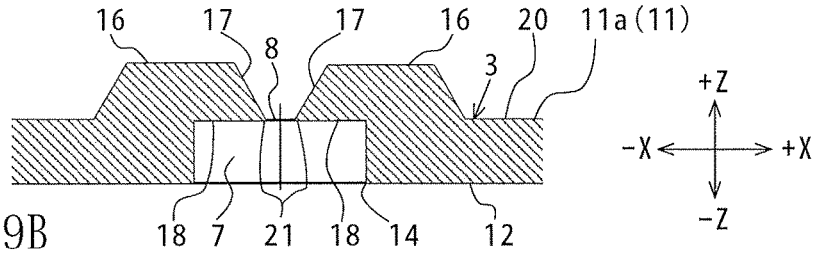

FIG. 9 illustrates views showing an essential part of a nozzle plate 3 according to a fifth modification of the first embodiment (corresponding to FIG. 3). In the nozzle plate 3 according to this modification, constitutional portions substantially equal to the constitutional portions of the nozzle plate 3 according to the first embodiment are given same symbols, and the explanations which overlap with the explanations of the nozzle plate 3 according to the first embodiment are omitted.

In the nozzle plate 3 according to this modification, a pair of interference bodies 16 having a frustoconical shape is formed on the nozzle plate 3, and the number of corner portions 22, 22, 22, 22 of an opening edge of an orifice 8 formed by a circular outlet-side opening portion 15 of a nozzle hole 7 and circular outer edge portions 21, 21 of the interference bodies 16, 16 is increased twice compared to the number of corner portions of the nozzle plate 3 according to the above-mentioned embodiment (see FIG. 3). The respective corner portions (corner portions in four places) 22 of the opening edge of the orifice 8 formed by the circular outlet-side opening portion 15 of the nozzle hole 7 and the circular outer edge portions 21, 21 of the interference bodies 16, 16 are formed into a non-rounded sharpened and pointed shape. Accordingly, a liquid film which passes through the corner portions 22 of the orifice 8 and the areas in the vicinity of the corner portions 22 can be made thin whereby an end portion of the liquid film of fuel which passes through the orifices 8 can be easily atomized due to a friction between the end portion of the liquid film of fuel and air.

The centers of the pair of interference bodies 16, 16 and the center of the nozzle hole 7 are positioned on a line B7-B7 (on a line along an X-axis direction). Distances between the center of the nozzle hole 7 to the respective circular outer edge portions 21, 21 are set to (ε2/2).

The nozzle plate 3 according to this modification can acquire a larger effect of atomizing fuel by the corner portions 22 having a non-rounded sharpened and pointed shape than the nozzle plate 3 according to the above-mentioned first embodiment and hence, the nozzle plate 3 according to this modification can inject fuel in a wider range than the nozzle plate 3 according to the above-mentioned first embodiment.

Further, in the nozzle plate 3 according to this modification, the directivity and an injection angle of fuel injected to the outside from the orifice 8 can be changed by changing a distance (gap) ε2 between the pair of interference bodies 16, 16.

Sixth Modification of First Embodiment

Figure 10A:
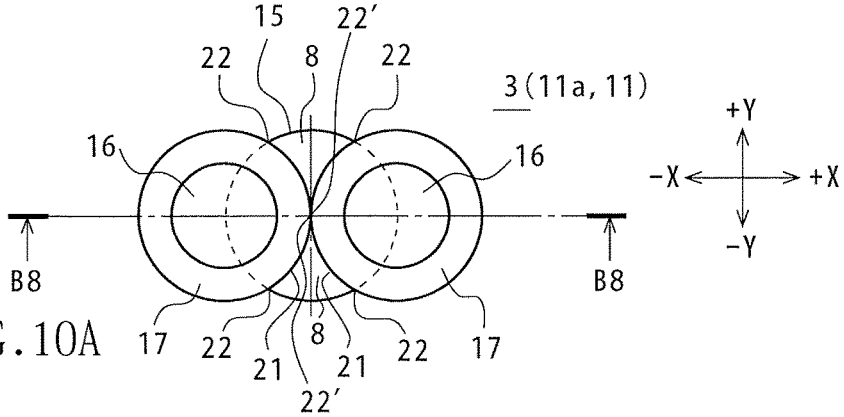
FIG. 10A and FIG. 10B are views showing an essential part of a nozzle plate for a fuel injection device according to a sixth modification of the first embodiment and views which correspond to FIG. 3A and FIG. 3B.
Figure 10B:
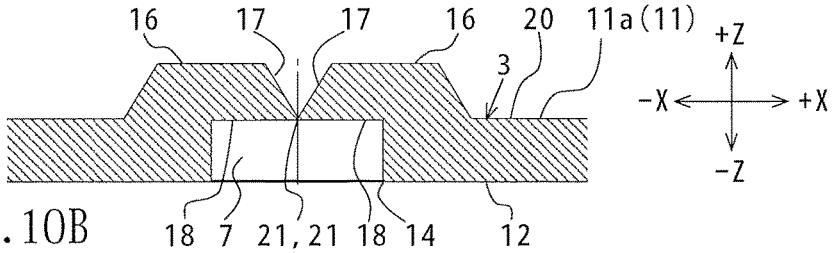

FIG. 10 illustrates views showing an essential part of a nozzle plate 3 according to a sixth modification of the first embodiment (corresponding to FIG. 3). FIG. 10 also illustrates views showing a modification of the nozzle plate 3 according to the fifth modification. In the nozzle plate according to this modification, constitutional portions substantially equal to the constitutional portions of the nozzle plates 3 according to the first embodiment and the fifth modification are given same symbols, anti the explanations which overlap with the explanations of the nozzle plates 3 according to the first embodiment and the fifth modification are omitted.

In the nozzle plate 3 according to this modification, a pair of interference bodies 16, 16 are made to abut against each other and hence, in addition to corner portions 22, 22, 22, 22 formed on four portions of an opening edge of an orifice 8 formed by a circular outlet-side opening portion 15 of a nozzle hole 7 and circular outer edge portions 21, 21 of the interference bodies 16, 16, two corner portions 22', 22' are formed on a portion where the pair of interference bodies 16, 16 abut against each other. Further, the respective corner portions 22 formed on the opening edge of the on flee 8 formed by the circular outlet-side opening portion 15 of the nozzle hole 7 and the circular outer edge portions 21, 21 of the interference bodies 16, 16 and the corner portions 22', 22' which are formed on the portion where the pair of interference bodies 16, 16 abut against each other are formed into a non-rounded sharpened and pointed shape. Accordingly, a liquid film which passes through the respective corner portions 22, 22' of the orifice 8 and the areas in the vicinity of the corner portions 22, 22' can be made thin and hence, an end portion of the liquid film of fuel which passes through the orifices 8 can be easily atomized due to a friction between the end portion of the liquid film of fuel and air.

The centers of the pair of interference bodies 16, 16 and the center of the nozzle hole 7 are positioned on a line B8-B8 (on a line along an X-axis direction). A contact point of the pair of circular outer edge portions 21, 21 agrees with the center of the nozzle hole 7.

The nozzle plate 3 according to this modification can acquire a larger effect of atomizing fuel by the corner portions 22, 22' having a non-rounded sharpened and pointed shape than the nozzle plates 3 according to the above-mentioned first embodiment and the above-mentioned fifth modification.

Seventh Modification of First Embodiment

Figure 11A:
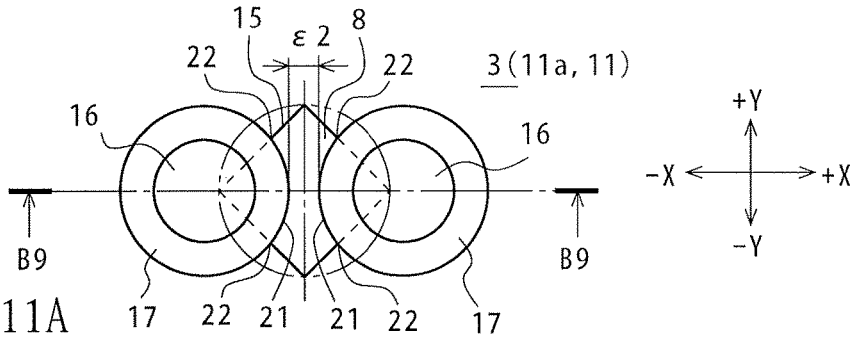
FIG. 11A and FIG. 11B are views showing an essential part of a nozzle plate for a fuel injection device according to a seventh modification of the first embodiment and views which correspond to FIG. 3A and FIG. 3B.
Figure 11B:
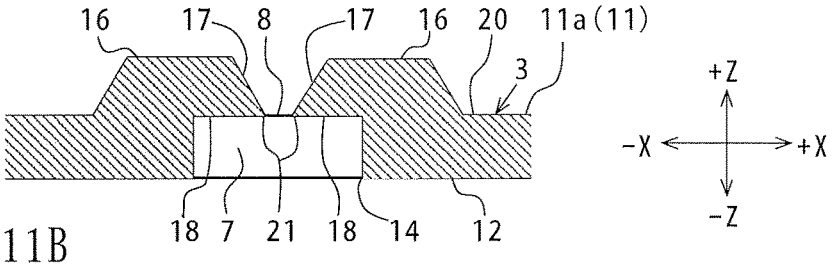

FIG. 11 illustrates views showing an essential part of a nozzle plate 3 according to a seventh modification of the first embodiment (corresponding to FIG. 3). FIG. 11 also illustrates views showing a modification of the nozzle plate 3 according to the fifth modification. In the nozzle plate 3 according to this modification, constitutional portions substantially equal to the constitutional portions of the nozzle plates 3 according to the first embodiment and the fifth modification are given same symbols, and the explanations which overlap with the explanations of the nozzle plates 3 according to the first embodiment and the fifth modification are omitted.

The nozzle plate 3 according to this modification differs from the nozzle plate 3 according to the fifth modification with respect to a point that a nozzle hole 7 is formed of a quadrangular hole, and an outlet-side opening portion 15 of a nozzle hole 7 has a quadrangular shape. In this nozzle plate 3, respective corner portions 22 of an opening edge of an orifice 8 formed by an outlet-side opening portion 15 of the nozzle hole 7 and circular outer edge portions 21, 21 of interference bodies 16, 16 are formed into a non-rounded sharpened shape and hence, an end portion of a liquid film of fuel which passes through the orifices 8 can be formed into a sharpened and pointed shape by which the end portion of the liquid film of fuel is easily atomized due to a friction between the end portion of the liquid film of fuel and air.

The nozzle plate 3 according to this modification can, in the same manner as the nozzle plate 3 according to the above-mentioned fifth modification, acquire a larger effect of atomizing fuel by the respective corner portions 22 having a non-rounded sharpened and pointed shape than the nozzle plates 3 according to the above-mentioned first embodiment, and can inject fuel in a wider range than the nozzle plates 3 according to the above-mentioned first embodiment.

Eighth Modification of First Embodiment

Figure 12A:
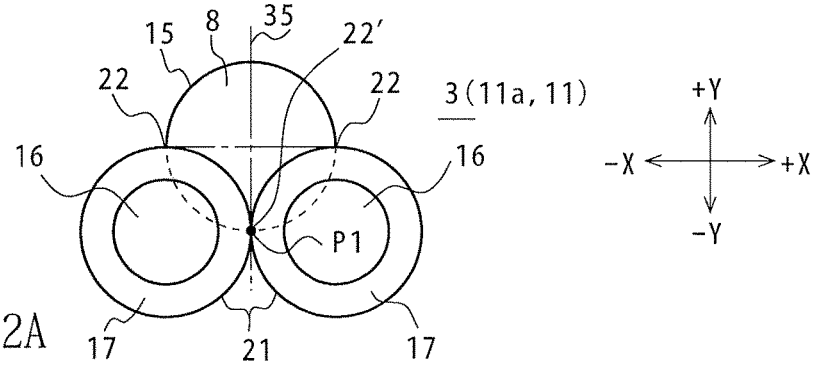
FIG. 12A and FIG. 12B are views showing an essential part of a nozzle plate for a fuel injection device according to an eighth modification of the first embodiment.
Figure 12B:
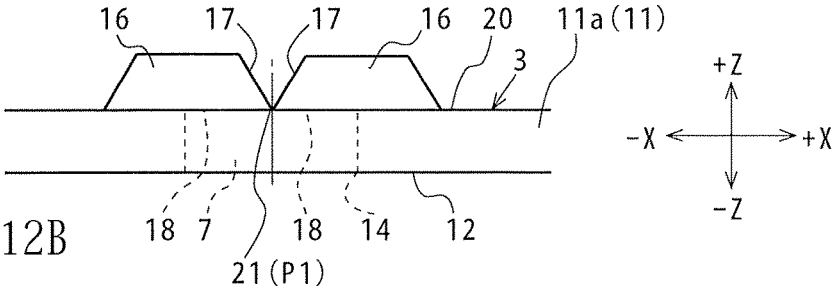

FIG. 12 illustrates views showing an essential part of a nozzle plate 3 according to an eighth modification of the first embodiment (corresponding to FIG. 3). FIG. 12 also illustrates views showing a modification of the nozzle plate 3 according to the sixth modification, in the nozzle plate 3 according to this modification, constitutional portions substantially equal to the constitutional portions of the nozzle plates 3 according to the first embodiment and the sixth modification are given same symbols, and the explanations which overlap with the explanations of the nozzle plates 3 according to the first embodiment and the sixth modification are omitted.

The nozzle plate 3 according to this modification differs from the nozzle plate 3 according to the sixth modification with respect to a point that a contact position P1 of a pair of interference bodies 16, 16 is positioned at an intersecting point between a center line (a center line along a Y-axis direction) 35 of nozzle holes 7 and an outlet-side opening portion 15 of the nozzle hole 7, and the contact position between the pair of interference bodies 16, 16 is positioned at the center of the nozzle hole 7.

In the nozzle plate 3 according to this modification, in addition to corner portions 22, 22 formed on two portions of an opening edge of an orifice 8 firmed by a circular outlet-side opening portion 15 of a nozzle hole 7 and circular outer edge portions 21, 21 of the pair of interference bodies 16, 16, one corner portion 22' is formed on a portion where the pair of interference bodies 16, 16 abut against each other. Further, the respective corner portions 22 formed on the opening edge of the orifice 8 formed by the circular outlet-side opening portion 15 of the nozzle hole 7 and the circular outer edge portions 21, 21 of the pair of interference bodies 16, 16 and the corner portion 22' on the portion where the pair of interference bodies 16, 16 abut against each other are formed into a non-rounded sharpened and pointed shape. Accordingly, an end portion of the liquid film which passes through the orifices 8 can be formed into a thin film and hence, the end portion of the liquid film of fuel which passes through the orifice 8 can be easily atomized due to a friction between the end portion of the liquid film of fuel and air.

The nozzle plate 3 according to this modification can acquire a larger effect of atomizing fuel by the respective corner portions 22, 22' having a non-rounded sharpened and pointed shape than the nozzle plate 3 according to the above-mentioned first embodiment.

Ninth Modification of First Embodiment

Figure 13A:
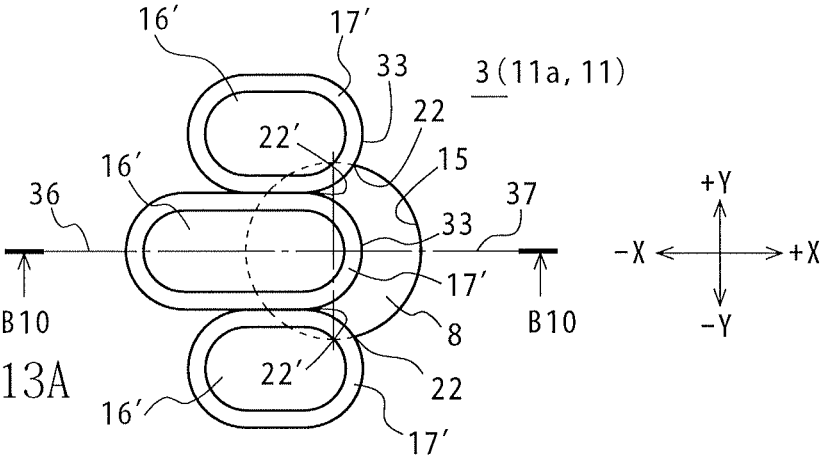
FIG. 13A and FIG. 13B are views showing an essential part of a nozzle plate for a fuel injection device according to a ninth modification of the first embodiment and views which correspond to FIG. 3A and FIG. 3B.
Figure 13B:
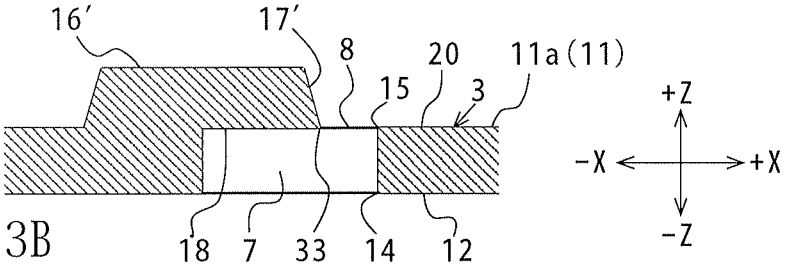

FIG. 13 illustrates views showing an essential part of a nozzle plate 3 according to a ninth modification of the first embodiment (corresponding to FIG. 3). FIG. 13 also illustrates views showing a modification of the nozzle plate 3 according to the fourth modification, in the nozzle plate 3 according to this modification, constitutional portions substantially equal to the constitutional portions of the nozzle plates 3 according to the first embodiment and the fourth modification are given same symbols, and the explanations which overlap with the explanations of the nozzle plates 3 according to the first embodiment and the fourth modification are omitted.

In the nozzle plate 3 according to this modification, three interference bodies 16' substantially equal to the interference bodies 16' of the nozzle plate 3 according to the above-mentioned fourth modification are formed in a close contact state with each other, and the interference bodies 16' are arranged such that a center line 36 of the interference body 16' positioned at the center in a longitudinal direction agrees with a center line (a center line extending along an X axis) 37 of a nozzle hole 7.

In the nozzle plate 3 according to this modification, an orifice 8 is formed by semicircular outer edge portions 33 of three interference bodies 16' on one end side and a circular outlet-side opening portion 15 of the nozzle hole 7. Corner portions 22 of an opening edge of the orifice 8 formed by the outlet-side opening portion 15 of the nozzle hole 7 and the semicircular outer edge portions 33 of three interference bodies 16' are formed into a non-rounded sharpened shape and hence, an end portion of a liquid film of fuel which passes through the orifice 8 is formed into a sharpened and pointed shape by which the end portion of the liquid film of fuel can be easily atomized due to a friction between the end portion of the liquid film of fuel and air. Further, in the nozzle plate 3 according to this modification, corner portions 22' formed in a contact portion between the semicircular outer edge portions 33, 33 of the interference bodies 16', 16' arranged adjacent to each other are formed into a non-rounded sharpened shape and hence, an end portion of a liquid film of fuel which passes through the orifice 8 is formed into a sharpened and pointed shape by which the end portion of the liquid film of fuel can be easily atomized due to a friction between the end portion of the liquid film of fuel and air. That is, in this modification, the corner portions 22, 22' having a non-rounded sharpened shape are firmed on four portions of the nozzle plate 3.

The nozzle plate 3 according to this modification can acquire a larger effect of atomizing fuel by the corner portions 22, 22' having a non-rounded sharpened and pointed shape than the nozzle plates 3 according to the above-mentioned first embodiment.

Tenth Modification of First Embodiment

Figure 14A:
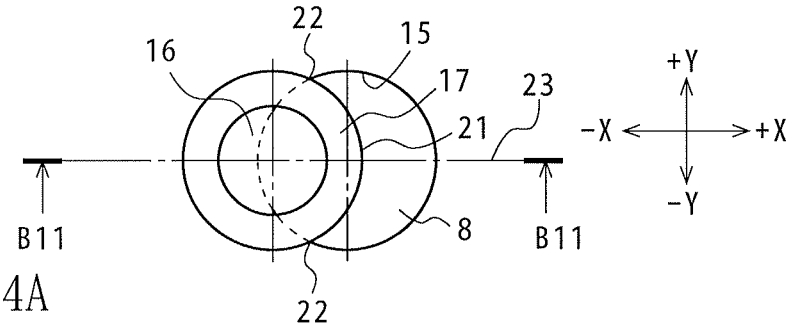
FIG. 14A and FIG. 14B are views showing an essential part of a nozzle plate for a fuel injection device according to a tenth modification of the first embodiment and views which correspond to FIG. 3A and FIG. 3B.
Figure 14B:
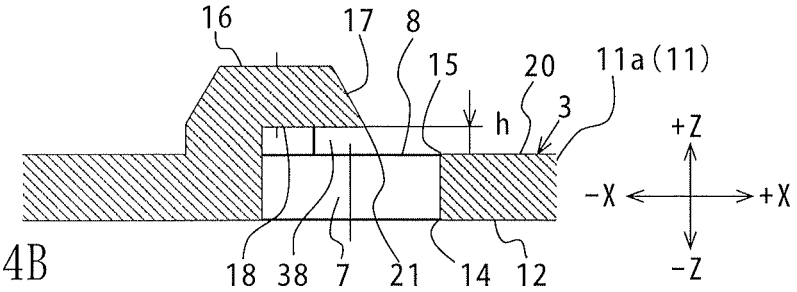

FIG. 14 illustrates views showing an essential part of a nozzle plate 3 according to a tenth modification of the first embodiment (corresponding to FIG. 3). In the nozzle plate 3 according to this modification, constitutional portions substantially equal to the constitutional portions of the nozzle plate 3 according to the first embodiment are given same symbols, and the explanations which overlap with the explanations of the nozzle plate 3 according to the first embodiment are omitted.

In the nozzle plate 3 according to this modification, a fuel impinging surface 18 of an interference body 16 is spaced apart from an outer surface 20 of a bottom wall portion 11 by h in a +Z axis direction, and a circular outer edge portion 21 of the interference body 16 and an outlet-side opening portion 15 of a nozzle hole 7 are separated in the +Z axis direction by a gap 38. In the nozzle plate 3, when the interference body 16 is viewed in a −Z axis direction (as viewed in a plan view), an orifice 8 having a crescent shape is formed by a circular outer edge portion 21 of the interference body 16 and a circular outlet-side opening portion 15 of the nozzle hole 7, and non-rounded sharpened and pointed corner portions 22, 22 are formed on both end portions of the orifice 8 having a crescent shape respectively.

In such a nozzle plate 3 according to this modification, when fuel is injected from the orifice 8, air is entrapped into sprayed fuel from the gap 38 formed between the fuel impinging surface 18 of the interference body 16 and an outer surface 20 of the bottom wall portion 11. Accordingly, a larger amount of air flows into fuel than the case where fuel is injected using the nozzle plate 3 according to the first embodiment and hence, the nozzle plate 3 according to this modification has an effect of atomizing fuel.

As shown in FIG. 14A, the formation of the gap 38 between the fuel impinging surface 18 of the interference body 16 and the outer surface 20 of the bottom wall portion 11 is applicable to the above-mentioned first to ninth modifications.

Eleventh Modification of First Embodiment

Figure 15A:
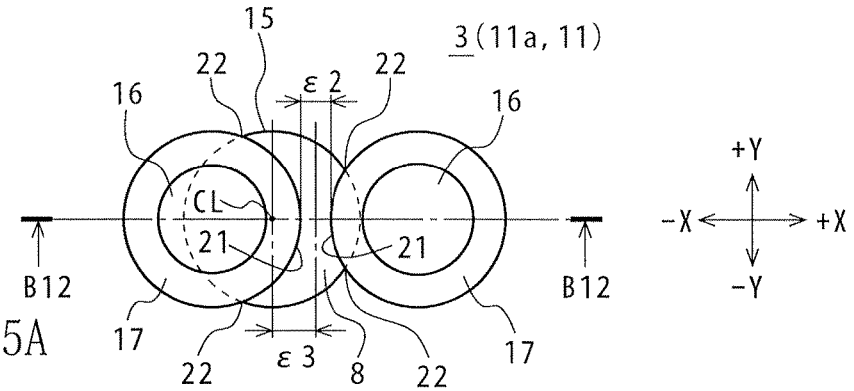
FIG. 15A and FIG. 15B are views showing an essential part of a nozzle plate for a fuel injection device according to an eleventh modification of the first embodiment and views showing an example similar to the fifth modification (see FIG. 9).
Figure 15B:
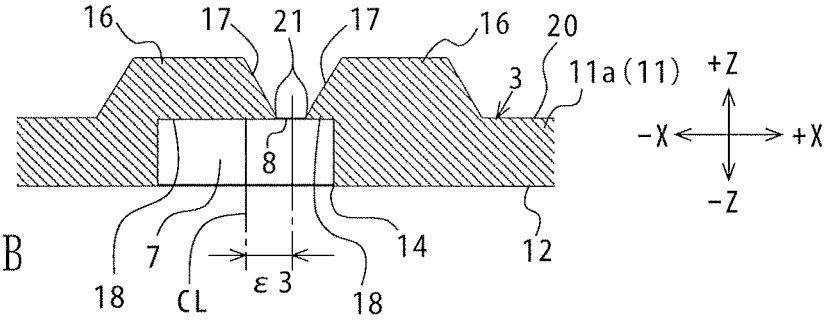

FIG. 15 illustrates views showing an essential part of a nozzle plate 3 according to an eleventh modification of the first embodiment and views showing an example similar to the fifth modification (see FIG. 9). In the nozzle plate 3 according to this modification, constitutional portions substantially equal to the constitutional portions of the nozzle plates 3 according to the first embodiment and the fifth modification are given same symbols, and the explanations which overlap with the explanations of the nozzle plates 3 according to the first embodiment and the fifth modification are omitted.

In the nozzle plate 3 according to this modification, the pair of interference bodies 16, 16 in the fifth modification is shifted in a +X direction with respect to the center CL of the nozzle hole 7 by ε3. In the nozzle plate 3 according to this modification, in the same manner as the nozzle plate 3 of the fifth modification, respective corner portions (corner portions in four places) 22 of an opening edge of an orifice 8 formed by a circular outlet-side opening portion 15 of the nozzle hole 7 and a pair of circular outer edge portions 21, 21 of the interference bodies 16, 16 are formed into a non-rounded sharpened and pointed shape. Accordingly, a liquid film of fuel which passes through the corner portions 22 of the orifice 8 and the areas in the vicinity of the corner portions 22 can be made thin and hence, an end portion of the liquid film of fuel which passes through the orifice 8 can be easily atomized due to a friction between the end portion of the liquid film of fuel and air. Further, in the nozzle plate 3 according to this modification, an area which one of the pair of interference bodies 16, 16 closes the nozzle hole 7 differs from an area which the other of the pair of interference bodies 16, 16 closes the nozzle hole 7. That is, the area which one interference body 16 (−X direction side in FIG. 15) closes the nozzle hole 7 is larger than the area which the other interference body 16 (+X direction side in FIG. 15) closes the nozzle hole 7. Accordingly, an amount of fuel whose flow direction is changed toward the other interference body 16 side after impinging on one interference body 16 is larger than an amount of fuel whose flow direction is changed toward one interference body 16 side after impinging on the other interference body 16. Further, the orifice 8 is shifted toward the +X direction with respect to the center of the nozzle hole 7. As a result, in the nozzle plate 3 according to this modification, the injection direction of fuel from the orifice 8 can be shifted in the +X direction with respect to the center CL of the nozzle hole 7.

With respect to the nozzle plate 3 according to this modification, the example is described where the pair of interference bodies 16, 16 is shifted in the +X direction with respect to the center CL of the nozzle hole 7. However, this modification is not limited to such a case, and which direction that the pair of interference bodies 16, 16 is to be shifted with respect to the center CL of the nozzle hole 7 is determined based on which direction of fuel is to be injected with respect to the center CL of the orifice 8.

Twelfth Modification of First Embodiment

Figure 16A:
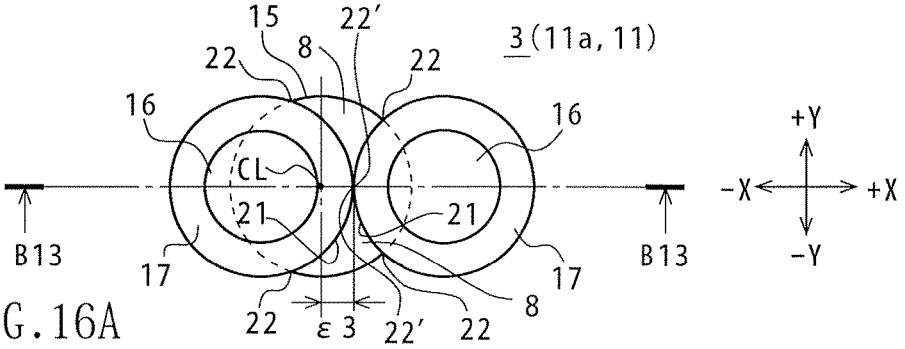
FIG. 16A and FIG. 16B are views showing an essential part of a nozzle plate for a fuel injection device according to a twelfth modification of the first embodiment and views showing an example similar to the sixth modification (see FIG. 10).
Figure 16B:
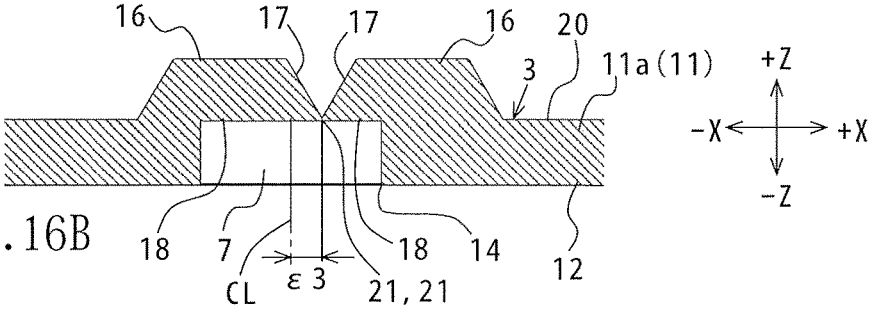

FIG. 16 illustrates views showing an essential part of a nozzle plate 3 according to a twelfth modification of the first embodiment and views showing an example similar to the sixth modification (see FIG. 10). In the nozzle plate 3 according to this modification, constitutional portions substantially equal to the constitutional portions of the nozzle plates 3 according to the first embodiment and the sixth modification are given same symbols, and the explanations which overlap with the explanations of the nozzle plates 3 according to the first embodiment and the sixth modification are omitted.

In the nozzle plate 3 according to this modification, the pair of interference bodies 16, 16 in the sixth modification is shifted in a +X direction with respect to the center CL of the nozzle hole 7 by ε3. In the nozzle plate 3 of this modification, in the same manner as the nozzle plate 3 of the sixth modification, in addition to respective corner portions (corner portions in four places) 22 of an opening edge of an orifice 8 formed by a circular outlet-side opening portion of the nozzle hole 7 and circular outer edge portions 21, 21 of a pair of interference bodies 16, 16, corner portions 22', 22' are formed in two places where the pair of interference bodies 16, 16 abut against each other. These corner portions 22, 22' are formed into a non-rounded sharpened and pointed shape. Accordingly, a liquid film which passes through the corner portions 22, 22' of the orifice 8 and the areas in the vicinity of the corner portions 22, 22' can be made thin and hence, an end portion of the liquid film which passes through the orifice 8 can be easily atomized due to a friction between the end portion of the liquid film of fuel and air. Further, in the nozzle plate 3 according to this modification, an area which one of the pair of interference bodies 16, 16 closes the nozzle hole 7 differs from an area which the other of the pair of interference bodies 16, 16 closes the nozzle hole 7. That is, the area which one interference body 16 (−X direction side in FIG. 15) closes the nozzle hole 7 is larger than the area which the other interference body 16 (+X direction side in FIG. 15) closes the nozzle hole 7. Accordingly, an amount of fuel whose flow direction is changed toward the other interference body 16 side after impinging on one interference body 16 is larger than an amount of fuel whose flow direction is changed toward one interference body 16 side after impinging on the other interference body 16. Further, the orifice 8 is shifted toward the +X direction with respect to the center CL of the nozzle hole 7. As a result, in the nozzle plate 3 according to this modification, the injection direction of fuel from the orifice 8 can be shifted in the +X direction with respect to the center CL of the nozzle hole 7.

With respect to the nozzle plate 3 according to this modification, the example is described where the pair of interference bodies 16, 16 is shifted in the +X direction with respect to the center CL of the nozzle hole 7. However, this modification is not limited to such a case, and which direction that the pair of interference bodies 16, 16 is to be shifted with respect to the center CL of the nozzle hole 7 is determined based on which direction fuel is to be injected with respect to the center CL of the orifice 8.

Thirteenth Modification of First Embodiment

Figure 17A:
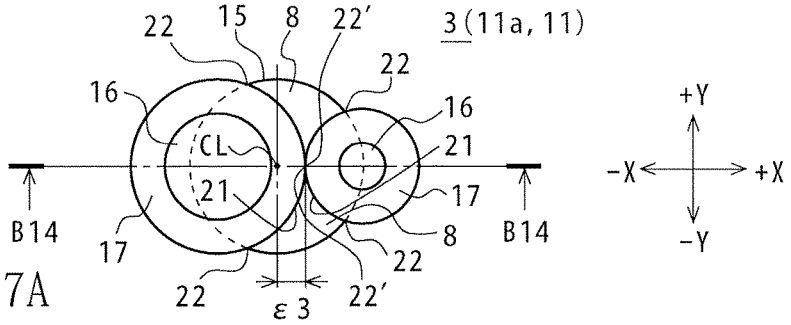
FIG. 17A and FIG. 17B are views showing an essential part of a nozzle plate for a fuel injection device according to a thirteenth modification of the first embodiment and views showing an example similar to the twelfth modification (see FIG. 16).
Figure 17B:
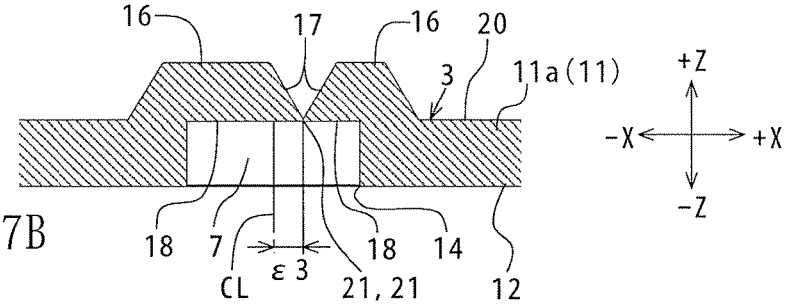

FIG. 17 illustrates views showing an essential part of a nozzle plate 3 according to a thirteenth modification of the first embodiment and views showing an example similar to the twelfth modification (see FIG. 16). In the nozzle plate 3 according to this modification, constitutional portions substantially equal to the constitutional portions of the nozzle plates 3 according to the first embodiment and the twelfth modification are given same symbols, and the explanations which overlap with the explanations of the nozzle plates 3 according to the first embodiment and the twelfth modification are omitted.

In the nozzle plate 3 according to this modification, one of a pair of interference bodies 16, 16 (interference body 16 on a right side: +X side) is formed smaller than the other of the pair of interference bodies 16, 16 (interference body 16 on a left side: −X side). As a result, compared to the nozzle plate 3 according to the twelfth modification, in the nozzle plate 3 according to this modification, although an amount (ε3) that an orifice 8 is shifted in the +X direction with respect to the center CL of the nozzle hole 7 is equal between these modifications, the difference between an area which one of the pair of interference bodies 16, 16 closes the nozzle hole 7 and an area which the other of the pair of interference bodies 16, 16 closes the nozzle hole 7 becomes large, and an opening area of the orifice 8 becomes large. Accordingly, the nozzle plate 3 according to this modification can acquire a fuel injection characteristic different from that of the nozzle plate 3 according to the twelfth modification. On the other hand, in the nozzle plate 3 according to this modification, in the same manner as the nozzle plate 3 according to the twelfth modification, in addition to respective corner portions (corner portions in four places) 22 of an opening edge of the orifice 8 formed by a circular outlet-side opening portion 15 of the nozzle hole 7 and circular outer edge portions 21, 21 of the pair of the interference bodies 16, 16, corner portions 22', 22' are formed in two places where a pair of interference bodies 16, 16 abuts against each other.

Fourteenth Modification of First Embodiment

Figure 18A:
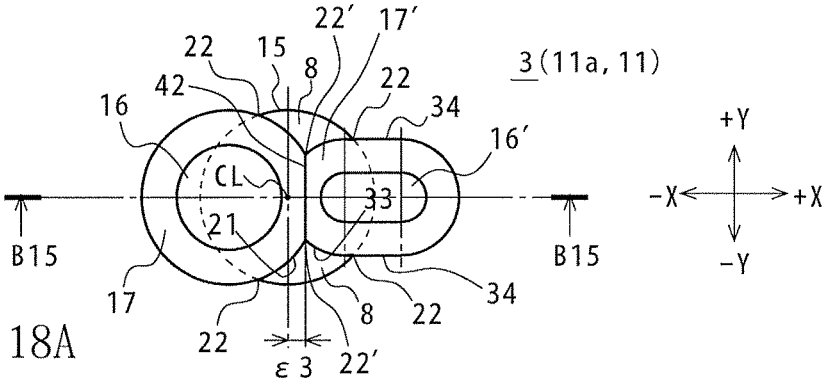
FIG. 18A and FIG. 18B are views showing an essential part of a nozzle plate for a fuel injection device according to a fourteenth modification of the first embodiment and views showing an example similar to the thirteenth modification (see FIG. 17).
Figure 18B:
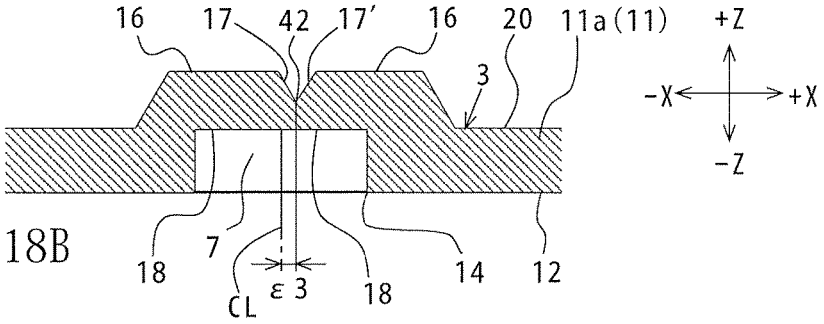

FIG. 18 illustrates views showing an essential part of a nozzle plate 3 according to a fourteenth modification of the first embodiment and views showing an example similar to the thirteenth modification (see FIG. 17). In the nozzle plate 3 according to this modification, constitutional portions substantially equal to the constitutional portions of the nozzle plates 3 according to the first embodiment and the thirteenth modification are given same symbols, and the explanations which overlap with the explanations of the nozzle plates 3 according to the first embodiment and the thirteenth modification are omitted.

In the nozzle plate 3 according to this modification, one of the pair of interference bodies 16, 16 of the nozzle plate 3 according to the thirteenth modification (interference body 16 on a right side: +X side) is replaced with the interference body 16' shown in FIG. 8, and the other interference body 16 (interference body 16 on a left side: −X side) is made to abut against one interference body 16' in a state where the interference bodies 16, 16' are collapsed by pressing (having a contact of a predetermined width in ±Y direction).

In such a nozzle plate 3 according to this modification, compared to the nozzle plate 3 according to the thirteenth modification, an opening area of the orifice 8 becomes narrow, and an area that one interference body 16' closes the nozzle hole 7 and an area that the other interference body 16 closes the nozzle hole 7 become different from each other. Further, in the nozzle plate 3 according to this modification, a sharpened corner portion 22 formed by a circular outlet-side opening portion 15 of the nozzle hole 7 and a circular outer edge portion 21 of the interference body 16, and a sharpened corner portion 22 formed by the circular outlet-side opening portion 15 of the nozzle hole 7 and a straight outer edge portion 34 of the interference body 16' have a shape which is narrower and more sharpened than the corner portions 22 of the nozzle plate 3 according to the thirteenth modification. On the other hand, the corner portions 22', 22' formed at an abutting portion 42 where one interference body 16' and the other interference body 16 of this modification abut against each other are less sharpened than the corner portions 22', 22' of the nozzle plate 3 according to the thirteenth modification. As a result, the nozzle plate 3 according to this modification can acquire a fuel injection characteristic which differs from a fuel injection characteristic of the nozzle plate 3 according to the thirteenth modification.

The abutting portion 42 between the interference body 16 and the interference body 16' is shifted from the center CL of the nozzle hole 7 in the +X direction by ε3.

Fifteenth Modification of First Embodiment

Figure 19A:
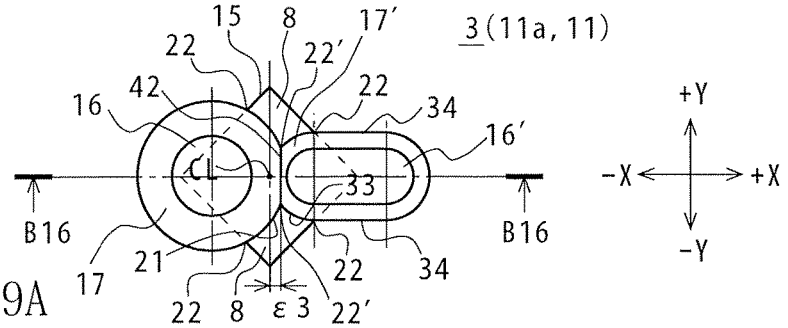
FIG. 19A and FIG. 19B are views showing an essential part of a nozzle plate for a fuel injection device according to a fifteenth modification of the first embodiment and views showing an example similar to the fourteenth modification (see FIG. 18).
Figure 19B:
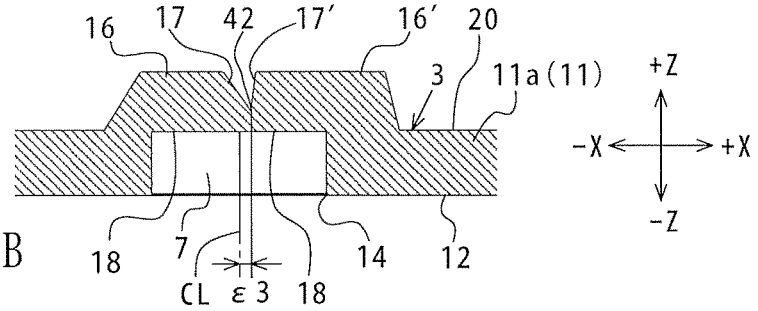

FIG. 19 illustrates views showing an essential part of a nozzle plate 3 according to a fifteenth modification of the first embodiment and views showing an example similar to the fourteenth modification (see FIG. 18). In the nozzle plate 3 according to this modification, constitutional portions substantially equal to the constitutional portions of the nozzle plates 3 according to the first embodiment and the fourteenth modification are given same symbols, and the explanations which overlap with the explanations of the nozzle plates 3 according to the first embodiment and the fourteenth modification are omitted.

The nozzle plate 3 according to this modification differs from the nozzle plate 3 according to the fourteenth modification with respect to a point that the nozzle hole 7 formed in the nozzle plate 3 according to the fourteenth modification is formed of a quadrangular hole, and an outlet-side opening portion 15 of the nozzle hole 7 has a quadrangular shape.

In the nozzle plate 3 according to this modification, an abutting portion 42 where one interference body 16' and the other interference body 16 abut against each other is positioned in a shifted manner in a +X direction by ε3 with respect to the center CL of the nozzle hole 7. Further, in the nozzle plate 3 according to this modification, two corner portions 22 formed by the outlet-side opening portion 15 of the nozzle hole 7 and a straight outer edge portion 34 of the interference body 16', two corner portions 22 formed by the outlet-side opening portion 15 of the nozzle hole 7 and a circular outer edge portion 21 of the interference body 16, and two corner portions 22' formed on the abutting portion 42 where the interference body 16' and the interference body 16 abut against each other are formed into a non-rounded sharpened shape and hence, an end portion of a liquid film of fuel which passes through the orifice 8 can be formed into a sharpened and pointed shape by which the end portion of the liquid film of fuel is easily atomized due to a friction between the end portion of the liquid film of fuel and air.

Sixteenth Modification of First Embodiment

Figure 20A:
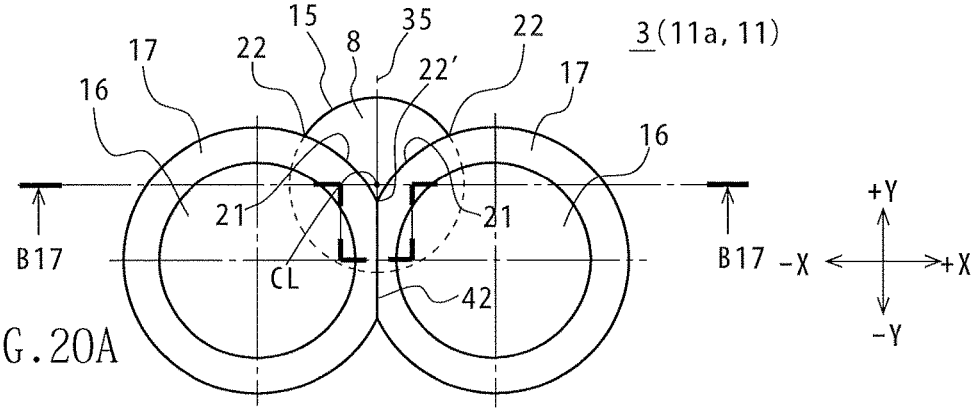
FIG. 20A and FIG. 20B are views showing an essential part of a nozzle plate for a fuel injection device according to a sixteenth modification of the first embodiment and views showing an example similar to the eighth modification (see FIG. 12).
Figure 20B:
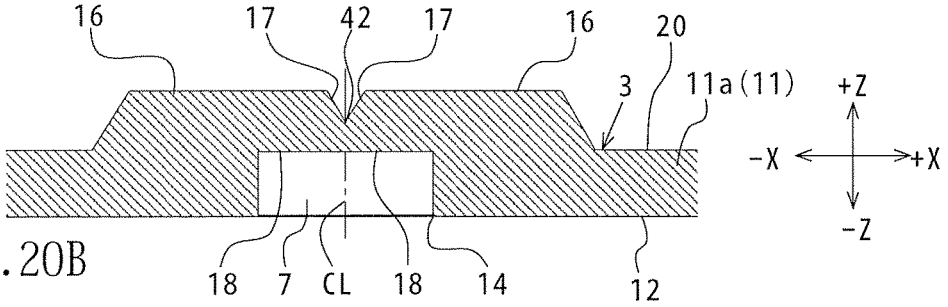

FIG. 20 illustrates views showing an essential part of a nozzle plate 3 according to a sixteenth modification of the first embodiment and views showing an example similar to the eighth modification (see FIG. 12). In the nozzle plate 3 according to this modification, constitutional portions substantially equal to the constitutional portions of the nozzle plates 3 according to the first embodiment and the eighth modification are given same symbols, and the explanations which overlap with the explanations of the nozzle plates 3 according to the first embodiment and the eighth modification are omitted.

In the nozzle plate 3 according to this modification, a pair of interference bodies 16, 16 is larger than a nozzle hole 7, an abutting portion 42 where the pair of interference bodies 16, 16 abut against each other is positioned on a center line (center line along a Y axis direction) 35 of the nozzle hole 7, one end (a corner portion 22') of the abutting portion 42 where the pair of interference bodies 16, 16 abut against each other is positioned in the vicinity of the center CL of the nozzle hole 7, and the other end of the abutting portion. 42 where the pair of interference bodies 16, 16 abut against each other is positioned outside the nozzle hole 7. In the nozzle plate 3 according to this modification, the nozzle hole 7 is partially closed by the pair of interference bodies 16, 16 so that an orifice 8 having an approximately sector shape is formed by an outlet-side opening portion 15 of the nozzle hole 7 and circular outer edge portions 21, 21 of the pair of interference bodies 16, 16. On an opening edge of the orifice 8, corner portions 22, 22 formed by the outlet-side opening portion 15 of the nozzle hole 7 and circular outer edge portions 21, 21 of the pair of interference bodies 16, 16 and a corner portion 22' formed on the abutting portion 42 where the pair of interference bodies 16, 16 abut against each other are formed. These corner portions 22, 22' of the orifice 8 are formed into a non-rounded pointed shape and hence, an end portion of a liquid film which passes through the orifice 8 can be formed into a thin film and hence, an end portion of a liquid film of fuel which passes through the orifice 8 can be formed into a thin film whereby the end portion of the liquid film of fuel which passes through the orifice 8 is easily atomized due to a friction between the end portion of the liquid film of fuel and air.

Further, the nozzle plate 3 according to this modification differs from the nozzle plate 3 according to the eighth modification with respect to a point that an opening area of the orifice 8 is small, and the orifice 8 is offset to a +Y direction side with respect to the center CL of the nozzle hole 7. As a result, the nozzle plate 3 according to this modification can exhibit a fuel injection characteristic different from a fuel injection characteristic of the nozzle plate 3 according to the eighth modification.

Seventeenth Modification of First Embodiment

Figure 21A:
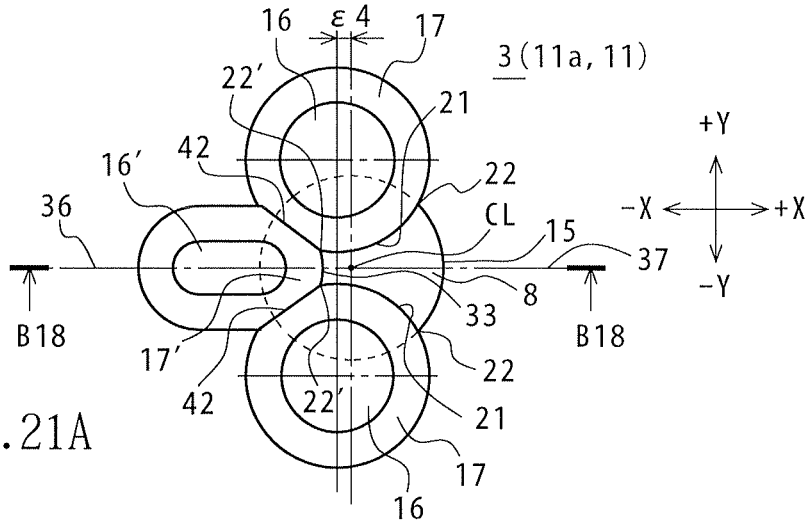
FIG. 21A and FIG. 21B are views showing an essential part of a nozzle plate for a fuel injection device according to a seventeenth modification of the first embodiment and views showing an example similar to the ninth modification (see FIG. 13).
Figure 21B:
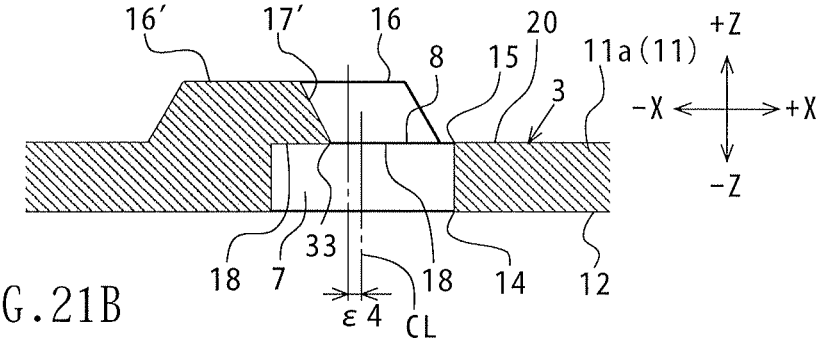

FIG. 21 illustrates views showing an essential part of a nozzle plate 3 according to a seventeenth modification of the first embodiment and views showing an example similar to the ninth modification (see FIG. 13). In the nozzle plate 3 according to this modification, constitutional portions substantially equal to the constitutional portions of the nozzle plates 3 according to the first embodiment and the ninth modification are given same symbols, and the explanations which overlap with the explanations of the nozzle plates 3 according to the first embodiment and the ninth modification are omitted.

The nozzle plate 3 according to this modification is such that, in the nozzle plate 3 according to the ninth modification, the interference body 16' positioned at the center portion is shifted to a −X axis direction, and the interference body 16' positioned adjacent to the interference body 16' positioned at the center portion in a +Y axis direction and the interference body 16' positioned adjacent to the interference body 16' positioned at the center portion in a −Y axis direction are changed to interference bodies 16, 16 having a frustoconical shape respectively. As a result, the nozzle plate 3 according to this modification can, compared to the nozzle plate 3 according to the ninth modification, narrow a distance between an orifice 8 and the interference bodies 16, 16 close to an X axis and hence, a larger amount of fuel can be ejected through an area close to a +X axis.

The pair of interference bodies 16, 16 have a line-symmetry shape with respect to the X axis, and the center position is disposed at a position shifted toward a −X axis direction from a Y axis by a predetermined size ε4.

Further, in the nozzle plate 3 according to this modification, corner portions 22, 2.2 formed by circular outer edge portions 21, 21 of a pair of interference bodies 16, 16 and an outlet-side opening portion 15 of a nozzle hole 7 and corner portions 22', 22' formed on the abutting portions 42, 42 where the pair of interference bodies 16, 16 and the interference body 16' abut against each other are formed into a non-rounded sharpened shape. That is, the corner portions 22, 22' can be formed into a sharpened and pointed shape by which an end portion of a liquid film of fuel which passes through the orifice 8 is easily atomized due to a friction between the end portion of the liquid film of fuel and air.

Eighteenth Modification of First Embodiment

Figure 22A:
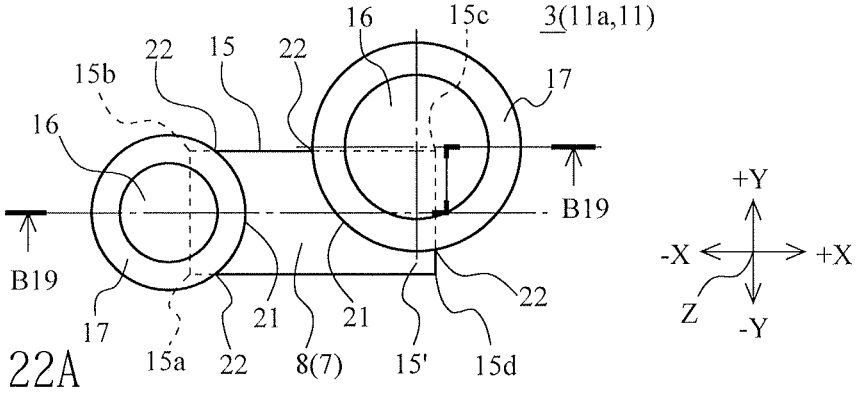
FIG. 22A to FIG. 22C are views showing an essential part of a nozzle plate for a fuel injection device according to an eighteenth modification of the first embodiment.
Figure 22B:
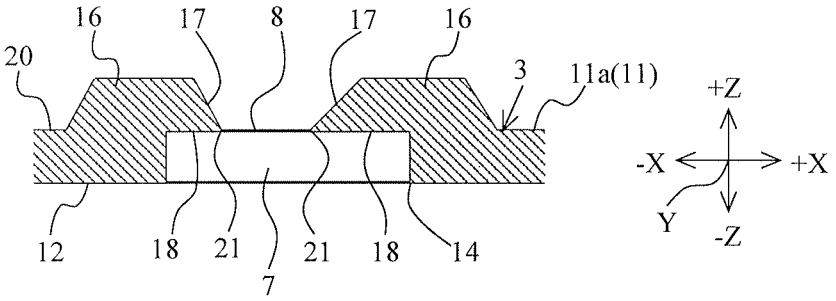

FIG. 22 illustrates views showing an essential part of a nozzle plate 3 according to an eighteenth modification of the first embodiment. In the nozzle plate 3 according to this modification, constitutional portions substantially equal to the constitutional portions of the nozzle plate 3 according to the first embodiment are given same symbols, and the explanations which overlap with the explanations of the nozzle plate 3 according to the first embodiment are omitted.

In the nozzle plate 3 according to this modification, a nozzle hole 7 is a hole having a rectangular shape, and an outlet-side opening portion 15 of the nozzle hole 7 is formed into a rectangular shape. A first interference body 16 is formed on one longitudinal end side of the rectangular outlet-side opening portion 15, and a second interference body 16 is formed on a corner portion 15*c* on the other longitudinal end side of the rectangular outlet-side opening portion 15. The first interference body 16 projects toward a nozzle hole 7 side so as to cover both corner portions 15*a*, 15*b* of the outlet-side opening portion 15 on one longitudinal end side thus partially closing the outlet-side opening portion 15. The second interference body 16 is formed larger than the first interference body 16, and covers one (15*c*) of both corner portions 15*c*, 15*d* positioned on the other longitudinal end side of the outlet-side opening portion 15, projects toward a nozzle hole 7 side so as to straddle over a long side and a short side which form one corner portion 15*c*, and partially closes the outlet-side opening portion 15. Further, in this modification, an area where the second interference body 16 partially closes the outlet-side opening portion 15 is larger than an area where the first interference body 16 partially closes the outlet-side opening portion 15. An opening edge of an orifice 8 is formed by arcuate outer edge portions 21, 21 of the first and second interference bodies 16, 16 and the outlet-side opening portion 15 of the nozzle hole 7. Further, in the nozzle plate 3 according to this modification, four corner portions 22 are formed by circular outer edge portions 21, 21 of the first and second interference bodies 16, 16 and the outlet-side opening portion 15 of the nozzle hole 7. Four corner portions 22 are formed into a non-rounded sharpened shape so that the corner portions 22 can be formed into a sharpened and pointed shape by which an end portion of a liquid film of fuel which passes through the orifice 8 is easily atomized due to a friction between the end portion of the liquid film of fuel and air. Further, in the nozzle plate 3, an opening portion 15' narrower than other portions of the outlet-side opening portion 15 is formed between the arcuate outer edge portion 21 of the second interference body 16 and the opening edge of the outlet-side opening portion 15. This narrow opening portion 15' can partially form the flow of fuel which passes through the nozzle hole 7 into a thin film.

In the nozzle plate 3 according to this modification having such a constitution, a portion of fuel which passes through the nozzle hole 7 impinges on a fuel impinging surface 18 of the first interference body 16. The flow direction of fuel which impinges on the fuel impinging surface 18 is sharply changed in a +X direction. A portion of fuel which passes through the nozzle hole 7 impinges on a fuel impinging surface 18 of the second interference body 16, and the flow direction of fuel which impinges on the fuel impinging surface 18 is sharply changed to the substantially −Y direction (see FIG. 22A). As a result, the flow of fuel whose flow direction is sharply changed due to the impingement of fuel on the fuel impinging surfaces 18, 18 of the first interference body 16 and the second interference body 16 and the flow of fuel which advances straightly in the nozzle 7 impinge on each other and hence, the flow of fuel which passes through the nozzle hole 7 and the orifice 8 becomes a turbulent flow. Then, fuel injected from the orifice 8 becomes the flow mainly inclined with respect to a +Z direction (inclined toward an intermediate direction between the +X axis and the −Y axis in FIG. 22A). Further, as described previously, in the nozzle plate 3 according to this modification, four corner portions 22 which are formed by circular outer edge portions 21, 21 of the first and second interference bodies 16, 16 and the outlet-side opening portion 15 of the nozzle hole 7 are formed into a non-rounded sharpened and pointed shape so that the corner portions 22 are formed into a shape by which an end portion of a liquid film of fuel which passes through the orifice 8 is easily atomized due to a friction between the end portion of the liquid film of fuel and air. Accordingly, the nozzle plate 3 according to this modification can, compared to the conventional nozzle plates, further enhance the level of atomization of fuel injected from the orifice 8.

Figure 22C:
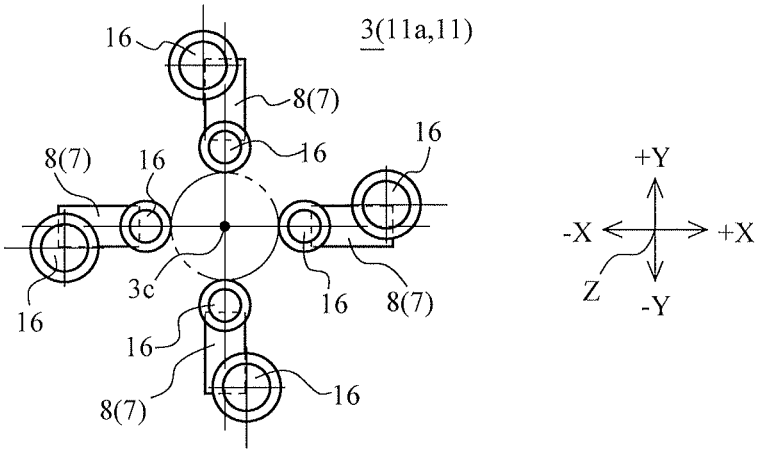

FIG. 22C is a plan view showing a center portion side of the nozzle plate 3 for a fuel injection device according to this modification. As shown in FIG. 22C, with respect to the nozzle plates 3 for a fuel injection device according to this modification, the nozzle hole 7 and the first and second interference bodies 16, 16 are arranged in four places at equal intervals around the nozzle plate center 3*c*. In the nozzle plate 3 for a fuel injection device according to this modification, fuel injected from the respective nozzle holes 7 (orifices 8) generates a spiral flow about the nozzle plate center 3*c*. FIG. 22C shows merely one example of the case where a plurality of sets each of which is formed of the nozzle hole 7 and the first and second interference bodies 16, 16 are arranged around the nozzle plate center 3*c*, and this modification is not limited by the configuration shown in FIG. 22C. That is, in this modification, the optimum number of sets each of which is formed of the nozzle hole 7 and the first and second interference bodies 16, 16 which correspond to the use condition or the like may be arranged around the nozzle plate center 3*c*.

Nineteenth Modification of First Embodiment

Figure 23A:
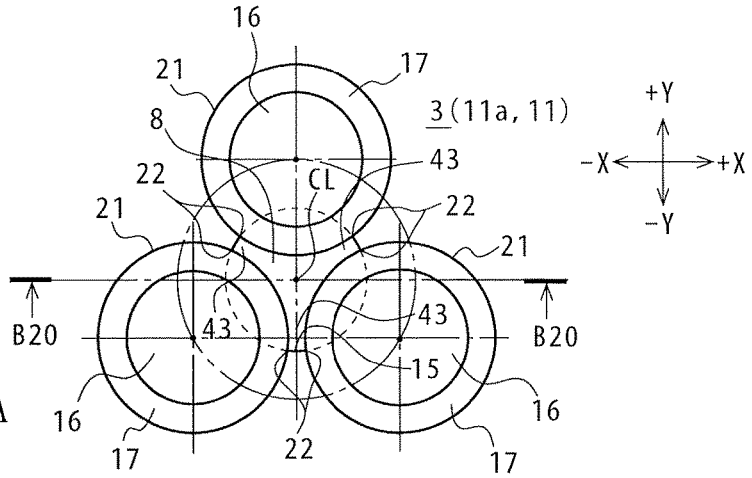
FIG. 23A and FIG. 23B are views showing an essential part of a nozzle plate for a fuel injection device according to a nineteenth modification of the first embodiment.
Figure 23B:
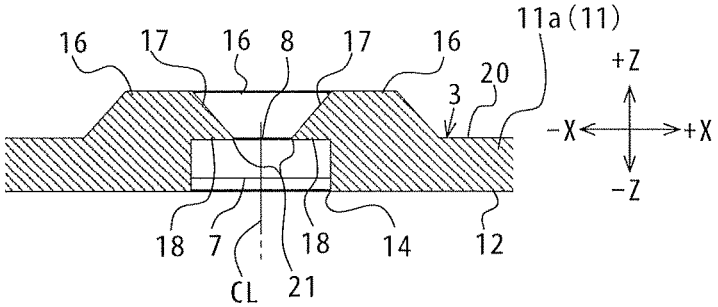

FIG. 23 illustrates views showing an essential part of a nozzle plate 3 according to a nineteenth modification of the first embodiment. In the nozzle plate 3 according to this modification, constitutional portions substantially equal to the constitutional portions of the nozzle plate 3 according to the first embodiment are given same symbols, and the explanations which overlap with the explanations of the nozzle plate 3 according to the first embodiment are omitted.

In the nozzle plate 3 according to this modification, three interference bodies 16, 16, 16 are arranged at equal intervals from each other around the circular outlet-side opening portion 15 of the nozzle hole 7, and a gap 43 is formed between the interference bodies 16, 16 arranged adjacent to each other. Further, in the nozzle plate 3 according to this modification, the orifice 8 is formed by the outlet-side opening portion 15 of the nozzle hole 7 and three interference bodies 16, 16, 16.

In the nozzle plate 3 according to this modification, six corner portions 22 are formed by the circular outer edge portions 21 of three interference bodies 16 and the outlet-side opening portion 15 of the nozzle hole 7, and these six corner portions 22 are formed into a non-rounded sharpened shape so that the corner portions 22 are formed into a sharpened and pointed shape by which an end portion of a liquid film of fuel which passes through the orifice 8 is easily atomized due to a friction between the end portion of the liquid film of fuel and air.

In the nozzle plate 3 according to this modification, areas which three interference bodies 16 close the nozzle hole 7 respectively are equal, and a flow passage area of the orifice 8 is gradually decreased in the direction toward an opening edge (outlet-side opening portion 15) of the nozzle hole 7 from the center CL of the nozzle hole 7. Accordingly, the flow of fuel can be easily collected toward the center of the nozzle hole 7, and fuel can be injected in the direction along the center line direction (+Z axis direction) of the nozzle hole 7.

In the nozzle plate 3 according to this modification, the gap 43 formed between the interference bodies 16, 16 arranged adjacent to each other is narrowed in the vicinity of the corner portions 22, 22 and hence, the flow of fuel which passes through areas in the vicinity of the corner portions 22, 22 of the orifice 8 can be formed into a thin film whereby the flow of fuel which passes through the areas in the vicinity of the corner portions 22, 22 of the orifice 8 can be easily atomized due to a friction between the flow of fuel and air.

Twentieth Modification of First Embodiment

Figure 24A:
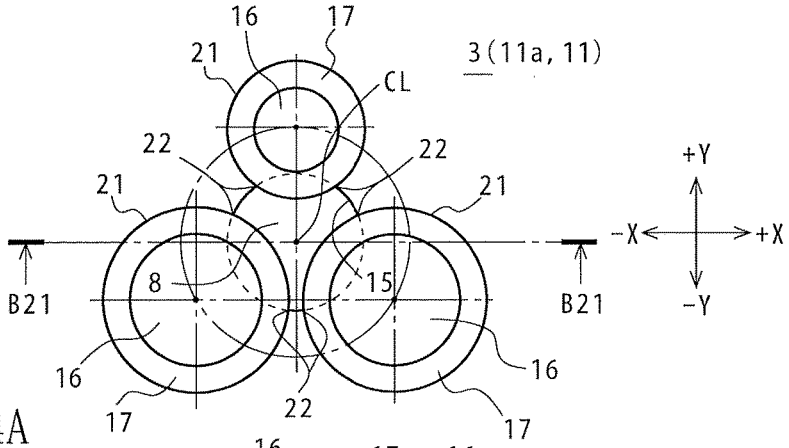
FIG. 24A and FIG. 24B are views showing an essential part of a nozzle plate for a fuel injection device according to a twentieth modification of the first embodiment and views showing an example similar to the nineteenth modification (see FIG. 23).
Figure 24B:
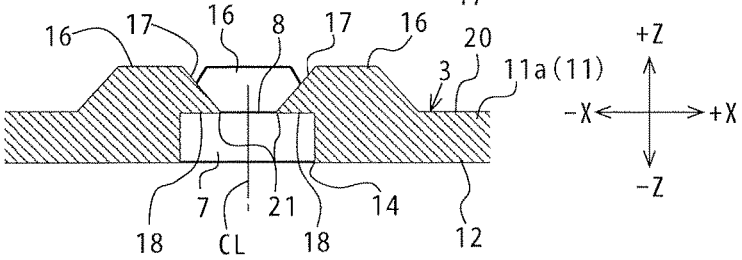

FIG. 24 illustrates views showing an essential part of a nozzle plate 3 according to a twentieth modification of the first embodiment and views showing an example similar to the nineteenth modification (see FIG. 23). In the nozzle plate 3 according to this modification, constitutional portions substantially equal to the constitutional portions of the nozzle plates 3 according to the first embodiment and the nineteenth modification are given same symbols, and the explanations which overlap with the explanations of the nozzle plates 3 according to the first embodiment and the nineteenth modification are omitted.

The nozzle plate 3 according to this modification is substantially equal to the nozzle plate 3 according to the nineteenth modification with respect to the point that three interference bodies 16 are arranged at equal intervals from each other around the nozzle hole 7. However, the nozzle plate 3 according to this modification differs from the nozzle plate 3 according to the nineteenth modification with respect to the following points.

That is, in the nozzle plate 3 according to this modification, the interference body 16 positioned in a +Y direction with respect to the center CL of a nozzle hole 7 is formed smaller than two other interference bodies 16, 16, an area that the small interference body 16 closes the nozzle hole 7 is smaller than areas which other interference bodies 16, 16 close the nozzle hole 7, and the position of centroid of the orifice 8 in FIG. 24A is shifted in the +Y direction from the center CL of the nozzle hole 7. As a result, in the nozzle plate 3 according to this modification, the fuel injection direction from the orifice 8 can be shifted in the +Y direction with respect to the center CL of the nozzle hole 7.

In the nozzle plate 3 according to this modification, in the same manner as the nozzle plate 3 according to the nineteenth modification, the corner portions 22 are formed in six places by circular outer edge portions 21 of three interference bodies 16 and outlet-side opening portions 15 of the nozzle hole 7. These six corner portions 22 are formed into a non-rounded sharpened shape so that the corner portions 22 are formed into a sharpened and pointed shape by which an end portion of a liquid film of fuel which passes through an orifice 8 is easily atomized due to a friction between the end portion of the liquid film of fuel and air.

In the nozzle plate 3 according to this modification, the mode is exemplified where, out of three interference bodies 16 formed in the nozzle plate 3 according to the nineteenth modification, the interference body 16 positioned in the +Y direction is formed smaller than other interference bodies 16, 16. However, this modification is not limited to such a mode, and any one of three interference bodies 16 may be formed smaller than two other interference bodies 16 depending on the direction along which the injection direction of fuel from the orifice 8 is shifted with respect to the center CL of the nozzle hole 7.

In the nozzle plate 3 according to this modification, out of three interference bodies 16 of the nozzle plate 3 according to the nineteenth modification, two arbitrary interference bodies 16 may be formed smaller than remaining one interference body 16.

Other Modifications

In the above-mentioned first embodiment and the first to twentieth modifications, the nozzle plates 3 made of a synthetic resin material are exemplified. However, the present invention is not limited to such nozzle plates 3 and is applicable to nozzle plates made of sintered metal which are formed by using a metal injection molding method.

In the above-mentioned first embodiment and the first to twentieth modifications, the modes where a pair of nozzle holes 7, 7 and a pair of orifices 8 are formed in the nozzle plate 3 are exemplified. However, the present invention is not limited to such modes, and a single nozzle hole 7 and a single orifice 8 may be formed in a nozzle plate 3, a plurality of (three or more) nozzle holes 7 and a plurality of orifices 8 the number of which is equal to the number of nozzle holes 7 may be formed in a nozzle plate 3, or orifices 8 the number of which is larger than the number of nozzle holes 7 may be formed in a nozzle plate 3.

In the above-mentioned first embodiment and the first to twentieth modifications, modes where an inclination angle θ of the side surfaces 17, 17' of the interference bodies 16, 16' is set to satisfy a relationship of $0° < \theta$ are exemplified. However, the present invention is not limited to such modes, and the inclination angle θ may be set to satisfy a relationship of $0° = \theta$.

The nozzle plate 3 may be formed by suitably combining the nozzle plates 3 described in the above-mentioned first embodiment and the first to twentieth modifications.

Second Embodiment

Figure 25A:
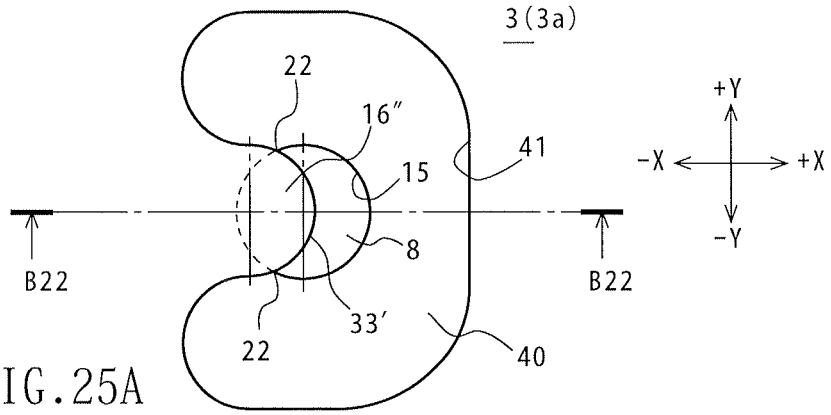
FIG. 25A and FIG. 25B are views showing an essential part of a nozzle plate for a fuel injection device according to a second embodiment of the present invention and views which correspond to FIG. 3A and FIG. 3B.
Figure 25B:
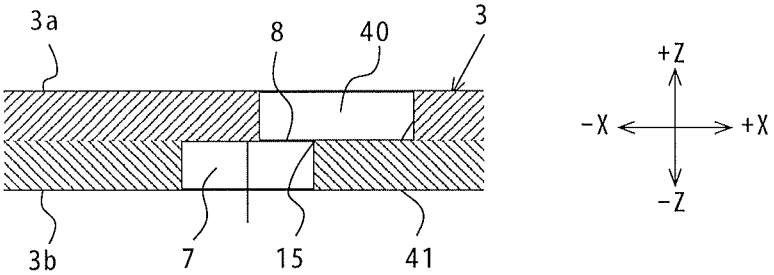
Figure 26A:
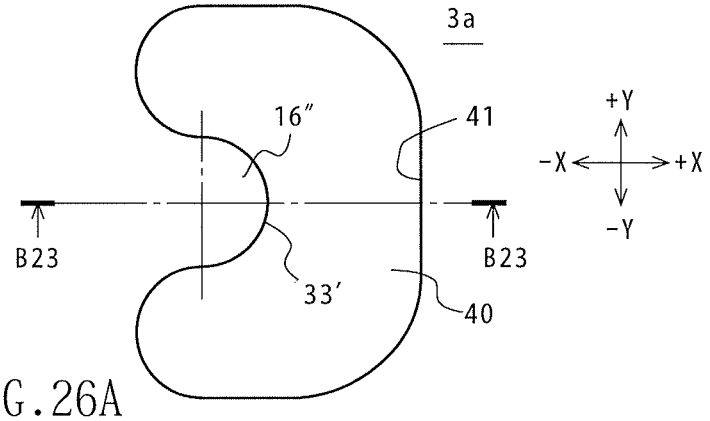
FIG. 26A and FIG. 26B are views showing an essential part of a first nozzle plate which forms the nozzle plate for a fuel injection device according to the second embodiment of the present invention.
Figure 26B:
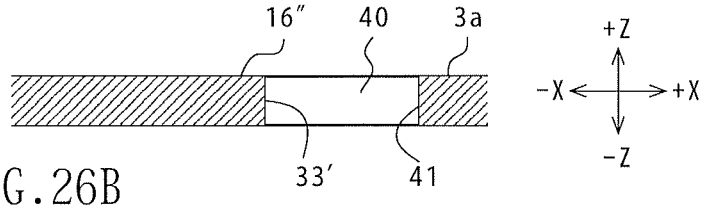
Figure 27A:
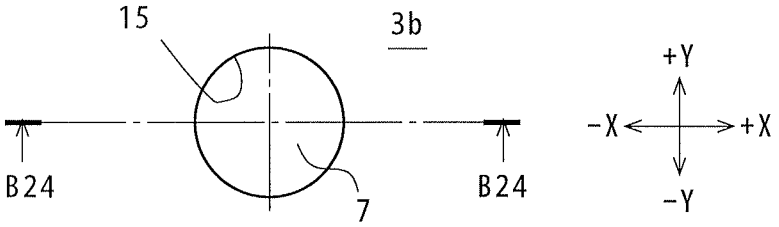
FIG. 27A and FIG. 27B are views showing an essential part of a second nozzle plate which forms the nozzle plate for a fuel injection device according to the second embodiment of the present invention.
Figure 27B:
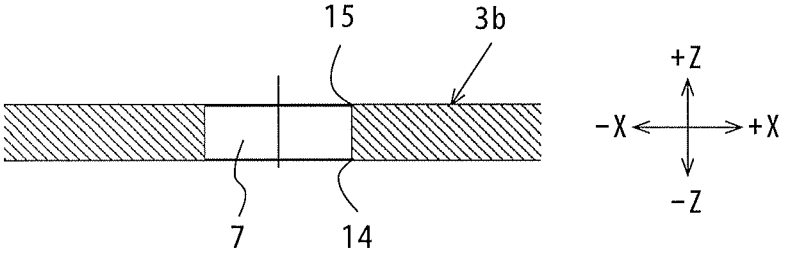

FIG. 25 to FIG. 27 illustrate views showing a portion of a nozzle plate 3 according to a second embodiment of the present invention in an enlarged manner. In these drawings, FIG. 25A is a plan view of the nozzle plate 3 (a view corresponding to FIG. 3A), and FIG. 25B is a cross-sectional view of the nozzle plate 3 taken along a line B22-B22 in FIG. 25A. FIG. 26A is a plan view of a first nozzle plate 3*a*, and FIG. 26B is a cross-sectional view of the first nozzle plate 3*a* taken along a line B23-B23 in FIG. 26A. FIG. 27A is a plan view of a second nozzle plate 3*b*, and FIG. 27B is a cross-sectional view of the second nozzle plate 31) taken along a line B24-B24 in FIG. 27A.

As shown in these drawings, the nozzle plate 3 according to this embodiment is formed by overlapping the first nozzle plate 3*a* and the second nozzle plate 3*b* which are formed by applying press forming to a metal plate (for example, stainless steel plate). A nozzle hole 7 which is a circular hole is formed in the second nozzle plate 3*b*. A fuel leaking hole 40 is formed in the first nozzle plate 3*a*, and an interference body 16" which partially closes a circular outlet-side opening portion 15 of the nozzle hole 7 is formed on the first nozzle plate 3*a*. As viewed in a plan view, with respect to a shape of the interference body 16" of the first nozzle plate 3*a*, the interference body 16" is formed into a tongue-shaped body formed by projecting one side of the fuel leaking hole 40 having an approximately rectangular shape toward the other side which opposedly faces one side, and a distal end side of the interference body 16" is rounded in a semicircular shape. Accordingly, an orifice 8 having a crescent shape is formed between a semicircular outer edge portion (arcuate outer edge portion, outer edge portion) 33' on the distal end side and a circular outlet-side opening portion 22 of the nozzle hole 7. The corner portions 22, 22 of an opening edge of the orifice 8 formed by the outlet-side opening portion 15 of the nozzle hole 7 and the semicircular outer edge portion 33' of the interference body 16" are formed into a non-rounded sharpened shape. That is, the corner portions 22, 22 are formed into a sharpened and pointed shape by which an end portion of a liquid film of fuel which passes through the orifice 8 can be easily atomized due to a friction between the end portion of the liquid film of fuel and air.

With respect to the fuel leaking hole 40 formed in the first nozzle plate 3*a*, a side surface 41 of the fuel leaking hole 40 excluding the interference body 16" is formed such that the side surface 41 of the fuel leaking hole 40 excluding the interference body 16" is largely separated from the outlet-side opening portion 15 of the nozzle hole 7 so as to prevent the side surface 41 of the fuel leaking hole 40 excluding the interference body 16" from obstructing fuel sprayed from the orifice 8. In the first nozzle plate 3*a*, four corners of the fuel leaking hole 40 are rounded for the sake of convenience of forming the fuel leaking hole 40 using a press.

The first nozzle plate 3*a* and the second nozzle plate 3*b* are made to overlap with each other in a state where the first nozzle plate 3*a* and the second nozzle plate 3*b* are positioned due to concave-convex engagement or the like between positioning projections and positioning holes not shown in the drawing for accurately positioning the interference body 16" with respect to the nozzle hole 7.

The nozzle plate 3 according to this embodiment can acquire the substantially equal advantageous effects as the nozzle plate 3 according to the first embodiment.

Third Embodiment

Figure 28C:
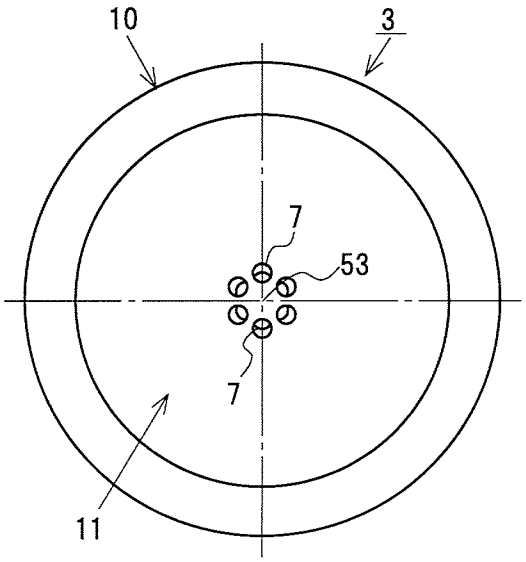
FIG. 28A to FIG. 28C are views showing a nozzle plate for a fuel injection device according to a third embodiment of the present invention.
Figure 28B:
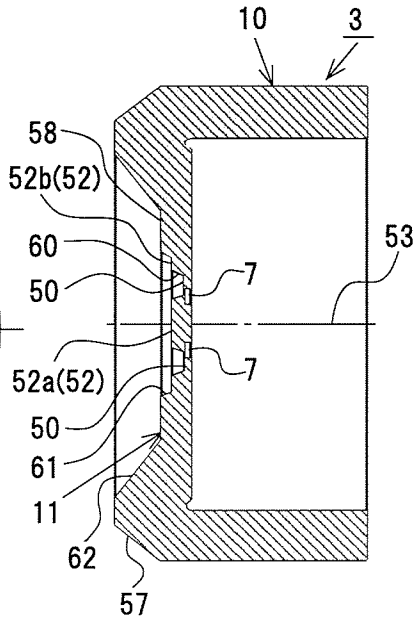
Figure 28A:
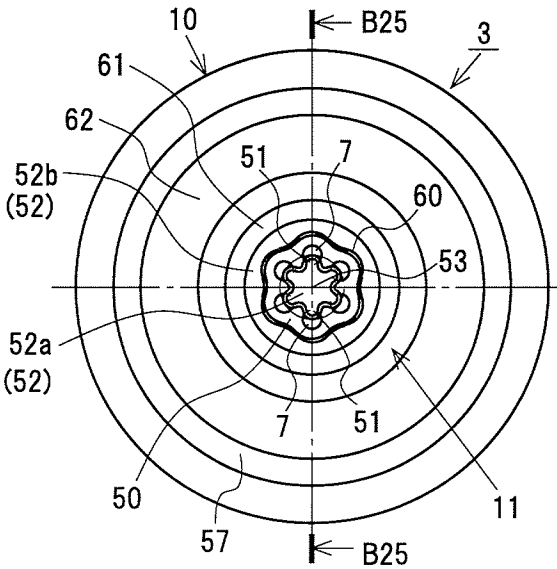
Figure 29A:
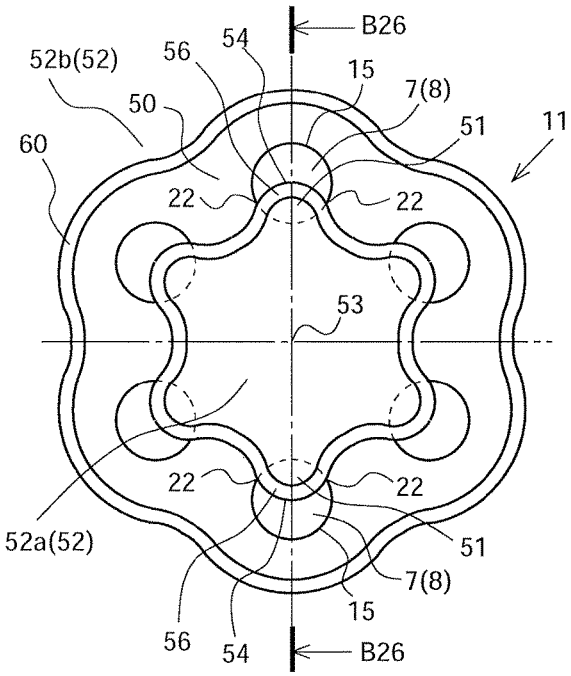
FIG. 29A is an enlarged view of a center portion of the nozzle plate shown in FIG. 28A.
Figure 29B:
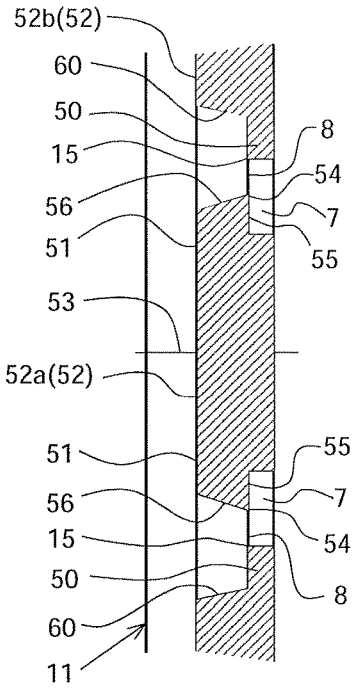
FIG. 29B is a cross-sectional view taken along a line B26-B26 in FIG. 29A.

FIG. 28 and FIG. 29 illustrate views showing a nozzle plate 3 according to a third embodiment of the present invention. FIG. 28A is a front view of the nozzle plate 3, FIG. 28B is a cross-sectional view of the nozzle plate 3 taken along a line B25-B25 in FIG. 28A, and FIG. 28C is a back view of the nozzle plate 3. FIG. 29A is an enlarged view of a center portion of the nozzle plate 3 shown in FIG. 28A, and FIG. 29B is a cross-sectional view of the center portion of the nozzle plate 3 taken along a line B26-B26 in FIG. 29A.

As shown in FIG. 28 and FIG. 29, the nozzle plate 3 according to this embodiment is a bottomed cylindrical body which is an integral body formed of a cylindrical wall portion 10 and a bottom wall portion 11 formed so as to close one end of the cylindrical wall portion 10. The bottom wall portion 11 has a nozzle hole plate portion 50 where a nozzle hole 7 is formed, and an interference body plate portion 52 where an interference body 51 is formed. The interference body plate portion 52 is formed such that a portion of the bottom wall portion 11 around a center axis 53 is counterbored. The nozzle hole plate portion 50 is formed into a shape where a portion of the interference body plate portion 52 around the center axis 53 is partially counterbored in a ring shape. Nozzle holes 7 are formed in the bottom wall portion 11 in six places at equal intervals from each other around the center axis 53, and a portion of the nozzle hole 7 is formed in a penetrating manner in the nozzle hole plate portion 50 from a front side to a back side (such that the nozzle hole 7 opens on the front and back sides). With respect to the bottom wall portion 11, a plurality of interference bodies 51 each of which closes a portion of the nozzle hole 7 are formed on an interference body plate portion 52*a* (52) on an inner side surrounded by the nozzle hole plate portion 50.

The number of the interference bodies 51 is equal to the number of the nozzle holes 7. The interference body 51 corresponds to the interference bodies 16, 16' of the nozzle plate 3 according to the first embodiment, an orifice 8 is formed by partially closing the nozzle hole 7, and the interference body 51 has an arcuate outer edge portion (outer edge portion) 54 which forms a portion of an opening edge of the orifice 8. A corner portion 22 of the opening edge of the orifice 8 formed by the arcuate outer edge portion 54 of the interference body 51 and a circular outlet-side opening portion 15 of the nozzle hole 7 is formed into a non-rounded sharpened shape. That is, the corner portion 22 is formed into a sharpened shape by which an end portion of a liquid film of fuel which passes through the orifice 8 is easily atomized due to a friction between the end portion of the liquid film of fuel and air. According to the nozzle plate 3 of this embodiment, with respect to fuel injected from the orifice 8, a liquid film of fuel injected from both corner portions 22, 22 of the orifice 8 and areas in the vicinity of the corner portions 22, 22 is formed into a thin, sharpened and pointed state and hence, fuel injected from the corner portions 22, 22 of the orifice 8 and areas in the vicinity of the corner portions 22, 22 is easily atomized due to a friction between the liquid film and air in the vicinity of the orifice 8.

The interference body 51 has a fuel impinging surface 55 on which a portion of fuel which passes through the nozzle hole 7 impinges, and a side surface (inclined surface) 56 which intersects with the fuel impinging surface 55 at an acute angle (for example, 75°). By making a portion of fuel which passes through the nozzle hole 7 impinge on the fuel impinging surface 55 of the interference body 51, the portion of fuel which passes through the nozzle hole 7 is atomized, the flow of the portion of fuel which passes through the nozzle hole 7 is sharply bent, and is made to impinge on fuel which intends to advance straightly and passes through the nozzle hole 7 and the orifice 8 thus forming the flow of fuel into a turbulent flow such that fuel which passes through the orifice 8 is easily atomized in air. Further, an air layer is formed between fuel which passes through the orifice 8 and the side surface 56 of the interference body 51 and hence, fuel which passes through the orifice 8 is easily entrapped into air whereby the atomization of fuel which passes through the orifice 8 is accelerated thus facilitating the uniform dispersion of atomized fuel in the intake pipe 2.

The bottom wall portion 11 is formed at a position where a nozzle guard projection 57 surrounds the nozzle hole plate portion 50 and on a radially outer end side of an outer surface 58. The nozzle guard projection 57 is formed so as to project along the direction that a center axis of the valve body 5 extends in a state where the nozzle plate 3 is mounted on a distal end side of the valve body 5 (see FIG. 2). The nozzle guard projection 57 is an annular body formed along the circumferential direction of the bottom wall portion 11. The nozzle guard projection 57 is formed so as to form a gap between an imaginary plane and the bottom wall portion 11 when a distal end of the nozzle guard projection 57 is brought into contact with the imaginary plane. In this manner, at the time of assembling the nozzle plate 3 to the valve body 5, the nozzle guard projection 57 formed on the bottom wall portion 11 prevents a tool or the like from impinging on the nozzle hole 7 and the area around the nozzle hole 7 thus preventing the occurrence of a damage on the nozzle hole 7 formed in the bottom wall portion 11 and the area around the nozzle hole 7. Further, at the time of assembling the fuel injection device 1 where the nozzle plate 3 is assembled to the valve body 5 to an intake pipe 2 of the engine, the nozzle guard projection 57 prevents engine parts or the like from impinging on the nozzle hole 7 and the area around the nozzle hole 7 thus preventing the occurrence of a damage on the nozzle hole 7 formed in the bottom wall portion 11 and the portions around the nozzle hole 7.

In the bottom wall portion 11, a side surface 60 which connects an outer surface of an outer interference body plate portion 52*h* (52) positioned outside the nozzle hole plate portion 50 and an outer surface of the nozzle hole plate portion 50 to each other is formed into a waveform in conformity with an outer edge of an interference body plate portion 52*a* (52) positioned on an inner side of the nozzle hole plate portion 50. The side surface 60 is positioned substantially at an equal distance from the outer edge of the interference body plate portion 52*a* (52). The side surface 60 which connects the outer surface of the nozzle hole plate portion 50 and the outer surface of the outer interference body plate portion 52*b* (52) to each other, a side surface 61 which connects the outer surface of the interference body plate portion 52*b* (52) and the outer surface of the bottom wall portion 11, and a side surface 62 of the nozzle guard projection 57 are formed so as not to obstruct spraying of fuel injected from the orifice 8 by taking into account the flow direction (injection direction) of fuel injected from the orifice 8.

The nozzle plate 3 according to this embodiment having the above-mentioned configuration can, compared to a case where the interference body 16 is formed on respective nozzle holes 7 separately (see FIG. 2), increase a wall thickness of the nozzle plate 3 around the nozzle hole 7 in a wide range and hence, a strength of portions around the nozzle hole 7 can be improved.

Further, according to the nozzle plate 3 of this embodiment, in the same manner as the nozzle plate 3 according to the first embodiment, with respect to fuel injected from the orifice 8, a liquid film of fuel injected from both corner portions 22, 22 of the orifice 8 and areas in the vicinity of the corner portions 22, 22 is formed into a thin, sharpened and pointed state and hence, fuel injected from the corner portions 22, 22 of the orifice 8 and areas in the vicinity of the corner portions 22, 22 is easily atomized due to a friction between the liquid film and air in the vicinity of the orifice 8.

In this embodiment, the mode is exemplified where the nozzle holes 7 are formed in six places at equal intervals around the center axis 53 of the bottom wall portion 11. However, the present invention is not limited to such a mode, and the nozzle holes 7 may be formed in plural (two or more) places at equal intervals or at irregular intervals around the center axis 53 of the bottom wall portion 11. In this embodiment, the interference body plate portions 52*a*, 52*b* have different planer shapes depending on the number of the nozzle holes 7 and the arrangement of the nozzle holes 7. Further, in this embodiment, wall thicknesses of the interference body plate portion 52 and the nozzle hole plate portion 50 of the bottom wall portion 11 are suitably changed corresponding to a required fuel injection characteristic or the like.

Fourth Embodiment

Figure 30C:
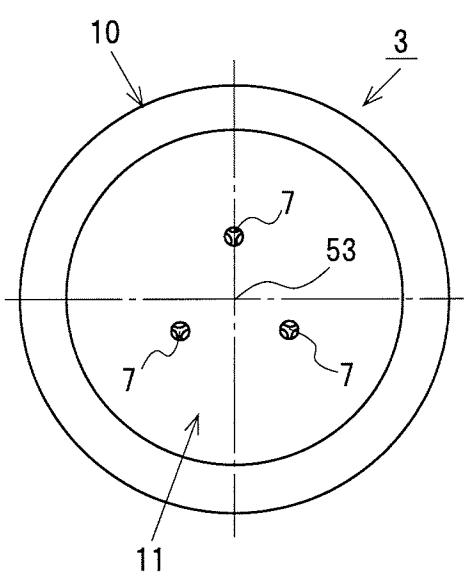
FIG. 30A to FIG. 30C are views showing a nozzle plate according to a fourth embodiment of the present invention.
Figure 30B:
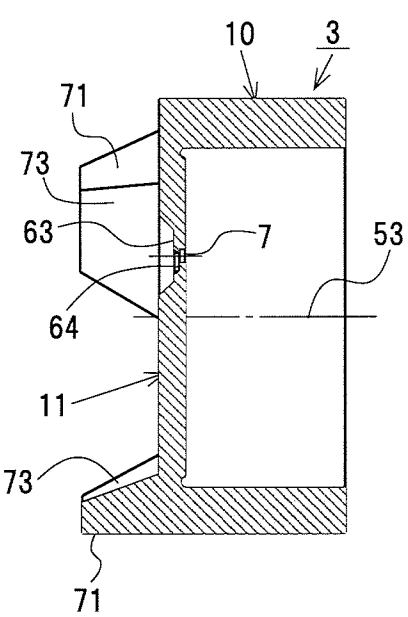
Figure 30A:
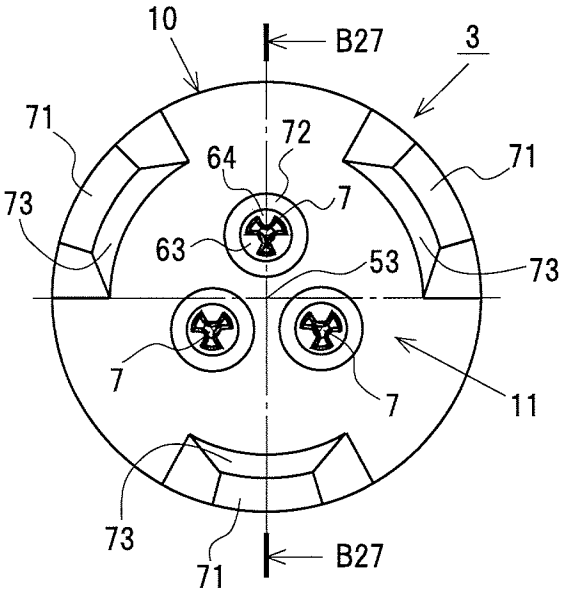
Figure 31A:
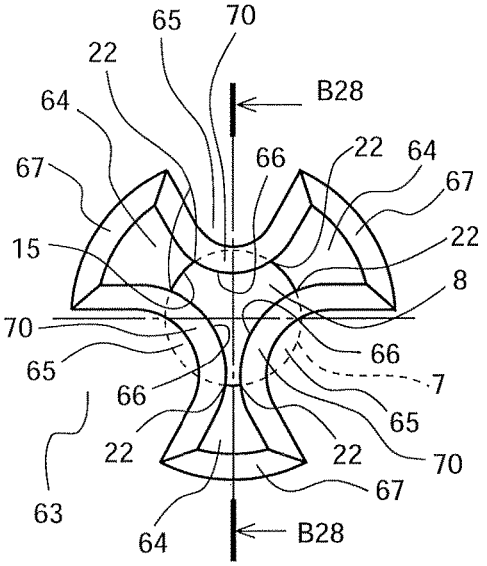
FIG. 31A is an enlarged view of a center portion (nozzle portion) of the nozzle plate shown in FIG. 30A.
Figure 31B:
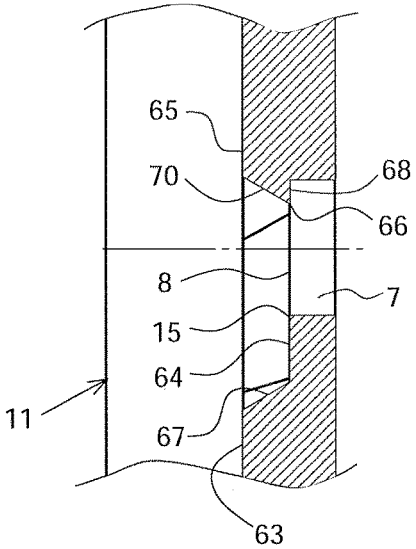
FIG. 31B is a cross-sectional view taken along a line B28-B28 in FIG. 31A.

FIG. 30 and FIG. 31 illustrate views showing a nozzle plate 3 according to a fourth embodiment of the present invention and views showing a modification of the nozzle plate 3 shown in FIG. 24. FIG. 30A is a front view of the nozzle plate 3, FIG. 30B is a cross-sectional view of the nozzle plate 3 taken along a line B27-B27 in FIG. 30A, and FIG. 30C is a back view of the nozzle plate 3. FIG. 31A is an enlarged view of a center portion of the nozzle plate 3 shown in FIG. 30A, and FIG. 31B is a cross-sectional view of the center portion of the nozzle plate 3 taken along a line B28-B28 in FIG. 31A.

As shown in FIG. 30 and FIG. 31, the nozzle plate 3 according to this embodiment is a bottomed cylindrical body which is an integral body formed of a cylindrical wall portion 10 and a bottom wall portion 11 formed so as to close one end of the cylindrical wall portion 10. Nozzle holes 7 are formed in the bottom wall portion 11 in three places at equal intervals around a center axis 53. The bottom wall portion 11 is counterbored in an inverse frustoconical shape so as to surround the nozzle holes 7. An interference body plate portion 63 is formed around the nozzle hole 7, and a nozzle hole plate portion 64 is formed by partially counterboring the interference body plate portion 63. The interference body plate portion 63 is formed with a larger wall thickness than the nozzle hole plate portion 64. The area around the nozzle hole 7 is formed into a shape similar to a shape formed by integrally joining three interference bodies 16 shown in FIG. 24A. The interference body plate portions 63 are formed in three places corresponding to the nozzle holes 7 formed in three places. Interference bodies 65 of the interference body plate portions 63 correspond to the interference bodies 16 of the nozzle plate 3 according to the first embodiment, and are formed in three places so as to partially close the nozzle holes 7 in three places. Each one of the interference bodies 65 in three places corresponds to any one of three interference bodies 16 of the nozzle plate 3 shown in FIG. 24A. These three interference bodies 65 form an orifice 8 by partially closing the nozzle hole 7, and the interference bodies 65 have arcuate outer edge portions (outer edge portions) 66 which form portions of an opening edge of the orifice 8. Corner portions 22 of the opening edge of the orifice 8 formed by the arcuate outer edge portions 66 of the interference bodies 65 and a circular outlet-side opening portion 15 of the nozzle hole 7 are formed into a non-rounded sharpened shape. That is, the corner portions 22 are formed into a sharpened shape by which an end portion of a liquid film of fuel which passes through the orifice 8 is easily atomized due to a friction between the end portion of the liquid film of fuel and air. According to the nozzle plate 3 of this embodiment, with respect to fuel injected from the orifice 8, a liquid film of fuel injected from both corner portions 22, 22 of the orifice 8 and areas in the vicinity of the corner portions 22, 22 is formed into a thin, sharpened and pointed state and hence, fuel injected from the corner portions 22, 22 of the orifice 8 and areas in the vicinity of the corner portions 22, 22 is easily atomized due to a friction between the liquid film and air in the vicinity of the orifice 8.

A portion of the nozzle hole 7 is formed in a penetrating manner in the nozzle hole plate portion 64 having a smaller wall thickness than the interference body plate portion 63 from a front side to a back side (such that the nozzle hole 7 opens on the front and back sides). Further, a side surface 67 of the interference body plate portion 63 which connects the interference bodies 65, 65 arranged adjacent to each other is formed at a position which does not obstruct spraying of fuel by taking into account the injection direction of fuel injected from an outlet-side opening portion 15 of the nozzle hole 7.

The interference body 65 has a fuel impinging surface 68 on which a portion of fuel which passes through the nozzle hole 7 impinges, and a side surface (inclined surface) 70 which intersects with the fuel impinging surface 68 at an acute angle (for example, 75°). By making a portion of fuel which passes through the nozzle hole 7 impinge on the fuel impinging surface 68 of the interference body 65, the portion of fuel which passes through the nozzle hole 7 is atomized, the flow of the portion of fuel which passes through the nozzle hole 7 is sharply bent, and is made to impinge on fuel which intends to advance straightly and passes through the nozzle hole 7 and the orifice 8 thus forming the flow of fuel into a turbulent flow such that fuel which passes through the orifice 8 is easily atomized in air. Further, an air layer is formed between fuel which passes through the orifice 8 and the side surface 70 of the interference body 65 and hence, fuel which passes through the orifice 8 is easily entrapped into air whereby the atomization of fuel which passes through the orifice 8 is accelerated thus facilitating the uniform dispersion of atomized fuel in the intake pipe 2 (see FIG. 1).

In the bottom wall portion 11, nozzle guard projections 71 are formed at equal intervals in three places along the circumferential direction on a radially outer end side of an outer surface of the bottom wall portion 11. The nozzle guard projections 71 are formed so as to project along the direction that a center axis of the valve body 5 extends in a state where the nozzle plate 3 is mounted on a distal end side of the valve body 5 (see FIG. 2). The nozzle guard projection 71 is a block body formed so as to be positioned in a middle portion between the nozzle holes 7, 7 arranged adjacent to each other. The nozzle guard projections 71 are formed so as to form a gap between an imaginary plane and the bottom wall portion 11 when distal ends of the nozzle guard projections 71 are brought into contact with the imaginary plane. In this manner, at the time of assembling the nozzle plate 3 to the valve body 5, the nozzle guard projections 71 formed on the bottom wall portion 11 in three places prevent a tool or the like from impinging on the nozzle hole 7 and the area around the nozzle hole 7 thus preventing the occurrence of a damage on the nozzle hole 7 formed in the bottom wall portion 11 and portions around the nozzle hole 7. Further, at the time of assembling the fuel injection device 1 where the nozzle plate 3 is assembled to the valve body 5 to an intake pipe 2 of the engine, the nozzle guard projections 71 prevent engine parts or the like from impinging on the nozzle hole 7 and the area around the nozzle hole 7 thus preventing the occurrence of a damage on the nozzle hole 7 formed in the bottom wall portion 11 and the portions around the nozzle hole 7.

In the bottom wall portion 11, a side surface 72 which connects the outer surface of the interference body plate portion 63 and the outer surface of the bottom wall portion 11, and a side surface 73 of the nozzle guard projection 71 are formed so as not to obstruct spraying of fuel injected from the orifice 8 by taking into account the flow direction (injection direction) of fuel injected from the orifice 8.

The nozzle plate 3 according to this embodiment having the above-mentioned configuration can, compared to a case where the plurality of interference bodies 16 are formed independently around the nozzle hole 7 (see FIG. 24A), increase a wall thickness of the nozzle plate 3 around the nozzle hole 7 in a wide range and hence, a strength of portions around the nozzle hole 7 can be improved.

Further, according to the nozzle plate 3 of this embodiment, in the same manner as the nozzle plate 3 according to the first embodiment, with respect to fuel injected from the orifice 8, a liquid film of fuel injected from the corner portion 22 of the orifice 8 and areas in the vicinity of the corner portion 22 is formed into a thin, sharpened and pointed state and hence, fuel injected from the corner portion 22 of the orifice 8 and areas in the vicinity of the corner portion 22 is easily atomized due to a friction between the liquid film and air in the vicinity of the orifice 8.

In this embodiment, the mode is exemplified where the nozzle holes 7 are formed in three places at equal intervals around the center axis 53 of the bottom wall portion 11. However, the present invention is not limited to such a mode, and the nozzle holes 7 may be formed in at least one desired position of the bottom wall portion 11. Although the interference bodies 65 in this embodiment are formed in three places for one nozzle hole 7, the present invention is not limited to such a case, the optimum number of the nozzle holes 7 and the optimum arrangement of the nozzle holes 7 are determined corresponding to a required fuel injection characteristic or the like. Further, in this embodiment, wall thicknesses of the interference body plate portion 63 and the nozzle hole plate portion 64 of the bottom wall portion 11 are suitably changed corresponding to a required fuel injection characteristic or the like.

Fifth Embodiment

Figure 32A:
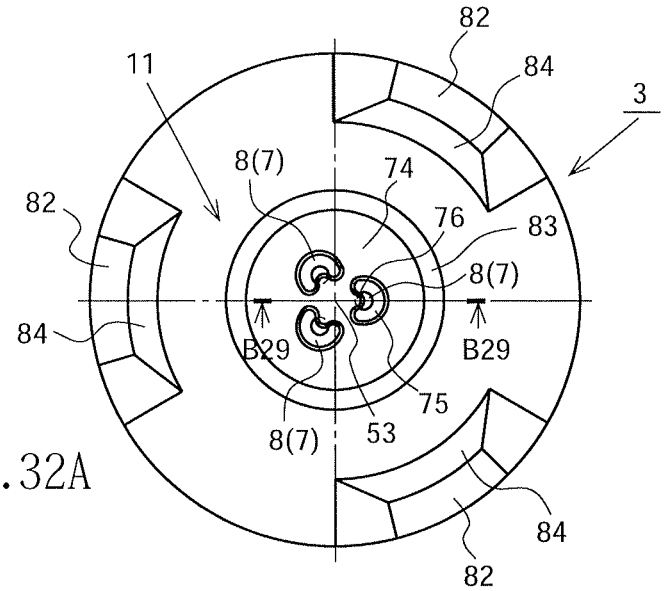
FIG. 32A to FIG. 32C are views showing a nozzle plate according to a fifth embodiment of the present invention.
Figure 32B:
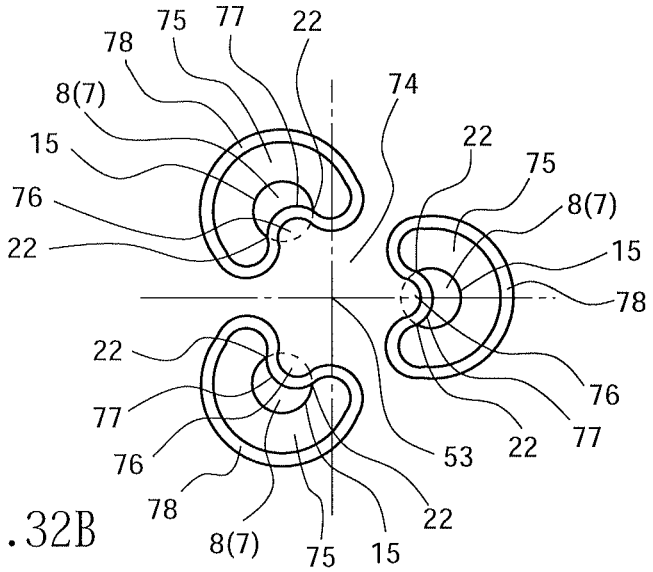
Figure 32C:
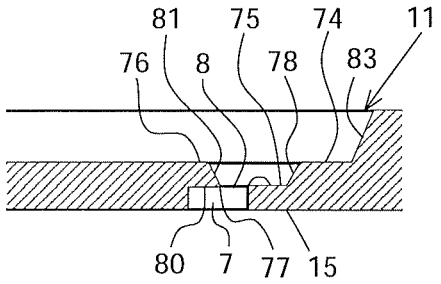

FIG. 32 illustrates views showing a nozzle plate 3 according to a fifth embodiment of the present invention. FIG. 32A is a front view of the nozzle plate 3, FIG. 32B is an enlarged view of a center portion of the nozzle plate 3 shown in FIG. 32A, and FIG. 32C is a partial cross-sectional view of the nozzle plate 3 taken along a line B29-B29 in FIG. 32A.

As shown in FIG. 32, although the nozzle plate 3 according to this embodiment differs from the nozzle plate 3 according to the fourth embodiment with respect to a shape of the periphery of a nozzle hole 7 formed in a bottom wall portion 11, other constitutions of the nozzle plate 3 according to this embodiment are substantially equal to the corresponding constitutions of the nozzle plate 3 according to the fourth embodiment. Accordingly, the explanation which overlaps with the explanation of the nozzle plate 3 according to the fourth embodiment is omitted.

The nozzle holes 7 are formed in the bottom wall portion 11 in three places at equal intervals around a center axis 53. The bottom wall portion 11 is counterbored in an inverse frustoconical shape so as to surround the nozzle holes 7. An interference body plate portion 74 is formed around the nozzle holes 7, and a nozzle hole plate portion 75 is formed by partially counterboring the interference body plate portion 74. The interference body plate portion 74 is formed with a larger wall thickness than the nozzle hole plate portion 75, and a part of the interference body plate portion 74 partially closes the nozzle hole 7 as an interference body 76. Interference bodies 76 correspond to the interference bodies 16, 16' of the nozzle plate 3 according to the first embodiment, and are formed in three places corresponding to the respective nozzle holes 7. The interference body 76 forms an orifice 8 by partially closing the nozzle hole 7, and the interference body 76 has an arcuate outer edge portion (outer edge portion) 77 which forms a portion of an opening edge of the orifice 8. Corner portions 22 of the opening edge of the orifice 8 formed by the arcuate outer edge portions 77 of the interference body 76 and a circular outlet-side opening portion 15 of the nozzle hole 7 are formed into a non-rounded sharpened shape. That is, the corner portions 22 are formed into a sharpened shape by which an end portion of a liquid film of fuel which passes through the orifice 8 is easily atomized due to a friction between the end portion of the liquid film of fuel and air. According to the nozzle plate 3 of this embodiment, with respect to fuel injected from the orifice 8, a liquid film of fuel injected from both corner portions 22, 22 of the orifice 8 and areas in the vicinity of the corner portions 22, 22 is formed into a thin, sharpened and pointed state and hence, fuel injected from the corner portions 22, 22 of the orifice 8 and areas in the vicinity of the corner portions 22, 22 is easily atomized due to a friction between the liquid film and air in the vicinity of the orifice 8.

A portion of the nozzle hole 7 is formed in a penetrating manner in the nozzle hole plate portion 75 having a smaller wall thickness than the interference body plate portion 74 from a front side to a back side (such that the nozzle hole 7 opens on the front and back sides). The nozzle hole plate portion 75 is formed concentrically with the nozzle hole 7 except for the interference body 76 and areas in the vicinity of the interference body 76. Further, a side surface 78 of the interference body plate portion 74 is formed at a position which does not obstruct spraying of fuel by taking into account the injection direction of fuel injected from an outlet-side opening portion 15 of the nozzle hole 7.

The interference body 76 has a fuel impinging surface 80 on which a portion of fuel which passes through the nozzle hole 7 impinges, and a side surface (inclined surface) 81 which intersects with the fuel impinging surface 80 at an acute angle for example, 75°). By making a portion of fuel which passes through the nozzle hole 7 impinge on the fuel impinging surface 80 of the interference body 76, the portion of fuel which passes through the nozzle hole 7 is atomized, the flow of the portion of fuel which passes through the nozzle hole 7 is sharply bent, and is made to impinge on fuel which intends to advance straightly and passes through the nozzle hole 7 and the orifice 8 thus forming the flow of fuel into a turbulent flow such that fuel which passes through the orifice 8 is easily atomized in air. Further, an air layer is formed between fuel which passes through the orifice 8 and the side surface 81 of the interference body 76 and hence, fuel which passes through the orifice 8 is easily entrapped into air whereby the atomization of fuel which passes through the orifice 8 is accelerated thus facilitating the uniform dispersion of atomized fuel in the intake pipe 2 (see FIG. 1).

In the bottom wall portion 11, nozzle guard projections 82 are formed at equal intervals in three places along the circumferential direction on a radially outer end side of an outer surface of the bottom wall portion 11. The nozzle guard projections 82 are formed so as to be positioned in a middle portion between the nozzle holes 7 arranged adjacent to each other. The nozzle guard projections 82 are formed so as to form a gap between an imaginary plane and the bottom wall portion 11 when distal ends of the nozzle guard projections 82 are brought into contact with the imaginary plane. In this manner, at the time of assembling the nozzle plate 3 to a valve body 5 (see FIG. 2), the nozzle guard projections 82 formed on the bottom wall portion 11 in three places prevent a tool or the like from impinging on the nozzle hole 7 and the area around the nozzle hole 7 thus preventing the occurrence of a damage on the nozzle hole 7 formed in the bottom wall portion 11 and portions around the nozzle hole 7. Further, at the time of assembling the fuel injection device 1 where the nozzle plate 3 is assembled to the valve body 5 to an intake pipe 2 of the engine, the nozzle guard projections 82 prevent engine parts or the like from impinging on the nozzle hole 7 and the area around the nozzle hole 7 thus preventing the occurrence of a damage on the nozzle hole 7 formed in the bottom wall portion 11 and the portions around the nozzle hole 7.

In the bottom wall portion 11, a side surface 83 which connects the outer surface of the interference body plate portion 74 and the outer surface of the bottom wall portion 11, and a side surface 84 of the nozzle guard projection 82 are formed so as not to obstruct spraying of fuel injected from the orifice 8 by taking into account the flow direction (injection direction) of fuel injected from the orifice 8.

The nozzle plate 3 according to this embodiment having the above-mentioned configuration can, compared to a case where the interference bodies 16 are independently formed around the nozzle hole 7 (see FIG. 2), increase a wall thickness of the nozzle plate 3 around the nozzle hole 7 in a wide range and hence, a strength of portions around the nozzle hole 7 can be improved.

Further, according to the nozzle plate 3 of this embodiment, in the same manner as the nozzle plate 3 according to the first embodiment, with respect to fuel injected from the orifice 8, a liquid film of fuel injected from both corner portions 22, 22 of the orifice 8 and areas in the vicinity of the corner portions 22, 22 is formed into a thin, sharpened and pointed state and hence, fuel injected from the corner portions 22, 22 of the orifice 8 and areas in the vicinity of the corner portions 22, 22 is easily atomized due to a friction between the liquid film and air in the vicinity of the orifice 8.

In this embodiment, the node is exemplified where the nozzle holes 7 are formed in three places at equal intervals around the center axis 53 of the bottom wall portion 11. However, the present invention is not limited to such a mode, and the nozzle hole 7 may be formed in the bottom wall portion 11 at least at one desired position.

Sixth Embodiment

Figure 33A:
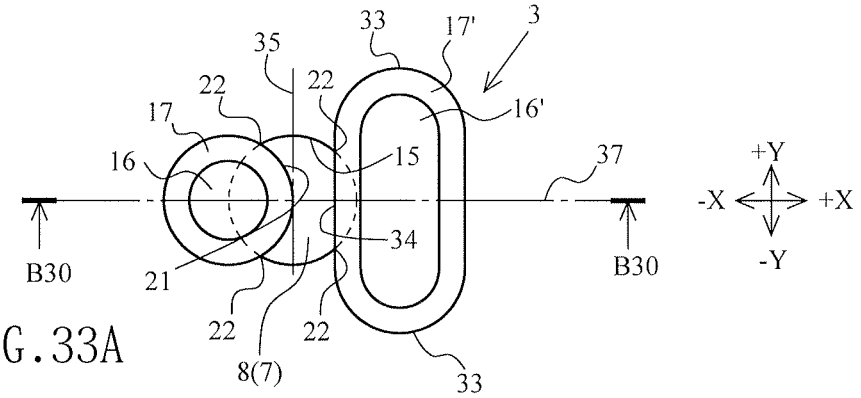
FIG. 33A and FIG. 33B are views showing a nozzle plate according to a sixth embodiment of the present invention.
Figure 33B:
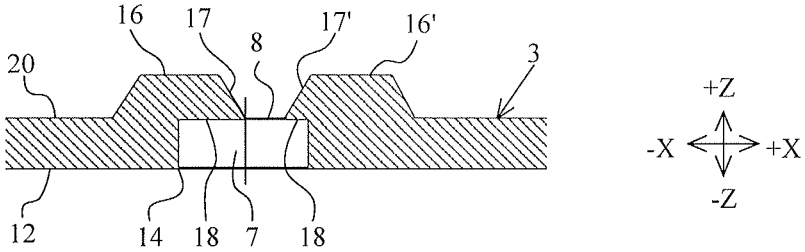

FIG. 33 illustrates views showing a nozzle plate 3 according to a sixth embodiment of the present invention. FIG. 33A is a plan view of a portion of the nozzle plate 3, and FIG. 33B is a partial cross-sectional view of the nozzle plate 3 taken along a line B30-B30 in FIG. 33A. In the nozzle plate 3 according to this embodiment shown in FIG. 33, constitutional portions substantially equal to the constitutional portions of the nozzle plate 3 according to the first embodiment are given same symbols, and the explanation which overlaps with the explanation of the nozzle plate 3 according to the first embodiment is omitted.

As shown in FIG. 33, the nozzle plate 3 according to this embodiment is characterized in that a straight outer edge portion 34 of an interference body 16' forms a part of an orifice 8. That is, in the nozzle plate 3 according to this embodiment, an interference body 16 and the interference body 16' partially close a circular outlet-side opening portion 15 of the nozzle hole 7, and the orifice 8 is formed by an arcuate outer edge portion 21 of the interference body 16, the straight outer edge portion 34 of the interference body 16' and the outlet-side opening portion 15 of the nozzle hole 7. The interference body 16 has a circular shape as viewed in a plan view, and the arcuate outer edge portion 21 partially forms the orifice 8. A shape of the interference body 16' as viewed in a plan view is formed into a shape where both end portions of a rectangular shape in a longitudinal direction are formed into a semicircular shape. Corner portions 22 formed by the arcuate outer edge portion 21 of the interference body 16 and the circular outlet-side opening portion 15 of the nozzle hole 7 are formed into a crescent non-rounded sharpened and pointed shape as viewed in a plan view. That is, the corner portions 22 are formed into a sharpened and pointed shape by which an end portion of a liquid film of fuel which passes through the orifice 8 is easily atomized due to a friction between the end portion of the liquid film of fuel and air. Corner portions 22 formed by the straight outer edge portion 34 of the interference body 16' and the outlet-side opening portion 15 of the nozzle hole 7 are formed into a non-rounded sharpened and pointed shape. That is, the corner portions 22 are formed into a shape by which an end portion of a liquid film of fuel which passes through the orifice 8 is easily atomized due to a friction between the end portion of the liquid film of fuel and air.

In the nozzle plate 3 according to this embodiment having such a configuration, the interference body 16 and the interference body 16' partially close the outlet-side opening portion 15 of the nozzle hole 7 and hence, a portion of fuel which passes through the nozzle hole 7 impinges on fuel impinging surfaces 18, 18 of the interference bodies 16, 16'. The flow direction of fuel which impinges on the fuel impinging surfaces 18, 18 is sharply changed. The flow of fuel whose flow direction is sharply changed and the flow of fuel which advances straightly in the nozzle hole 7 impinge on each other thus turning the flow of fuel which passes through the nozzle hole 7 and the orifice 8 into a turbulent flow. Further, as described previously, in the nozzle plate 3 according to this embodiment, the corner portions 22 which are formed by the arcuate outer edge portion 21 of the interference body 16 and the circular outlet-side opening portion 15 of the nozzle hole 7 and the corner portions 22 formed by the straight outer edge portion 34 of the interference body 16' and the outlet-side opening portion 15 of the nozzle hole 7 are formed into a non-rounded sharpened and pointed shape and hence, the corner portions 22 are formed into a shape by which an end portion of a liquid film of fuel which passes through the orifice 8 is easily atomized due to a friction between the end portion of the liquid film of fuel and air. Accordingly, the nozzle plate 3 according to this embodiment can further improve the level of atomization of fuel injected from the orifice 8 compared to conventional nozzle plates. The techniques described in the third to fifth embodiments may be applied to the nozzle plates 3 according to this embodiment and respective modifications of this embodiment described hereinafter.

First Modification of Sixth Embodiment

Figure 34A:
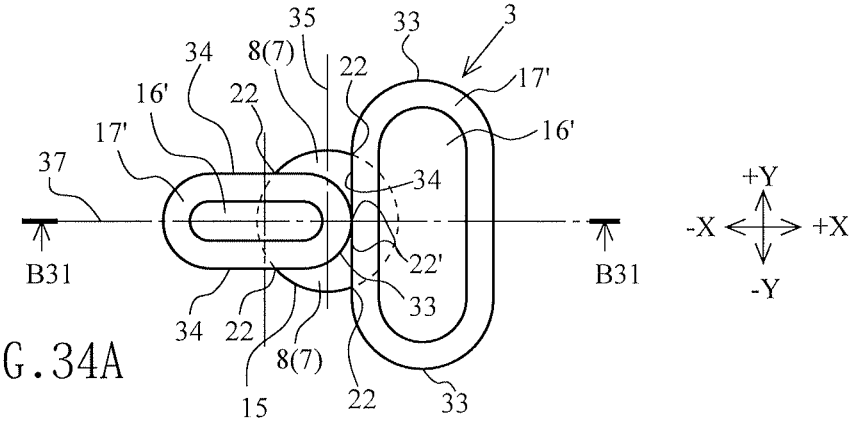
FIG. 34A and FIG. 34B are views showing a nozzle plate according to a first modification of the sixth embodiment.
Figure 34B:
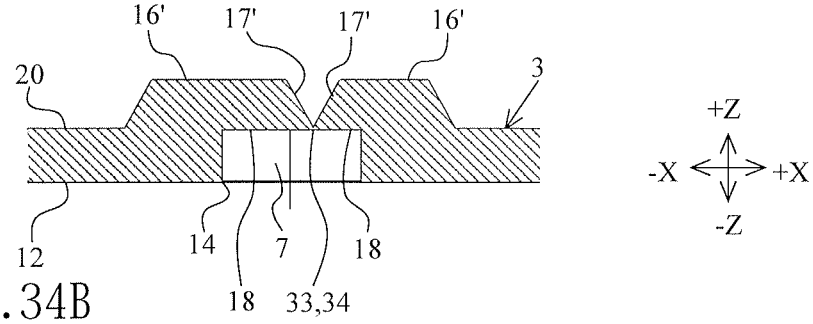
Figure 35A:
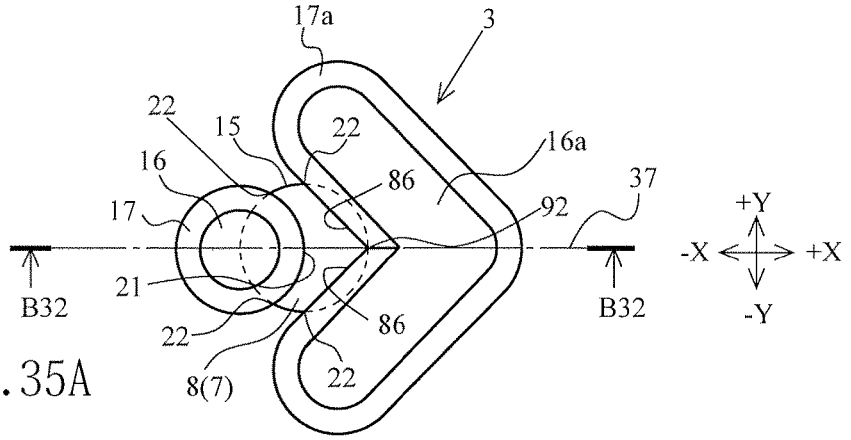
FIG. 35A to FIG. 35D are views showing a nozzle plate according to a second modification of the sixth embodiment.
Figure 35B:
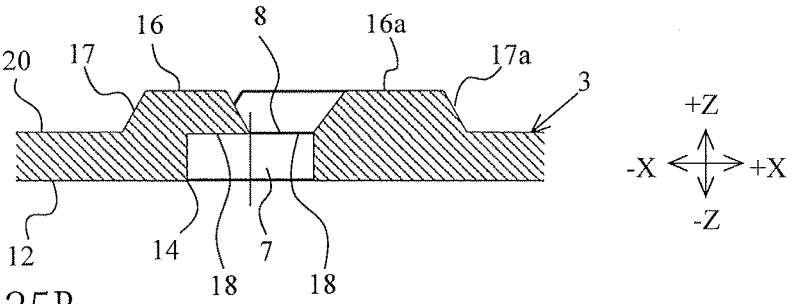
Figure 35C:
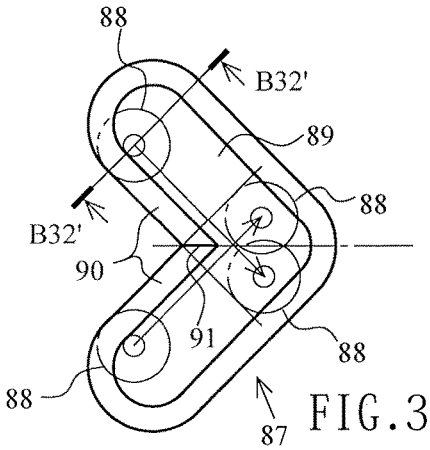
Figure 35D:
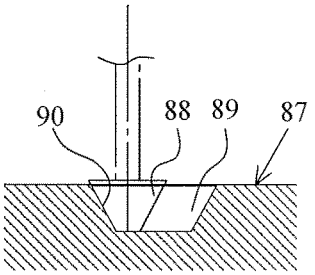

FIG. 34 illustrates views showing a nozzle plate 3 according to a first modification of the sixth embodiment. FIG. 34A is a plan view of a portion of the nozzle plate 3, and FIG. 34B is a partial cross-sectional view of the nozzle plate 3 taken along a line B31-B31 in FIG. 34A. In the nozzle plate 3 according to this modification shown in FIG. 34, constitutional portions substantially equal to the constitutional portions of the nozzle plate 3 according to the sixth embodiment are given same symbols used for indicating the constitutional portions of the nozzle plate 3 according to the sixth embodiment, and the explanation which overlaps with the explanation of the nozzle plate 3 according to the sixth embodiment is omitted.

As shown in FIG. 34, the nozzle plate 3 according to this modification is characterized in that straight outer edge portions 34, 34 of a first interference body 16' and a second interference body 16' form portions of an orifice 8. That is, in the nozzle plate 3 according to this modification, the first interference body 16' and the second interference body 16' partially close an outlet-side opening portion 15 of a nozzle hole 7, and the orifice 8 is formed by the straight outer edge portions 34, 34 of the first interference body 16' and the second interference body 16', a semicircular outer edge portion (arcuate outer edge portion) 33 of the first interference body 16' and the circular outlet-side opening portion 15 of the nozzle hole 7. A shape of the first and second interference bodies 16' as viewed in a plan view is formed into a shape where both end portions of a rectangular shape in a longitudinal direction are formed into a semicircular shape. A longitudinal direction of the first interference body 16' is arranged along a center line 37 extending parallel to an X axis, and a distal end of the semicircular outer edge portion 33 on one end side abuts against the straight outer edge portion 34 of the second interference body 16'. The second interference body 16' is arranged such that a longitudinal direction of the second interference body 16' becomes parallel to a Y axis, and is formed larger than the first interference body 16'.

Further, as shown in FIG. 34, in the nozzle plate 3 according to this modification, corner portions 22 formed by the straight outer edge portion 34 of the first interference body 16' and the circular outlet-side opening portion 15 of the nozzle hole 7 are formed into an approximately crescent non-rounded sharpened and pointed shape as viewed in a plan view and hence, the corner portions 22 are formed into a shape by which an end portion of a liquid film of fuel which passes through the orifice 8 is easily atomized due to a friction between the end portion of the liquid film of fuel and air. The corner portions 22 formed by the straight outer edge portion 34 of the second interference body 16' and the circular outlet-side opening portion 15 of the nozzle hole 7 are formed into a non-rounded sharpened and pointed shape and hence, the corner portions 22 are formed into a shape by which an end portion of a liquid film of fuel which passes through the orifice 8 is easily atomized due to a friction between the end portion of the liquid film of fuel and air. Further, the corner portions 22', 22' formed in portions where the semicircular outer edge portion 33 of the first interference body 16' and the straight outer edge portion 34 of the second interference body 16' abut against each other are formed into an approximately crescent non-rounded sharpened and pointed shape as viewed in a plan view. That is, the corner portions 22' 22' are formed into a shape by which an end portion of a liquid film of fuel which passes through the orifice 8 is easily atomized due to a friction between the end portion of the liquid film of fuel and air.

In the nozzle plate 3 according to this modification having such a configuration, the first interference body 16' and the second interference body 16' partially close the outlet-side opening portion 15 of the nozzle hole 7 and hence, a portion of fuel which passes through the nozzle hole 7 impinges on fuel impinging surfaces 18, 18 of the first interference body 16' and the second interference body 16' so that the flow direction of a portion of fuel is sharply changed. The flow of the portion of fuel whose flow direction is sharply changed and the flow of fuel which advances straightly in the nozzle hole 7 impinge on each other thus turning the flow of fuel which passes through the nozzle hole 7 and the orifice 8 into a turbulent flow. Further, as described previously, in the nozzle plate 3 of this modification, the corner portions 22 which are formed by the straight outer edge portion 34 of the first interference body 16' and the circular outlet-side opening portion 15 of the nozzle hole 7, the corner portions 22 formed by the straight outer edge portion 34 of the second interference body 16' and the circular outlet-side opening portion 15 of the nozzle hole 7 and the corner portions 22', 22' which are formed in portions where the semicircular outer edge portion 33 of the first interference body 16' and the straight outer edge portion 34 of the second interference body 16' are brought into contact with each other are formed into a non-rounded sharpened and pointed shape so that the corner portions 22, 22' are formed into a shape by which an end portion of a liquid film of fuel which passes through the orifice 8 is easily atomized due to a friction between the end portion of the liquid film of fuel and air. Accordingly, the nozzle plate 3 according to this embodiment can further improve the level of atomization of fuel injected from the orifice 8 compared to conventional nozzle plates.

Second Modification of Sixth Embodiment

FIG. 35 illustrates views showing a nozzle plate 3 according to a second modification of the sixth embodiment. FIG. 35A is a plan view of a portion of the nozzle plate 3, and FIG. 35B is a partial cross-sectional view of the nozzle plate 3 taken along a line B32-B32 in FIG. 35A. FIG. 35C is a plan view showing the relationship between a shape of a cavity 89 of a die 87 and a rotary working tool 88, and FIG. 35D is a cross-sectional view taken along a line B32'-B32' in FIG. 35C. In the nozzle plate 3 according to this modification shown in FIG. 35, constitutional portions substantially equal to the constitutional portions of the nozzle plate 3 according to the sixth embodiment are given same symbols, and the explanation which overlaps with the explanation of the nozzle plate 3 according to the sixth embodiment is omitted.

As shown in FIG. 35, the nozzle plate 3 according to this modification is characterized in that straight outer edge portions 86, 86 of a V-shaped interference body **16*a* form portions of an orifice 8. That is, in the nozzle plate 3 according to this modification, an interference body 16 and the V-shaped interference body 16*a* partially close an outlet-side opening portion 15 of a nozzle hole 7, and the orifice 8 is formed by an arcuate outer edge portion 21 of the interference body 16, straight outer edge portions (outer edge portions) 86, 86 of the V-shaped interference body 16*a*, and the circular outlet-side opening portion 15 of the nozzle hole 7. The interference body 16 is formed into a circular shape as viewed in a plan view. The V-shaped interference body 16***a* is formed into a shape where a pair of interference bodies 16', 16' abut against each other in a V shape as viewed in a plan view. As shown in FIGS. 35C and 35D, the V-shaped interference body 16*a* is formed such that a V-shaped cavity 89 for injection molding is formed by cutting or grinding the die 87 by the rotary working tool (end mill or the like) 88, and a molten resin is injected into the cavity 89 formed in the die 87. The inner side walls 90, 90 of the cavity 89 formed into a V shape are side walls for forming straight outer edge portions 86, 86 positioned so as to close the nozzle hole 7. With respect to the inner side walls 90, 90 formed in a V shape, moving trajectories of the rotary working tools 88 intersect with each other at a V-shaped valley bottom, and a non-rounded sharpened ridge 91 is formed at a portion where the rotary working tools 88 intersect with each other. Accordingly, in the interference body 16*a* formed by molding using the V-shaped cavity 89 for injection molding, a corner portion 92 formed by a pair of straight outer edge portions 86, 86 which intersects with each other in a V shape (an intersecting portion of the pair of straight outer edge portions 86, 86) is formed into a non-rounded sharpened and pointed shape. Further, a side surface 17*a* of the V-shaped interference body 16*a* is, in the same manner as the side surface 17 of the inference body 16 having a frustoconical shape, formed such that a side surface 17*a* intersects with a fuel impinging surface 18 at an acute angle.

Further, as shown in FIG. 35, in the nozzle plate 3 according to this modification, the interference body 16 is formed such that the center of the interference body 16 is positioned on a center line 37 of the nozzle hole 7 extending in a direction along an X axis. In the nozzle plate 3 according to this modification, a distal end of the corner portion 92 formed by the pair of straight outer edge portions 86, 86 which intersect with each other in a V shape is positioned on the center line 37 of the nozzle hole 7 extending in the direction along the X axis, and the distal end of the corner portion 92 formed by the pair of straight outer edge portions 86, 86 which intersects with each other in a V shape is positioned on an opening edge of the outlet-side opening portion 15. The V-shaped interference body 16*a* is formed into a line symmetrical shape using the center line 37 of the nozzle hole 7 extending in the direction along the X axis as an axis of symmetry.

Still further, as shown in FIG. 35, in the nozzle plate 3 according to this modification, the interference body 16 and the V-shaped interference body 16*a* partially close the circular outlet-side opening portion 15 of the nozzle hole 7, and the orifice 8 is formed by the arcuate outer edge portion 21 of the interference body 16, the pair of straight outer edge portions 86, 86 of the V-shaped interference body 16*a* and the circular outlet-side opening portion 15 of the nozzle hole 7. Corner portions 22 formed by the arcuate outer edge portion 21 of the interference body 16 and the circular outlet-side opening portion 15 of the nozzle hole 7 are formed into a crescent non-rounded sharpened and pointed shape as viewed in a plan view. That is, the corner portions 22 are formed into a sharpened and pointed shape by which an end portion of a liquid film of fuel which passes through the orifice 8 is easily atomized by a friction between the end portion of the liquid film of fuel and air. Corner portions 22 formed by the straight outer edge portions 86, 86 of the V-shaped interference body 16*a* and the circular outlet-side opening portion 15 of the nozzle hole 7 are formed into a non-rounded sharpened and pointed shape. That is, the corner portions 22 are formed into a shape by which an end portion of a liquid film of fuel which passes through the orifice 8 is easily atomized due to a friction between the end portion of the liquid film of fuel and air. Further, the V-shaped corner portion 92 of the V-shaped interference body 16*a* is formed into a non-rounded sharpened and pointed shape. That is, the corner portion 92 is formed into a shape by which an end portion of a liquid film of fuel which passes through the orifice 8 is easily atomized due to a friction between the end portion of the liquid film of fuel and air.

In the nozzle plate 3 according to this modification having such a configuration, the interference body 16 and the V-shaped interference body 16*a* partially close the outlet-side opening portion 15 of the nozzle hole 7 and hence, a portion of fuel which passes through the nozzle hole 7 impinges on fuel impinging surfaces 18, 18 of the interference body 16 and the V-shaped interference body 16*a* so that the flow direction of a portion of fuel is sharply changed. The flow of the portion of fuel whose flow direction is sharply changed and the flow of fuel which advances straightly in the nozzle hole 7 impinge on each other thus turning the flow of fuel which passes through the nozzle hole 7 and the orifice 8 into a turbulent flow. Further, as described previously, in the nozzle plate 3 of this modification, the corner portions 22 formed by the arcuate outer edge portion 21 of the interference body 16 and the circular outlet-side opening portion 15 of the nozzle hole 7, the corner portions 22 formed by the straight outer edge portions 86, 86 of the V-shaped interference body 16*a* and the circular outlet-side opening portion 15 of the nozzle hole 7, and the V-shaped corner portion 92 of the V-shaped interference body 16*a* are formed into a non-rounded sharpened and pointed shape so that the corner portions 92 are formed into a shape by which an end portion of a liquid film of fuel which passes through the orifice 8 is easily atomized due to a friction between the end portion of the liquid film of fuel and air. Accordingly, the nozzle plate 3 according to this modification can further improve the level of atomization of fuel injected from the orifice 8 compared to conventional nozzle plates.

Third Modification of Sixth Embodiment

Figure 36A:
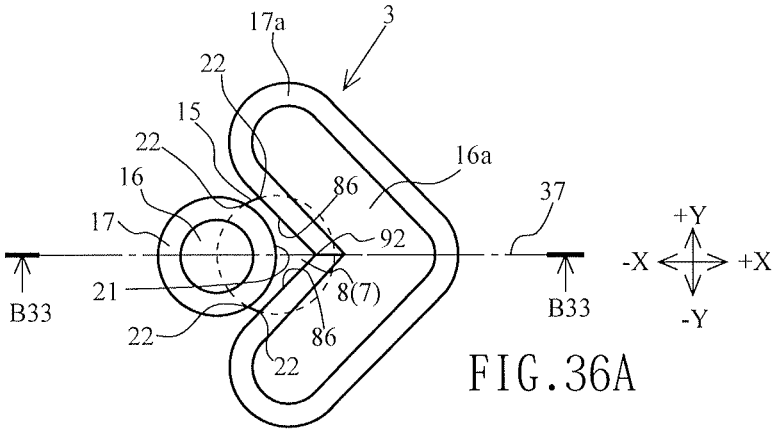
FIG. 36A and FIG. 36B are views showing a nozzle plate according to a third modification of the sixth embodiment.
Figure 36B:
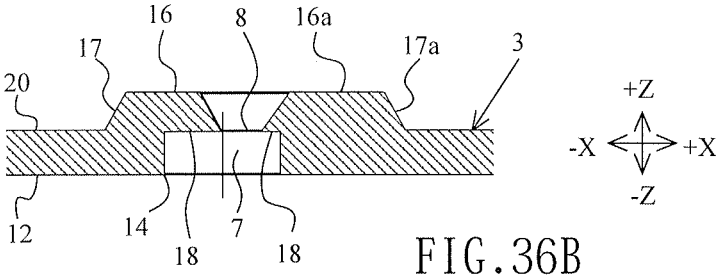

FIG. 36 illustrates views showing a nozzle plate 3 according to a third modification of the sixth embodiment and views showing a modification of the nozzle plate 3 according to the second modification of the sixth embodiment. FIG. 36A is a plan view of a portion of the nozzle plate 3, and FIG. 36B is a partial cross-sectional view of the nozzle plate 3 taken along a line B33-B33 in FIG. 36A. In the nozzle plate 3 according to this modification shown in FIG. 36, constitutional portions substantially equal to the constitutional portions of the nozzle plate 3 according to the second modification are given same symbols used for indicating the constitutional parts of the nozzle plate 3 according to the second modification, and the explanation which overlaps with the explanation of the nozzle plate 3 according to the second modification is omitted.

The nozzle plate 3 according to this modification shown in FIG. 36 is characterized in that an opening area of an orifice 8 is narrowed by arranging a V-shaped interference body 16*a* closer to an interference body 16 compared to the nozzle plate 3 according to the second modification. In the nozzle plate 3 according to this modification, a distal end of a V-shaped corner portion 92 is positioned inside an outlet-side opening portion 15 of a nozzle hole 7 in a radial direction.

Not to mention that the nozzle plate 3 according to this modification having such a configuration can acquire substantially the same advantageous effects as the nozzle plate 3 according to the second modification, the nozzle plate 3 according to this modification can reduce a film thickness of a liquid film of fuel which passes through the orifice 8 as a whole thus further effectively improving the level of atomization of fuel injected from the Orifice 8.

Fourth Modification of Sixth Embodiment

Figure 37A:
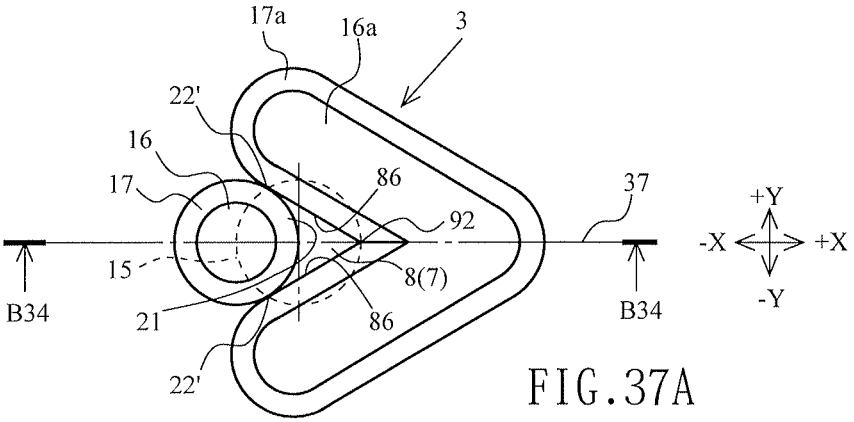
FIG. 37A and FIG. 37B are views showing a nozzle plate according to a fourth modification of the sixth embodiment.
Figure 37B:
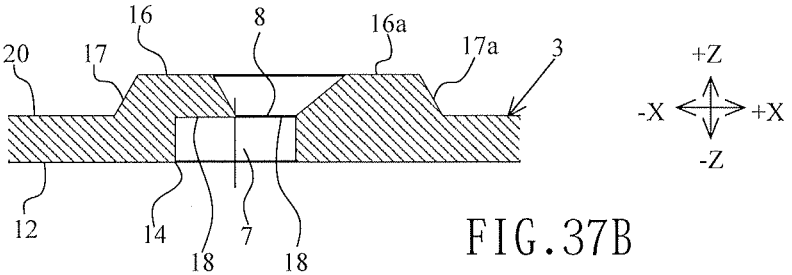

FIG. 37 illustrates views showing a nozzle plate 3 according to a fourth modification of the sixth embodiment and views showing a modification of the nozzle plate 3 according to the second modification of the sixth embodiment. FIG. 37A is a plan view of a portion of the nozzle plate 3, and FIG. 37B is a partial cross-sectional view of the nozzle plate 3 taken along a line B34-B34 in FIG. 37A. In the nozzle plate 3 according to this modification shown in FIG. 37, constitutional portions substantially equal to the constitutional portions of the nozzle plate 3 according to the second modification are given same symbols used for indicating the constitutional parts of the nozzle plate 3 according to the second modification, and the explanation which overlaps with the explanation of the nozzle plate 3 according to the second modification is omitted.

The nozzle plate 3 according to this modification shown in FIG. 37 is characterized in that, compared to the nozzle plate 3 according to the second modification, an opening angle of a pair of straight outer edge portions 86, 86 of a V-shaped interference body 16*a* which intersects with each other in a V shape (an intersecting angle made by the pair of straight outer edge portions 86, 86) is set at an acute angle, and the pair of straight outer edge portions 86, 86 of the V-shaped interference body 16*a* which intersects with each other in a V shape are brought into contact with an arcuate outer edge portion 21 of an interference body 16. Corner portions 22' formed at portions where the straight outer edge portions 86 of the V-shaped interference body 16*a* and the arcuate outer edge portions 21 of the interference body 16 are brought into contact with each other are formed into an approximately crescent non-rounded sharpened and pointed shape as viewed in a plan view. Accordingly, an end portion of a liquid film of fuel which passes through the orifice 8 is formed into a shape by which the end portion of the liquid film of fuel is easily atomized due to a friction between the end portion of the liquid film of fuel and air. Further, the V-shaped corner portion 92 of the V-shaped interference body 16*a* is formed into a non-rounded sharpened and pointed shape and hence, an end portion of a liquid film of fuel which passes through the orifice 8 is formed into a shape by which the end portion of the liquid film of fuel is easily atomized due to a friction between the end portion of the liquid film of fuel and air. Accordingly, the nozzle plate 3 according to this embodiment can further improve the level of atomization of fuel injected from the orifice 8 compared to conventional nozzle plates. In this modification, the V-shaped corner portion 92 of the V-shaped interference body 16*a* may be arranged outside the outlet-side opening portion 15 of the nozzle hole 7 in the radial direction, and a non-rounded sharpened and pointed corner portion (not shown in the drawing) may be formed by a pair of straight outer edge portions 86, 86 of the V-shaped interference body 16*a* and the outlet-side opening portion 15 of the nozzle hole 7.

Fifth Modification of Sixth Embodiment

Figure 38A:
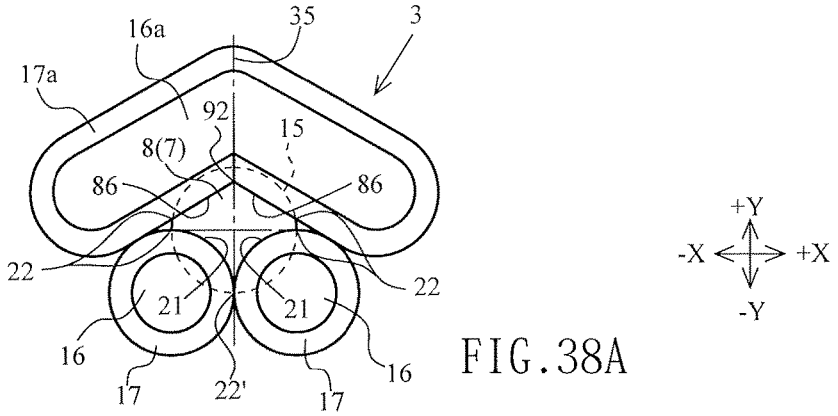
FIG. 38A and FIG. 38B are views showing a nozzle plate according to a fifth modification of the sixth embodiment.
Figure 38B:
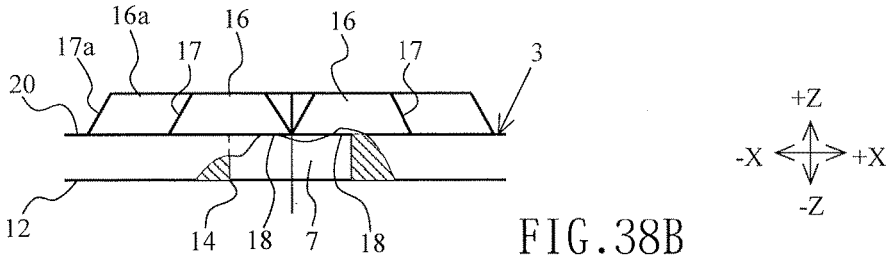

FIG. 38 illustrates views showing a nozzle plate 3 according to a fifth modification of the sixth embodiment and views showing a modification of the nozzle plate 3 according to the second modification of the sixth embodiment. FIG. 38A is a plan view of a portion of the nozzle plate 3, and FIG. 38B is a side view of a portion of the nozzle plate 3 with a part broken away. In the nozzle plate 3 according to this modification shown in FIG. 38, constitutional portions substantially equal to the constitutional portions of the nozzle plate 3 according to the second modification are given same symbols used for indicating the constitutional parts of the nozzle plate 3 according to the second modification, and the explanation which overlaps with the explanation of the nozzle plate 3 according to the second modification is omitted.

In the nozzle plate 3 according to this modification shown in FIG. 38, a pair of interference bodies 16, 16 and a V-shaped interference body 16*a* partially close an outlet-side opening portion 15 of a nozzle hole 7. In the nozzle plate 3, an orifice 8 is formed by arcuate outer edge portions 21, 21 of the pair of interference bodies 16, 16, a pair of straight outer edge portions 86, 86 of the V-shaped interference body 16*a*, and the outlet-side opening portion 15 of the nozzle hole 7.

In this modification, the pair of interference bodies 16, 16 are brought into contact with each other on a center line 35 which extends along a Y axis of the nozzle hole 7 and on an opening edge of the outlet-side opening portion 15. The pair of straight outer edge portions 86, 86 of the V-shaped interference body 16*a* is brought into contact with the arcuate outer edge portions 21, 21 of the interference bodies 16, 16 on an outer side of the nozzle hole 7 in the radial direction, and is formed in a line symmetry shape using the center axis 35 which extends along the Y axis of the nozzle hole 7 as an axis of symmetry. A V-shaped corner portion 92 of a V-shaped interference body 16*a* is positioned more inside in the radial direction than the opening edge of the outlet-side opening portion 15.

In the nozzle plate 3 according to this modification shown in FIG. 38, corner portions 22 formed by the arcuate outer edge portion 21 of the interference body 16 and the outlet-side opening portion 15 of the nozzle hole 7 are formed into a non-rounded sharpened and pointed shape, and corner portions 22 formed by the straight outer edge portions 86 of the V-shaped interference body 16*a* and the outlet-side opening portion 15 of the nozzle hole 7 are formed into a non-rounded sharpened and pointed shape. Further, corner portions 22' formed due to a contact between the arcuate outer edge portions 21, 21 of the pair of interference bodies 16, 16 are formed into a non-rounded sharpened and pointed shape. Further, the V-shaped corner portion 92 of the V-shaped interference body 16*a* is formed into a non-rounded sharpened and pointed shape.

In the nozzle plate 3 according to this modification having such a configuration, the pair of interference bodies 16, 16 and the V-shaped interference body 16*a* partially close the outlet-side opening portion 15 of the nozzle hole 7 and hence, a portion of fuel which passes through the nozzle hole 7 impinges on fuel impinging surfaces 18 of the pair of interference bodies 16, 16 and the V-shaped interference body 16*a* so that the flow direction of a portion of fuel is sharply changed. The flow of the portion of fuel whose flow direction is sharply changed and the flow of fuel which advances straightly in the nozzle hole 7 impinge on each other thus turning the flow of fuel which passes through the nozzle hole 7 and the orifice 8 into a turbulent flow. Further, in the nozzle plate 3 of this modification, the corner portions (22, 22', 92) of the orifice 8 in six places are formed into a non-rounded sharpened and pointed shape and hence, an end portion of a liquid film of fuel winch passes through the orifice 8 is easily atomized due to a friction between the end portion of the liquid film of fuel and air. Accordingly, the nozzle plate 3 according to this modification can further improve the level of atomization of fuel injected from the orifice 8 compared to conventional nozzle plates.

Sixth Modification of Sixth Embodiment

Figure 39A:
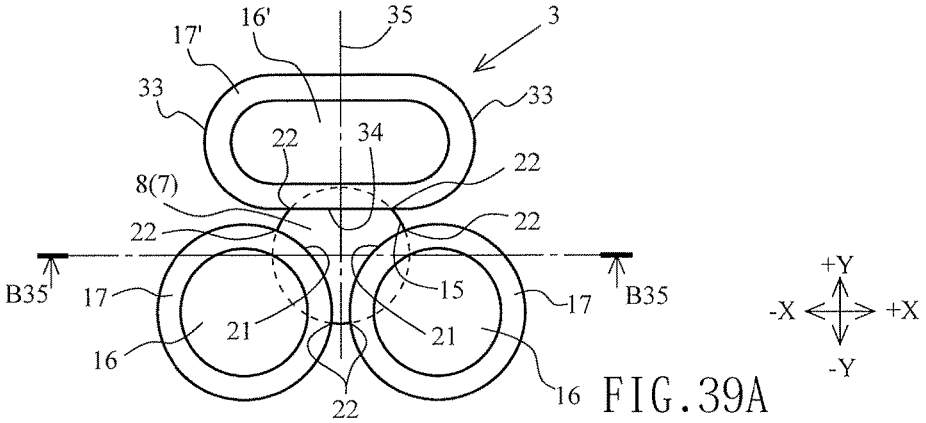
FIG. 39A and FIG. 39B are views showing a nozzle plate according to a sixth modification of the sixth embodiment.
Figure 39B:
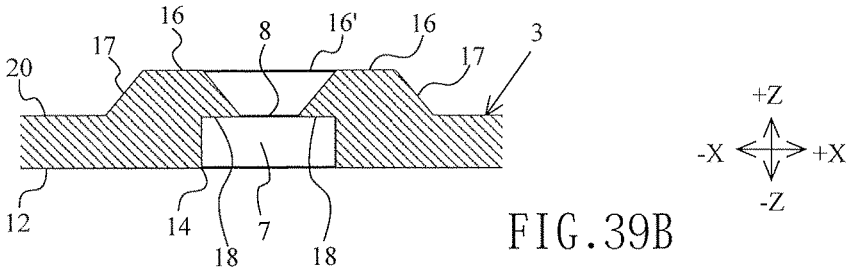

FIG. 39 illustrates views showing a nozzle plate 3 according to a sixth modification of the sixth embodiment. FIG. 39A is a plan view of a portion of the nozzle plate 3, and FIG. 39B is a partial cross-sectional view of the nozzle plate 3 taken along a line B35-B35 in FIG. 39A. In the nozzle plate 3 according to this modification shown in FIG. 39, constitutional portions substantially equal to the constitutional portions of the nozzle plate 3 according to the sixth embodiment are given same symbols used for indicating the constitutional parts of the nozzle plate 3 according to the first embodiment, and the explanation which overlaps with the explanation of the nozzle plate 3 according to the first embodiment is omitted.

As shown in FIG. 39, a nozzle plate 3 according to this modification is characterized in that a straight outer edge portion 34 of an interference body 16' forms a part of an orifice 8, and arcuate outer edge portions 21, 21 of a pair of interference bodies 16, 16 which are positioned in a spaced-apart manner from each other form parts of the orifice 8. That is, in the nozzle plate 3 according to this modification, the pair of interference bodies 16, 16 and the interference body 16' partially close a circular outlet-side opening portion 15 of a nozzle hole 7, and the orifice 8 is formed by the arcuate outer edge portions 21, 21 of the pair of interference bodies 16, 16, a straight outer edge portion 34 of the interference body 16' and the circular outlet-side opening portion 15 of the nozzle hole 7. Corner portions 22 formed by the arcuate outer edge portions 21, 21 of the interference bodies 16, 16 and the circular outlet-side opening portion 15 of the nozzle hole 7 are formed into a non-rounded sharpened and pointed shape as viewed in a plan view and hence, an end portion of a liquid film of fuel which passes through the orifice 8 is formed into a sharpened shape by which the end portion of the liquid film of fuel is easily atomized due to a friction between the end portion of the liquid film of fuel and air. Further, corner portions 22 formed by the straight outer edge portion 34 of the interference body 16' and the outlet-side opening portion 15 of the nozzle hole 7 are formed into a non-rounded sharpened and pointed shape and hence, an end portion of a liquid film of fuel which passes through the orifice 8 is formed into a shape by which the end portion of the liquid film of fuel is easily atomized due to a friction between the end portion of the liquid film of fuel and air.

As shown in FIG. 39, in the nozzle plate 3 according to this modification, the pair of interference bodies 16, 16 is positioned in a spaced-apart manner from each other in line symmetry using the center axis 35 which extends parallel to a Y axis as an axis of symmetry. Further, the center position of the interference body 16' in the longitudinal direction is formed so as to be positioned on the center line 35 which extends in a direction along the Y axis of the nozzle hole 7.

In the nozzle plate 3 according to this modification having such a configuration, the pair of interference bodies 16, 16 and the interference body 16' partially close the outlet-side opening portion 15 of the nozzle hole 7 and hence, a portion of fuel which passes through the nozzle hole 7 impinges on fuel impinging surfaces 18 of the pair of interference bodies 16, 16 and the interference body 16' so that the flow direction of a portion of fuel which impinges on the fuel impinging surfaces 18 is sharply changed. The flow of the portion of fuel whose flow direction is sharply changed and the flow of fuel which advances straightly in the nozzle hole 7 impinge on each other thus turning the flow of fuel which passes through the nozzle hole 7 and the orifice 8 into a turbulent flow. Further, in the nozzle plate 3 according to this embodiment, as described previously, the corner portions 22 formed by the arcuate outer edge portions 21, 21 of the pair of interference bodies 16, 16 and the outlet-side opening portion 15 of the nozzle hole 7 and the corner portions 22 formed by the straight outer edge portion 34 of the interference body 16' and the outlet-side opening portion 15 of the nozzle hole 7 are formed into a non-rounded sharpened and pointed shape so that an end portion of a liquid film of fuel which passes through the orifice 8 is formed into a shape by which the end portion of the liquid film of fuel is easily atomized due to a friction between the end portion of the liquid film of fuel and air. Accordingly, the nozzle plate 3 according to this modification can further improve the level of atomization of fuel injected from the orifice 8 compared to conventional nozzle plates.

Seventh Modification of Sixth Embodiment

Figure 40A:
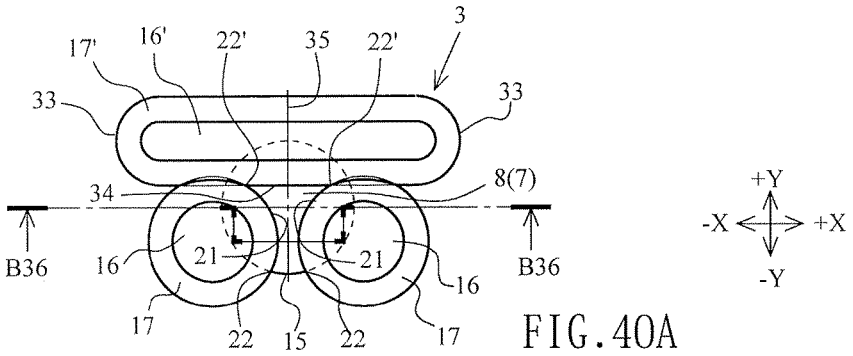
FIG. 40A and FIG. 40B are views showing a nozzle plate according to a seventh modification of the sixth embodiment.
Figure 40B:
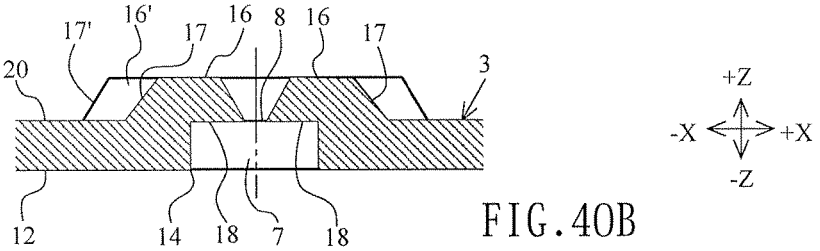

FIG. 40 illustrates views showing a nozzle plate 3 according to a seventh modification of the sixth embodiment and views showing a modification of the sixth modification of the sixth embodiment. FIG. 40A is a plan view of a portion of the nozzle plate 3, and FIG. 40B is a partial cross-sectional view of the nozzle plate 3 taken along a line B36-B36 in FIG. 40A. In the nozzle plate 3 according to this modification shown in FIG. 40, constitutional portions substantially equal to the constitutional portions of the nozzle plate 3 according to the sixth modification are given same symbols used for indicating the constitutional parts of the nozzle plate 3 according to the sixth modification, and the explanation which overlaps with the explanation of the nozzle plate 3 according to the sixth modification is omitted.

As shown in FIG. 40, in the nozzle plate 3 according to this modification, a straight outer edge portion 34 of an interference body 16' is made to abut against arcuate outer edge portions 21, 21 of a pair of interference bodies 16, 16, and the pair of interference bodies 16, 16 and the interference body 16' partially close a circular outlet-side opening portion 15 of a nozzle hole 7. In the nozzle plate 3, an orifice 8 is formed by the arcuate outer edge portions 21, 21 of the pair of interference bodies 16, 16, the straight outer edge portion 34 of the interference body 16' and the outlet-side opening portion 15 of the nozzle hole 7.

As shown in FIG. 40, in the nozzle plate 3 according to this modification, corner portions 22' formed by the arcuate outer edge portions 21, 21 of the pair of interference bodies 16, 16 and the straight outer edge portion 34 of the interference body 16' are formed into a non-rounded sharpened and pointed shape so that an end portion of a liquid film of fuel which passes through the orifice 8 is formed into a shape by which the end portion of the liquid film of fuel is easily atomized due to a friction between the end portion of the liquid film of fuel and air. Further, corner portions 22 formed by the arcuate outer edge portions 21, 21 of the interference bodies 16, 16 and the outlet-side opening portion 15 of the nozzle hole 7 are formed into a non-rounded sharpened and pointed shape so that an end portion of a liquid film of fuel which passes through the orifice 8 is formed into a shape by which the end portion of the liquid film of fuel is easily atomized due to a friction between the end portion of the liquid film of fuel and air.

Further, as shown in FIG. 40, in the nozzle plate 3 according to this modification, the pair of interference bodies 16, 16 and the interference body 16' partially close the circular outlet-side opening portion 15 of the nozzle hole 7 and hence, a portion of fuel which passes through the nozzle hole 7 impinges on fuel impinging surfaces 18 of the pair of interference bodies 16, 16 and the interference body 16' so that the flow direction of a portion of fuel is sharply changed. The flow of the portion of fuel whose flow direction is sharply changed and the flow of fuel which advances straightly in the nozzle hole 7 impinge on each other thus turning the flow of fuel which passes through the nozzle hole 7 and the orifice 8 into a turbulent flow. Further, in the nozzle plate 3 according to this modification, the respective corner portions 22, 22' of the orifice 8 are formed into a non-rounded sharpened and pointed shape so that an end portion of a liquid film of fuel which passes through the orifice 8 is formed into a shape by which the end portion of the liquid film of fuel is easily atomized due to a friction between the end portion of the liquid film of fuel and air. Accordingly, the nozzle plate 3 according to this modification can further improve the level of atomization of fuel injected from the orifice 8 compared to conventional nozzle plates.

Eighth Modification of Sixth Embodiment

Figure 41A:
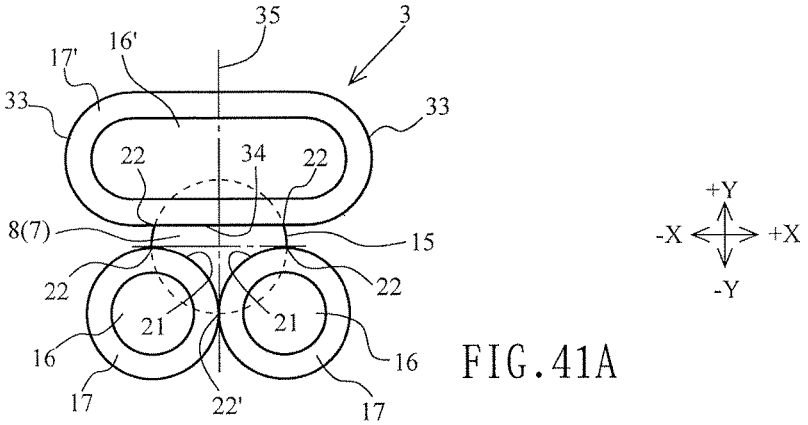
FIG. 41A and FIG. 41B are views showing a nozzle plate according to an eighth modification of the sixth embodiment.
Figure 41B:
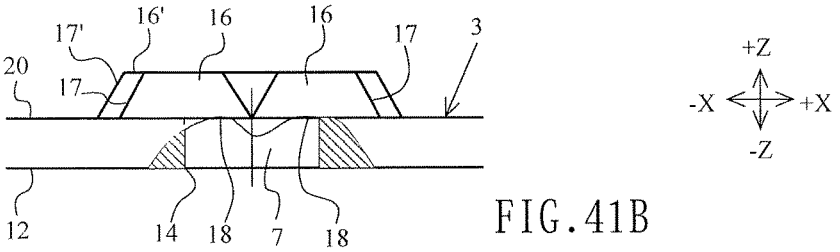

FIG. 41 illustrates views showing a nozzle plate 3 according to an eighth modification of the sixth embodiment and also views showing a modification of the sixth modification of the sixth embodiment. FIG. 41A is a plan view of a portion of the nozzle plate 3, and FIG. 41B is a side view of a portion of the nozzle plate 3. In the nozzle plate 3 according to this modification shown in FIG. 41, constitutional portions substantially equal to the constitutional portions of the nozzle plate 3 according to the sixth modification are given same symbols used for indicating the constitutional parts of the nozzle plate 3 according to the sixth modification, and the explanation which overlaps with the explanation of the nozzle plate 3 according to the sixth modification is omitted.

As shown in FIG. 41, in the nozzle plate 3 according to this modification, arcuate outer edge portions 21, 21 of a pair of interference bodies 16, 16 are made to abut against each other, and the pair of interference bodies 16, 16 and the interference body 16' partially close a circular outlet-side opening portion 15 of a nozzle hole 7. In the nozzle plate 3, an orifice 8 is formed by the arcuate outer edge portions 21, 21 of the pair of interference bodies 16, 16, the straight outer edge portion 34 of the interference body 16' and the circular outlet-side opening portion 15 of the nozzle hole 7.

As shown in FIG. 41, in the nozzle plate 3 according to this modification, a corner portion 22' formed in a portion where the arcuate outer edge portions 21, 21 of the pair of interference bodies 16, 16 abut against each other is formed into a non-rounded sharpened and pointed shape so that an end portion of a liquid film of fuel which passes through the orifice 8 is formed into a shape by which the end portion of the liquid film of fuel is easily atomized due to a friction between the end portion of liquid film of fuel and air. The corner portions 22 formed by the arcuate outer edge portions 21, 21 of the pair of interference bodies 16, 16 and the circular outlet-side opening portion 15 of the nozzle hole 7 are formed into a non-rounded sharpened and pointed shape so that an end portion of a liquid film of fuel which passes through the orifice 8 is formed into a shape by which the end portion of the liquid film of fuel is easily atomized due to a friction between the end portion of the liquid film of fuel and air. Further, the corner portions 22 formed by the straight outer edge portion 34 of the interference boy 16' and the outlet-side opening portion 15 of the nozzle hole 7 are formed into a non-rounded sharpened and pointed shape so that an end portion of a liquid film of fuel which passes through the orifice 8 is formed into a shape by which the end portion of the liquid film of fuel is easily atomized due to a friction between the end portion of the liquid film of fuel and air.

Further, as shown in FIG. 41, in the nozzle plate 3 according to this modification, the pair of interference bodies 16, 16 and the interference body 16' partially close the circular outlet-side opening portion 15 of the nozzle hole 7 and hence, a portion of fuel which passes through the nozzle hole 7 impinges on fuel impinging surfaces 18 of the pair of interference bodies 16, 16 and the interference body 16' so that the flow direction of a portion of fuel is sharply changed. The flow of the portion of fuel whose flow direction is sharply changed and the flow of fuel which advances straightly in the nozzle hole 7 impinge on each other thus turning the flow of fuel which passes through the nozzle hole 7 and the orifice 8 into a turbulent flow. Further, in the nozzle plate 3 according to this modification, the respective corner portions 22, 22' of the orifice 8 are formed into a non-rounded sharpened and pointed shape so that an end portion of a liquid film of fuel which passes through the orifice 8 is formed into a shape by which the end portion of the liquid film of fuel is easily atomized due to a friction between the end portion of the liquid film of fuel and air. Accordingly, the nozzle plate 3 according to this modification can further improve the level of atomization of fuel injected from the orifice 8 compared to conventional nozzle plates.

Ninth Modification of Sixth Embodiment

Figure 42A:
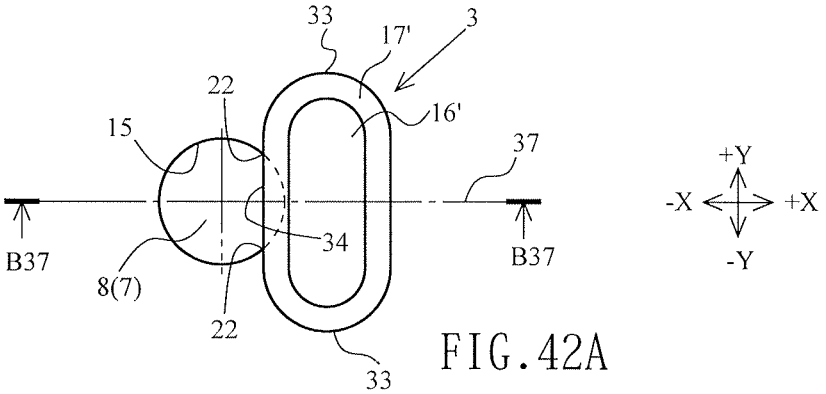
FIG. 42A and FIG. 42B are views showing a nozzle plate according to a ninth modification of the sixth embodiment.
Figure 42B:
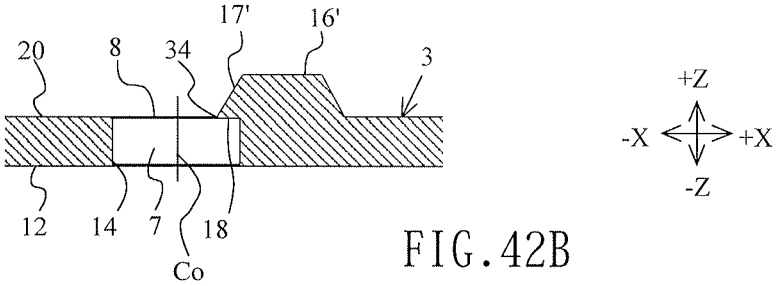

FIG. 42 illustrates views showing a nozzle plate 3 according to a ninth modification of the sixth embodiment. FIG. 42A is a plan view of a portion of the nozzle plate 3, and FIG. 42B is a cross-sectional view of the nozzle plate 3 taken along a line B37-B37 in FIG. 42A. In the nozzle plate 3 according to this modification shown in FIG. 42, constitutional portions substantially equal to the constitutional portions of the nozzle plate 3 according to the sixth embodiment are given same symbols used for indicating the constitutional parts of the nozzle plate 3 according to the sixth modification, and the explanation which overlaps with the explanation of the nozzle plate 3 according to the sixth embodiment is omitted.

As shown in FIG. 42, in the nozzle plate 3 according to this modification, the interference body 16 of the nozzle plate 3 according to the sixth embodiment is omitted. That is, the nozzle plate 3 is configured such that an outlet-side opening portion 15 of a nozzle hole 7 is partially closed only by an interference body 16'. Further, the corner portions 22 of the orifice 8 formed by a straight outer edge portion 34 of the interference boy 16' and a circular outlet-side opening portion 15 of the nozzle hole 7 are formed into a non-rounded sharpened and pointed shape so that an end portion of a liquid film of fuel which passes through the orifice 8 is formed into a shape by which the end portion of the liquid film of fuel is easily atomized due to a friction between the end portion of the liquid film of fuel and air. In the nozzle plate 3 according to this modification, a portion of fuel which passes through the nozzle hole 7 impinges on a fuel impinging surface 18 of the interference body 16', so that the flow direction of the fuel which impinges on the fuel impinging surface 18 is sharply changed. The flow of the portion of fuel whose flow direction is sharply changed and the flow of fuel which advances straightly in the nozzle hole 7 impinge on each other thus turning the flow of fuel which passes through the nozzle hole 7 and the orifice 8 into a turbulent flow. Accordingly, the nozzle plate 3 according to this modification can further improve the level of atomization of fuel injected from the orifice 8 compared to conventional nozzle plates.

Tenth Modification of Sixth Embodiment

Figure 43A:
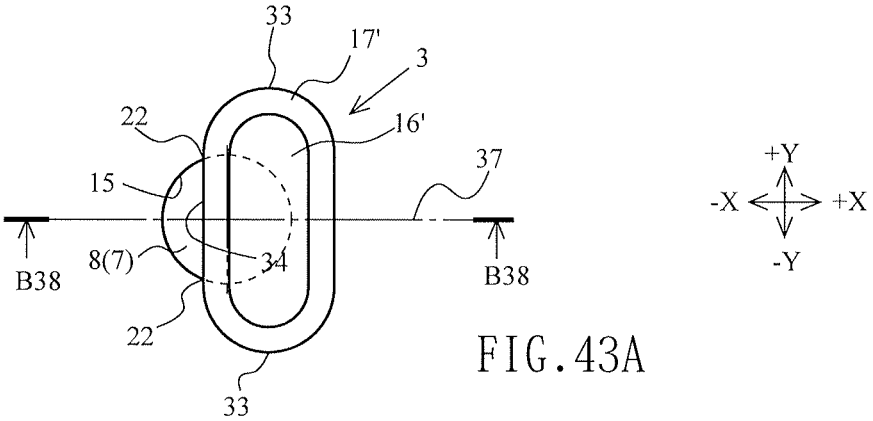
FIG. 43A and FIG. 43B are views showing a nozzle plate according to a tenth modification of the sixth embodiment.
Figure 43B:
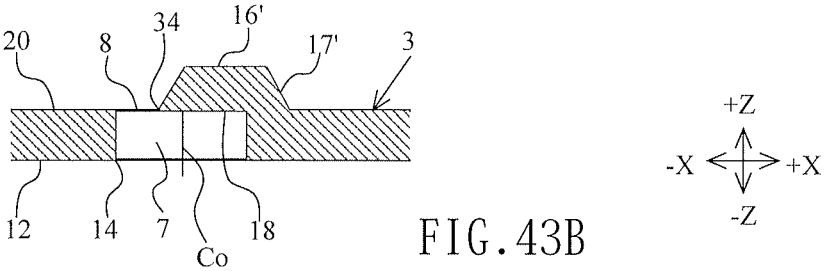

FIG. 43 illustrates views showing a nozzle plate 3 according to a tenth modification of the sixth embodiment and views showing a modification of the nozzle plate 3 according to the ninth modification of the sixth embodiment. FIG. 43A is a plan view of a portion of the nozzle plate 3, and FIG. 43B is a cross-sectional view of the nozzle plate 3 taken along a line B38-B38 in FIG. 43A. In the nozzle plate 3 according to this modification shown in FIG. 43, constitutional portions substantially equal to the constitutional portions of the nozzle plate 3 according to the ninth modification of the sixth embodiment are given same symbols used for indicating the constitutional parts of the nozzle plate 3 according to the ninth modification of the sixth embodiment, and the explanation which overlaps with the explanation of the nozzle plate 3 according to the ninth modification of the sixth embodiment is omitted.

As shown in FIG. 43, in the nozzle plate 3 according to this modification, an area of an outlet-side opening portion 15 of a nozzle hole 7 closed by an interference body 16' is set larger than an area of the outlet-side opening portion 15 closed by the interference body 16' in the nozzle plate 3 according to the ninth modification, and an opening area of the orifice 8 formed by a straight outer edge portion 34 of the interference body 16' and a circular outlet-side opening portion 15 of the nozzle hole 7 is set smaller than an opening area of the orifice 8 formed in the nozzle plate 3 according to the ninth modification. Further, in the nozzle plate 3 according to this modification, a corner portion 22 of an orifice 8 formed by a straight outer edge portion 34 of the interference body 16' and a circular outlet-side opening portion 15 of the nozzle hole 7 is pointed more sharply than the corresponding corner portion 22 of the orifice 8 formed in the nozzle plate 3 according to the ninth modification.

While the nozzle plate 3 according to this modification can acquire substantially the same advantageous effects as the nozzle plate 3 according to the ninth modification, the nozzle plate 3 according to this modification has a fuel injection characteristic different from that of the nozzle plate 3 according to the ninth modification. For example, in the nozzle plate 3 according to this modification, the fuel injection direction is largely inclined with respect to a center axis Co of the nozzle hole 7 compared to the nozzle plate 3 according to the ninth modification.

Eleventh Modification of Sixth Embodiment

Figure 44A:
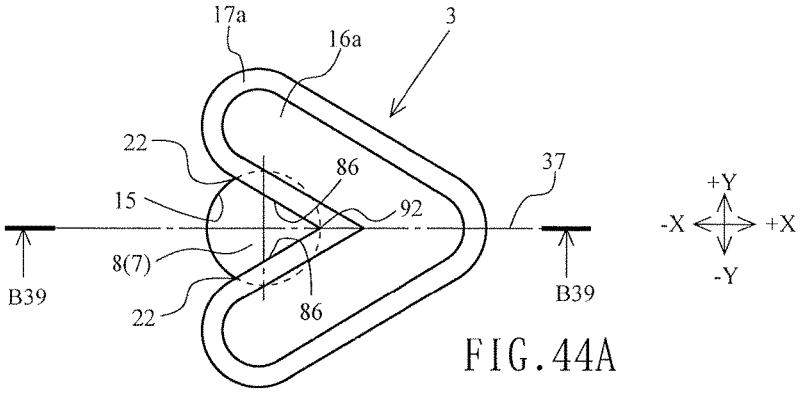
FIG. 44A and FIG. 44B are views showing a nozzle plate according to an eleventh modification of the sixth embodiment.
Figure 44B:
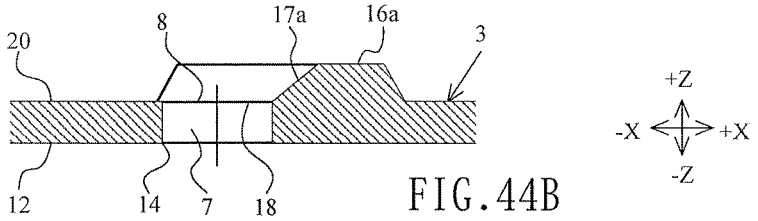

FIG. 44 illustrates views showing a nozzle plate 3 according to an eleventh modification of the sixth embodiment and views showing a modification of the nozzle plate 3 according to the fourth modification of the sixth embodiment. FIG. 44A is a plan view of a portion of the nozzle plate 3, and FIG. 44B is a cross-sectional view of the nozzle plate 3 taken along a line B39-B39 in FIG. 44A. In the nozzle plate 3 according to this modification shown in FIG. 44, constitutional portions substantially equal to the constitutional portions of the nozzle plate 3 according to the fourth modification of the sixth embodiment are given same symbols used for indicating the constitutional parts of the nozzle plate 3 according to the fourth modification of the sixth embodiment, and the explanation which overlaps with the explanation of the nozzle plate 3 according to the fourth modification of the sixth embodiment is omitted.

As shown in FIG. 44, the nozzle plate 3 according to this modification adopts the structure where the interference body 16 of the nozzle plate 3 according to the fourth modification of the sixth embodiment is omitted, and an outlet-side opening portion 15 of the nozzle hole 7 is partially closed by a V-shaped interference body 16*a*. Further, in the nozzle plate 3 according to this modification, corner portions 22 formed by a pair of straight outer edge portions 86, 86 and a circular outlet-side opening portion 15 of the nozzle hole 7 and a V-shaped corner portion 92 formed at a portion where the pair of straight outer edge portions 86, 86 intersect with each other are formed into a non-rounded sharpened and pointed shape so that an end portion of a liquid film of fuel which passes through the orifice 8 is formed into a shape by which the end portion of the liquid film of fuel is easily atomized due to a friction between the end portion of the liquid film of fuel and air. In the nozzle plate 3 according to this modification, a portion of fuel which passes through the nozzle hole 7 impinges on a fuel impinging surface 18 of the V-shaped interference body 16*a* so that the flow direction of the fuel which impinges on the fuel impinging surface 18 is sharply changed. The flow of the portion of fuel whose flow direction is sharply changed and the flow of fuel which advances straightly in the nozzle hole 7 impinge on each other thus turning the flow of fuel which passes through the nozzle hole 7 and the orifice 8 into a turbulent flow. Accordingly, the nozzle plate 3 according to this modification can further improve the level of atomization of fuel injected from the orifice 8 compared to conventional nozzle plates.

Twelfth Modification of Sixth Embodiment

Figure 45A:
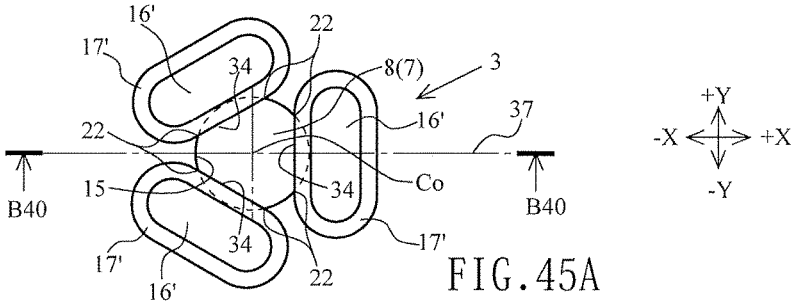
FIG. 45A and FIG. 45B are views showing a nozzle plate according to a twelfth modification of the sixth embodiment.
Figure 45B:
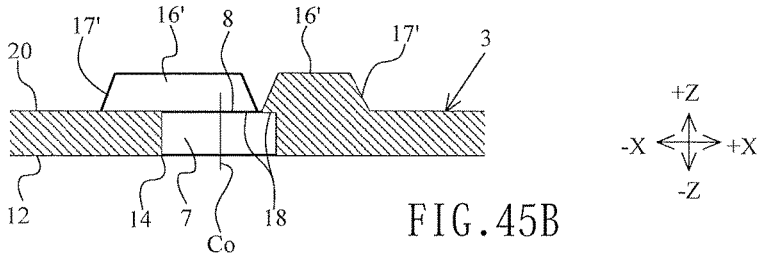

FIG. 45 illustrates views showing a nozzle plate 3 according to a twelfth modification of the sixth embodiment and views showing a modification of the nozzle plate 3 according to the ninth modification of the sixth embodiment. FIG. 45A is a plan view of a portion of the nozzle plate 3, and FIG. 45B is a cross-sectional view of the nozzle plate 3 taken along a line B40-B40 in FIG. 45A. In the nozzle plate 3 according to this modification shown in FIG. 45, constitutional portions substantially equal to the constitutional portions of the nozzle plate 3 according to the ninth modification are given same symbols used for indicating the constitutional parts of the nozzle plate 3 according to the ninth modification, and the explanation which overlaps with the explanation of the nozzle plate 3 according to the ninth modification of the sixth embodiment is omitted.

In the nozzle plate 3 according to this modification shown in FIG. 45, interference bodies 16' are formed around an outlet-side opening portion 15 of a nozzle hole 7 in three places at equal intervals. In the nozzle plate 3 according to this modification, an orifice 8 is formed by straight outer edge portions 34 of the interference bodies 3 in three places and the circular outlet-side opening portion 15 of the nozzle hole 7.

In the nozzle plate 3 according to this modification, corner portions 22 in six places which are formed by the straight outer edge portions 34 of the interference bodies 16' in three places and the circular outlet-side opening portion 15 of the nozzle hole 7 are formed into a non-rounded sharpened and pointed shape so that an end portion of a liquid film of fuel which passes through the orifice 8 is formed into a shape by which the end portion of the liquid film of fuel is easily atomized due to a friction between the end portion of the liquid film of fuel and air. In the nozzle plate 3 according to this modification, a portion of fuel which passes through the nozzle hole 7 impinges on a fuel impinging surface 18 of the V-shaped interference body 16*a* so that the flow direction of the fuel which impinges on the fuel impinging surface 18 is sharply changed. The flow of the portion of fuel whose flow direction is sharply changed and the flow of fuel which advances straightly in the nozzle hole 7 impinge on each other thus turning the flow of fuel which passes through the nozzle hole 7 and the orifice 8 into a turbulent flow. Accordingly, the nozzle plate 3 according to this modification can further improve the level of atomization of fuel injected from the orifice 8 compared to conventional nozzle plates.

Seventh Embodiment

Figures 46A, 46B, 46C, 46D:
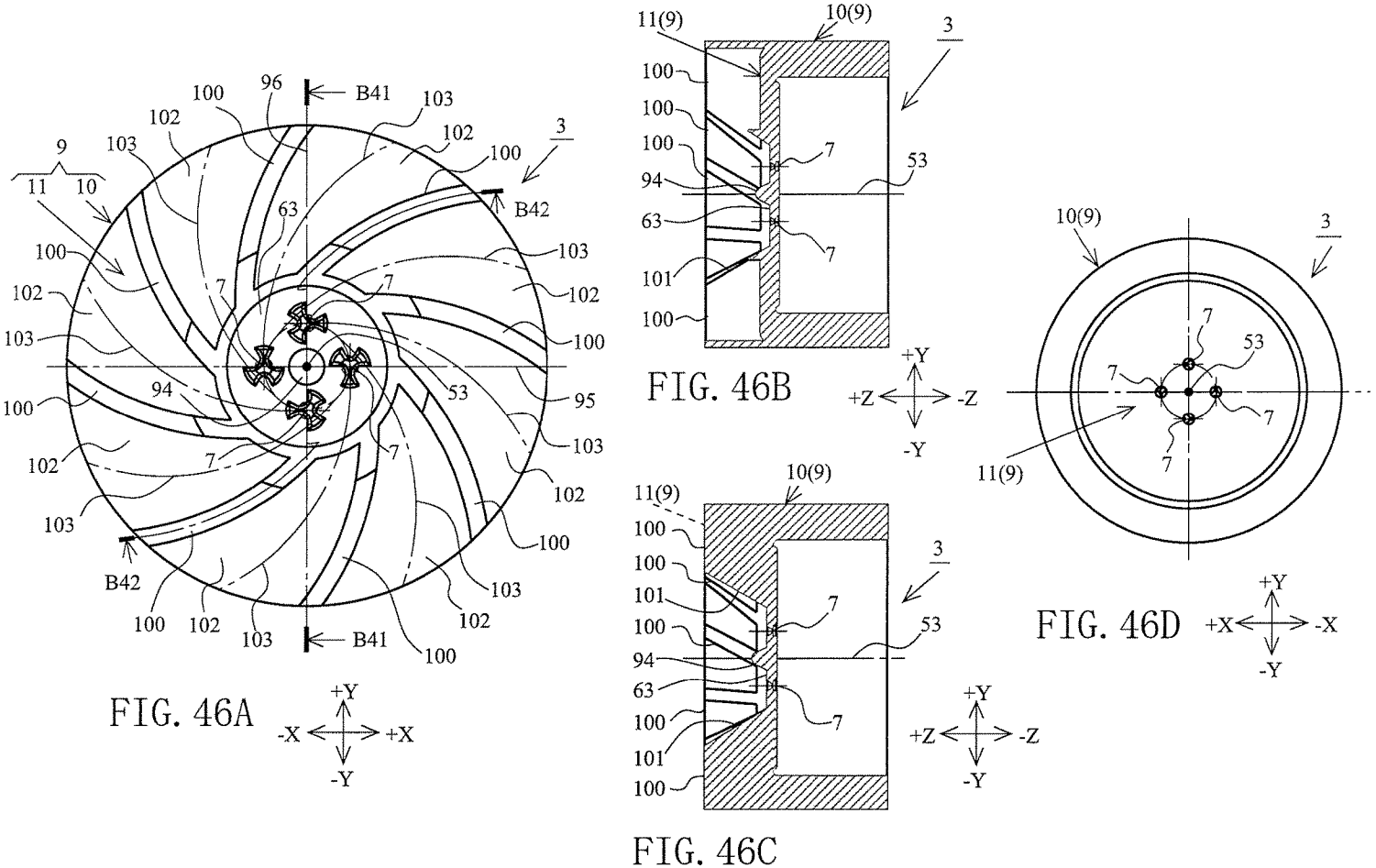
FIG. 46A to FIG. 46D are views showing a nozzle plate according to a seventh embodiment of the present invention.
Figure 47A:
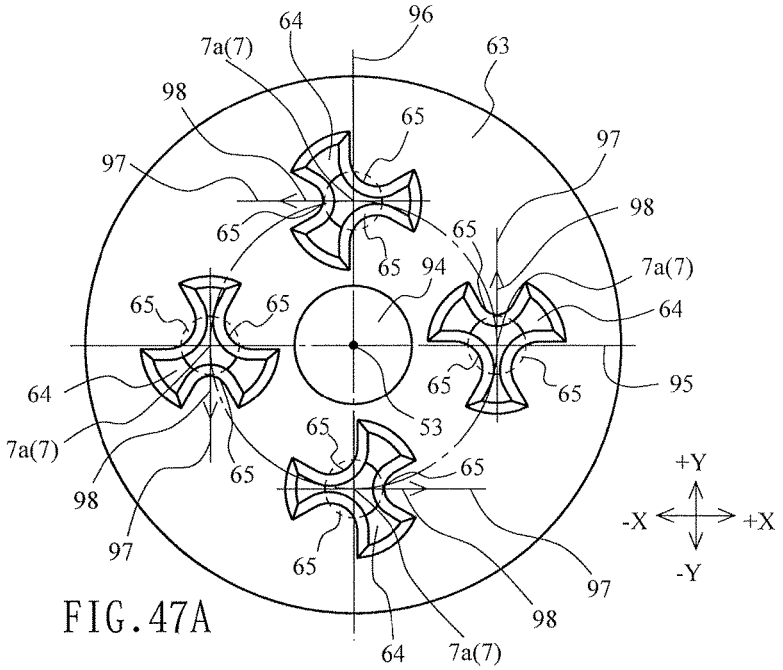
FIG. 47A to FIG. 47C are views showing the nozzle plate according to the seventh embodiment of the present invention.
Figure 47B:
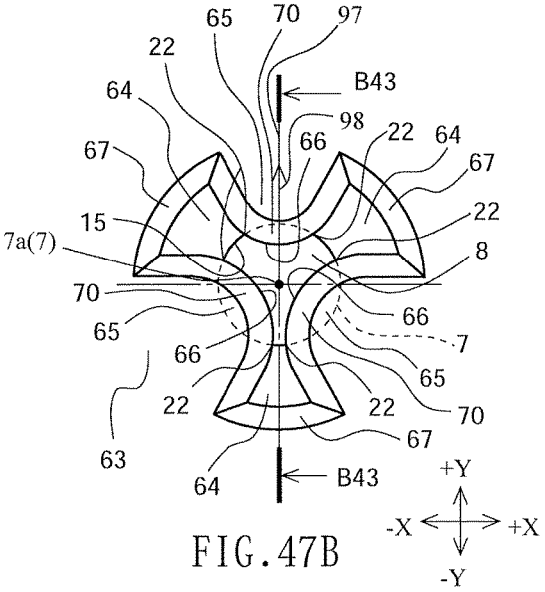
Figure 47C:
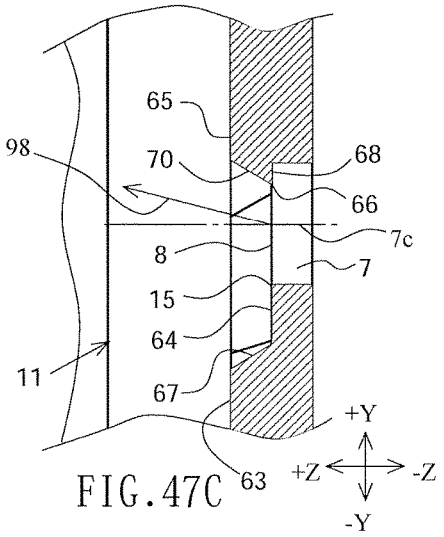

FIG. 46 and FIG. 47 illustrate views showing a nozzle plate 3 according to a seventh embodiment of the present invention. FIG. 46A is a front view of the nozzle plate 3 according to this embodiment, FIG. 46B is a cross-sectional view of the nozzle plate 3 taken along a line B41-B41 in FIG. 46A, FIG. 46C is a cross-sectional view of the nozzle plate 3 taken along a line B42-B42 in FIG. 46A, and FIG. 46D is a back view of the nozzle plate 3 according to this embodiment. FIG. 47A is an enlarged view of a portion (center portion) of the nozzle plate 3 in FIG. 46A, FIG. 47B is a partially enlarged view of the nozzle plate 3 showing a nozzle hole 7 and an area in the vicinity of the nozzle hole 7 in an enlarged manner, and FIG. 47C is an enlarged cross-sectional view taken along a line B43-B43 in FIG. 47B.

As shown in these drawings, in the nozzle plate 3 according to this embodiment, a nozzle plate body 9 includes: a cylindrical wall portion 10 fitted into a distal end side of a valve body 5; and a bottom wall portion 11 formed so as to close one end side of the cylindrical wall portion 10 (see FIG. 2). The bottom wall portion 11 has: nozzle hole plate portions 64 in which nozzle holes 7 are formed; and an interference body plate portion 63 on which interference bodies 65 are formed. The interference body plate portion 63 is formed such that a conical projection 94 having a rounded distal end is formed at the center (the position being aligned with the center axis 53) of the bottom wall portion 11, and a portion of the bottom wall portion 11 around the conical projection 94 is counterbored in a disc shape. The nozzle hole plate portions 64 are formed by partially counterboring portions of the interference body plate portion 63 around the nozzle hole 7 thus having a smaller wall thickness than the interference body plate portion 63. The nozzle holes 7 are formed in the bottom wall portion 11 in four places at equal intervals about a center axis 53, and a portion of the nozzle hole 7 penetrates the nozzle hole plate portion 64 from a front side to a back side (such that portions of the nozzle hole 7 open on the front and back sides). As shown in FIG. 47A, the respective nozzle holes 7 are formed such that centers 7*a* of the nozzle holes 7 are positioned on center lines 95, 96 (the straight line 95 which passes a center axis 53 and is parallel to an X axis, and the straight line 96 which passes the center axis 53 and is parallel to a Y axis) of the bottom wall portion 11.

As shown in FIGS. 47A and 47B, on the interference body plate portion 63 of the bottom wall portion 11, interference bodies 65 which close portions of the nozzle hole 7 are formed in three places for each one nozzle hole 7. The interference bodies 65 in three places are formed such that an orifice 8 which has a line-symmetry shape with respect to a straight line 97 orthogonal to the center line 95 (96) which passes the center 7*a* of the nozzle hole is formed. Accordingly, a center direction 98 of spraying of fuel injected from the orifice 8 is inclined toward the +Y direction side with respect to the center axis 7*c* of the nozzle hole 7, and the center direction 98 of the spraying of fuel injected from the orifice 8 extends along the straight line 97. The center directions 98 of the spraying of fuel injected from four orifices 8 are arranged in the counterclockwise direction about the center axis 53 of the bottom wall portion 11. As a result, the spraying of fuel injected from four orifices 8 forms a swirling flow in the counterclockwise direction about the center axis 53 of the bottom wall portion 11.

As shown in FIG. 47B in detail, the interference bodies 65 formed on the interference body plate portion 63 in three places have the same shape as portions of the interference body 16 described in the first embodiment, and form the orifice 8 by partially closing the nozzle hole 7. Corner portions 22 formed by an arcuate outer edge portion 66 of the interference body 65 and an outlet-side opening portion 15 of the nozzle hole 7 are formed into a non-rounded sharpened shape so that an end portion of a liquid film of fuel which passes through the orifice 8 can be easily atomized due to a friction between the end portion of the liquid film of fuel and air. The orifice 8 of the nozzle plate 3 according to this embodiment has substantially the same shape as the orifice 8 shown in FIG. 31A. The explanation of the nozzle plate 3 according to this embodiment is made with reference to FIG. 47 such that constitutional portions substantially equal to the constitutional portions of the nozzle plate 3 shown in FIG. 31A are given the same symbols, and the explanation which overlaps with the explanation of the nozzle plate 3 shown in FIG. 31A is omitted when appropriate.

As shown in FIG. 47B, each of the interference bodies 65 formed on the interference body plate portion 63 in three places has a fuel impinging surface 68 and a side surface (inclined surface) 67 substantially equal to the fuel impinging surface 68 and the side surface (inclined surface) 67 of the interference body 65 according to the fourth embodiment shown in FIG. 31. The fuel impinging surface 68 and the side surface 67 of the interference body 65 can acquire the substantially same advantageous effects as the fuel impinging surface 68 and the side surface 67 of the interference body 65 described in the fourth embodiment.

Eight blades 100 having the same shape are integrally formed on the bottom wall portion 11 such that the blades 100 are positioned around the center axis 53 at equal intervals and radially outside the interference body plate portion 63. The blade 100 has an arcuate shape as viewed in a plan view, and has a fixed wall thickness over a range from a radially inner end to a radially outer end thereof. The blade 100 is formed by cutting in an oblique upward direction from a radially inner end thereof so as to prevent the blade 100 from interrupting spraying of fuel injected from the orifices 8 thus forming a fuel impinge avoiding portion 101 so as to ensure a sufficient space where spraying state of fuel injected from the orifices 8 is minimally affected. The blade 100 is formed to have the same blade height except for the fuel impinge avoiding portion 101 formed on a radially inner end side of the blade 100. A distance between a pair of blades 100, 100 arranged adjacent to each other is narrowed toward a radially inside from a radially outside so that a blade groove 102 defined between the blades 100 is narrowed toward the radially inside from the radially outside.

In FIG. 46A, using the center axis 53 of the bottom wall portion 11 as a base point, assume the nozzle hole 7 having the center thereof on the center line 95 which extends in the +X axis direction as a first nozzle hole 7, and assume the respective nozzle holes 7 which are displaced from the first nozzle hole 7 at intervals of 90° in the counterclockwise direction as second to fourth nozzle holes 7. In FIG. 46A, using the center axis 53 of the bottom wall portion 11 as the center of a X-Y coordinate plane of a rectangular coordinate system, assume the blade groove 102 having a radially inner end thereof positioned at a portion close to the +X axis of a first quadrant as a first blade groove 102, and assume the respective blade grooves 102 which are displaced from the first blade groove 102 at intervals of 45° in the counterclockwise direction as second to eighth blade grooves 102. In FIG. 46A, a center line 103 of the first blade groove 102 passes the center of the second nozzle hole 7. A center line 103 of the third blade groove 102 passes the center of the third nozzle hole 7. A center line 103 of the fifth blade groove 102 passes the center of the fourth nozzle hole 7. A center line 103 of the seventh blade groove 102 passes the center of the first nozzle hole 7. A center line 103 of the second blade groove 102 passes an area in the vicinity of the second nozzle hole 7. A center line 103 of the fourth blade groove 102 passes an area in the vicinity of the third nozzle hole 7. A center line 103 of the sixth blade groove 102 passes an area in the vicinity of the fourth nozzle hole 7. A center line 103 of the eighth blade groove 102 passes an area in the vicinity of the first nozzle hole 7. The center lines 103 of these first to eighth blade grooves 102 are positioned so as to pass an area around the center axis 53 of the bottom wall portion 11.

In the nozzle plate 3 having the above-mentioned configuration, when fuel is injected from the respective orifices 8, a pressure in an area around the orifice 8 on an outlet side is lowered (lowered to a pressure lower than an atmospheric pressure) and hence, air around the nozzle plate 3 is made to flow (is sucked) toward the radially inner end side from the radially outer end side of the first to eighth blade grooves 102 so that air flows out from the radially inner ends of the first to eighth blade grooves 102 toward the center 7*a* of the nozzle hole 7 or the area in the vicinity of the nozzle hole 7. That is, the flow of air flowed out from the radially inner ends of the first to eighth blade grooves 102 moves away from the center axis 53 of the bottom wall portion 11 by a predetermined distance (at least by an amount corresponding to a shape of the conical projection 94) thus generating a swirling flow in the counterclockwise direction having the center thereof at the center axis 53 of the bottom wall portion 11. Atomized droplets (fine particles of fuel) in sprayed fuel have a momentum (a velocity component in the counterclockwise direction) so that the droplets entrap surrounding air and swirling air, and impart the momentum to the entrapped air. Air which acquires the momentum forms a spiral flow and conveys droplets (fine particles of fuel). The droplets (fine particles of fuel) in sprayed fuel are conveyed by the spiral air flow so that scattering of the droplet to the surrounding can be prevented. Accordingly, in the nozzle plate 3 according to this embodiment, an amount of fuel stuck to a wall surface or the like of the intake pipe 2 can be made small and hence, utilization efficiency of fuel can be improved (see FIG. 1).

Further, in the nozzle plate 3 according to this embodiment, eight blades 100 are integrally formed on the bottom wall portion 11 such that the blades 100 are positioned around the center axis 53 at equal intervals from each other and radially outside the interference body plate portion 63. Accordingly, at the time of assembling the nozzle plate 3 to the valve body 5, it is possible to prevent tools or the like from impinging on the nozzle hole 7 and an area around the nozzle hole 7 by means of the blades 100. It is also possible to prevent the damage on the nozzle holes 7 formed in the bottom wall portion 11 and areas around the nozzle holes 7 by means of the blades 100. Further, in the nozzle plate 3 according to this embodiment, when the fuel injection device 1 where the nozzle plate 3 is assembled to the valve body 5 is assembled to the intake pipe 2 of an engine, it is possible to prevent engine parts or the like from impinging on the nozzle hole 7 and an area around the nozzle hole 7 by means of the blades 100 and hence, it is possible to prevent the nozzle holes 7 formed in the bottom wall portion 11 and portions of the bottom wall portion 11 around the nozzle holes 7 from being damaged by means of the blades 100.

First Modification of Seventh Embodiment

Figure 48A:
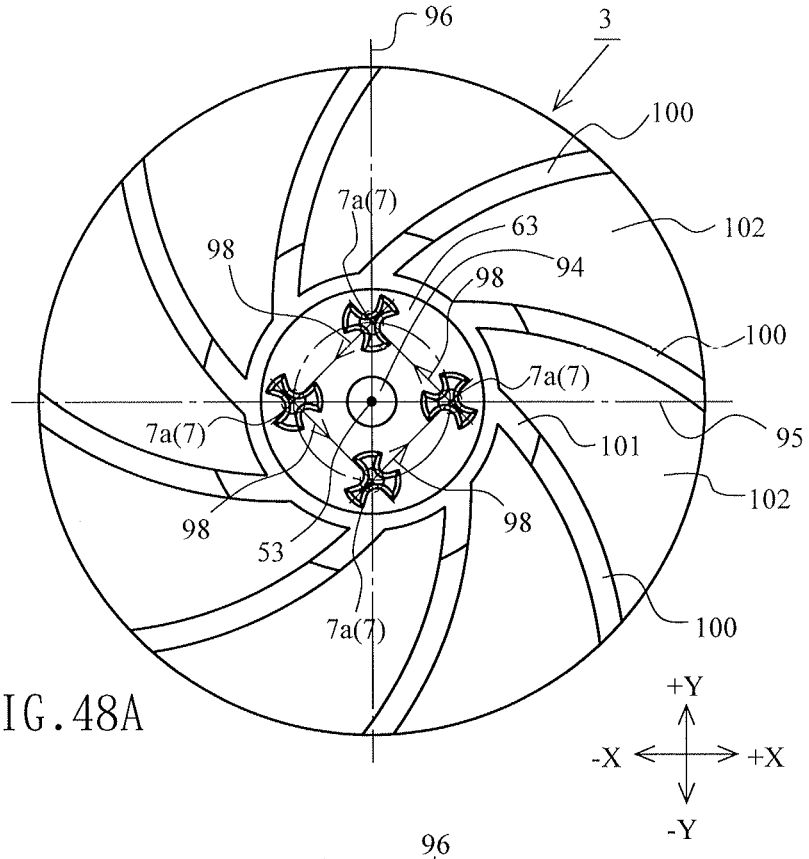
FIG. 48A and FIG. 48B are views showing a nozzle plate according to a first modification of the seventh embodiment.
Figure 48B:
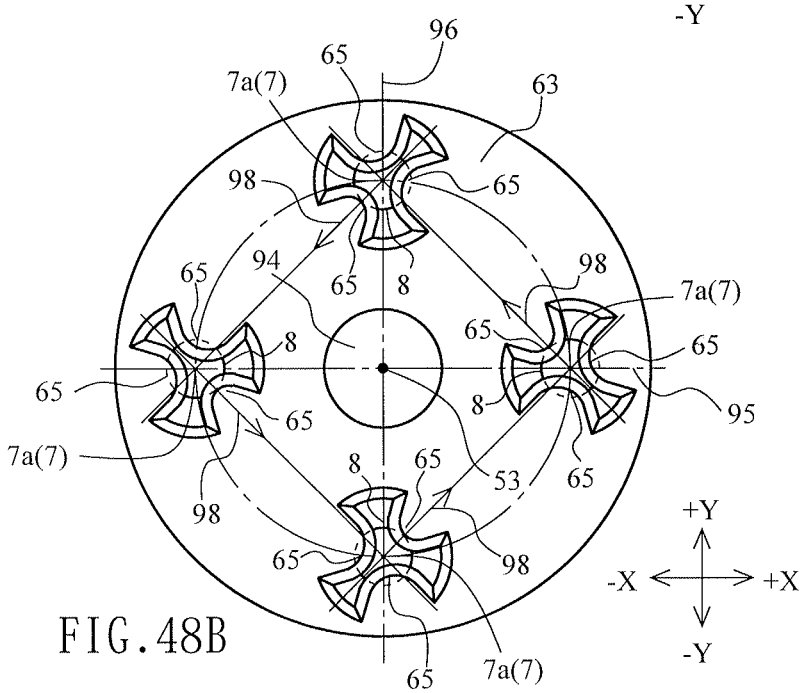

FIG. 48 illustrates views showing a first modification of the nozzle plate 3 according to the seventh embodiment of the present invention. FIG. 48A is a front view of the nozzle plate 3, and is also a view which corresponds to FIG. 46A. FIG. 48B is a view showing a center portion of the nozzle plate 3 in an enlarged manner, and is also a view which corresponds to FIG. 47A.

In the nozzle plate 3 according to this modification, interference bodies 65 are formed for each nozzle hole 7 in three places such that a center direction 98 of spraying of fuel injected from each orifice 8 is directed to a center 7*a* of another nozzle hole 7 arranged adjacent to the nozzle hole 7 (positioned on a front side in the fuel injecting direction). That is, the nozzle plate 3 according to this modification is formed such that the orifices 8 of the nozzle plate 3 according to the seventh embodiment (see FIG. 46A) are rotated in the counterclockwise direction by 45° using the center 7*a* of the nozzle hole 7 as the center of rotation, and the nozzle holes 7 and the orifices 8 formed on the nozzle plate 3 according to the seventh embodiment in four places (see FIG. 46A) are displaced radially outward with respect to the center axis 53 of the bottom wall portion 11.

In the nozzle plate 3 according to this embodiment having such a configuration, compared to the nozzle plate 3 according to the seventh embodiment, spraying of fuel from the orifices 8 arranged adjacent to each other largely affects each other so that a larger amount of momentum in the swirling direction can be imparted to air swirled by the plurality of blades 100 by fine particles of fuel in the sprayed fuel thus forming a stronger spiral air flow.

Second Modification of Seventh Embodiment

Figure 49C:
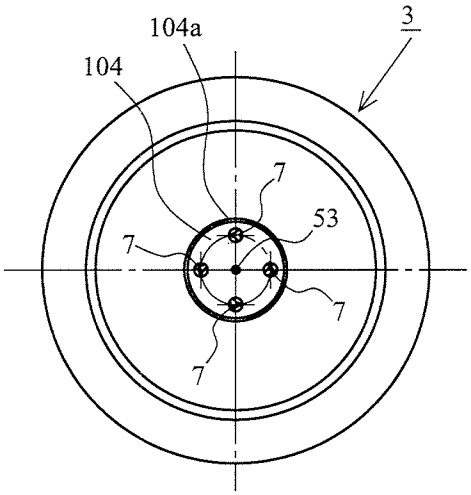
FIG. 49A to FIG. 49C are views showing a nozzle plate according to a second modification of the seventh embodiment.
Figure 49B:
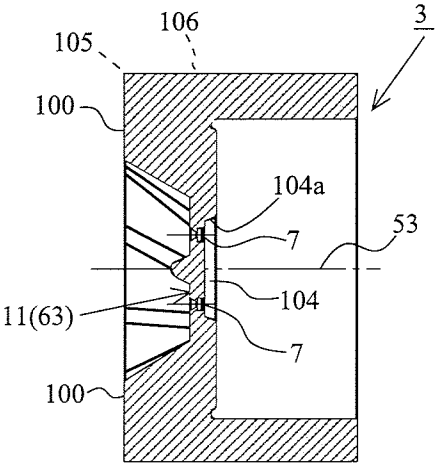
Figure 49A:
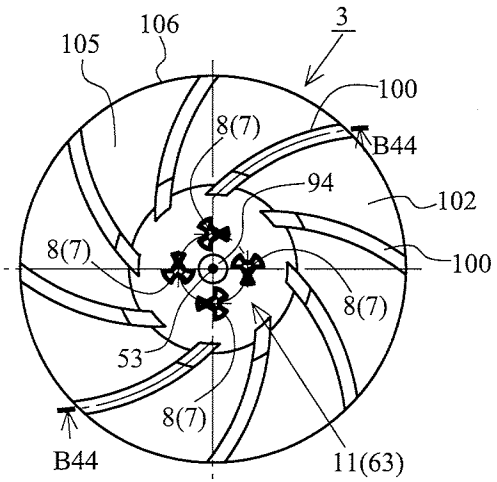

FIG. 49 illustrates views showing a second modification of the nozzle plate 3 according to the seventh embodiment of the present invention. FIG. 49A is a front view of the nozzle plate 3, and is also a view which corresponds to FIG. 46A. FIG. 49B is a view taken along a line B44-B44 in FIG. 49A. FIG. 49C is a back view of the nozzle plate, and is also a view which corresponds to FIG. 46D.

The nozzle plate 3 according to this modification differs from the nozzle plate 3 according to the seventh embodiment with respect to a point that a surface of an interference body plate portion 63 is formed coplanar with a surface of a bottom wall portion 11, while the interference body plate portion 63 is formed by counterboring a bottom wall portion 11 in a disc shape. In the nozzle plate 3 according to this modification, to make a wall thickness of a nozzle hole plate portion 64 and a wall thickness of the interference body plate portion 63 equal to a wall thickness of the nozzle hole plate portion 64 and a wall thickness of the interference body plate portion 63 of the nozzle plate 3 according to the seventh embodiment, a bottomed circular hole 104 is formed on a back surface side of the bottom wall portion 11 by counterboring. Four nozzle holes 7 are formed in a bottom surface of the circular hole 104. A side surface 104*a* of the circular hole 104 is positioned so as to surround four nozzle holes 7.

In the nozzle plate 3 according to this modification, the bottom wall portion 11 is obliquely formed by cutting or the like from a position slightly radially outside a radially inner end of the blade 100 toward a radially outer end of the blade 100 thus forming an inclined surface 105 having a hollow disc shape. A radially outer end of the inclined surface 105 having a hollow disc shape is rounded by a gently-curved surface 106. As a result, in the nozzle plate 3 according to this modification, compared to the nozzle plate 3 according to the seventh embodiment, air around blade grooves 102 can be smoothly introduced into the blade grooves 102 over a wide range. Further, the nozzle plate 3 according to this modification is formed such that, as described above, a surface of the interference body plate portion 63 is coplanar with a surface of the bottom wall portion 11. Accordingly, compared to the nozzle plate 3 according to the seventh embodiment where the interference body plate portion 63 is formed by counterboring the bottom wall portion 11 in a disc shape, air which flows into an interference body plate portion side from the radially inner ends of the blade grooves 102 is minimally affected by a recessed portion and hence, a speed of air flowing toward an orifice 8 side from the radially inner ends of the blade grooves 102 becomes high.

In the nozzle plate 3 according to this modification having the above-mentioned configuration, compared to the nozzle plate 3 according to the seventh embodiment, a speed of air flowing toward an orifice 8 side from the radially inner ends of the blade grooves 102 is high and hence, when a momentum is imparted to air flowing toward an orifice 8 side by fine particles of fuel in the spray, a stronger spiral air flow is formed.

Third Modification of Seventh Embodiment

Figure 50A:
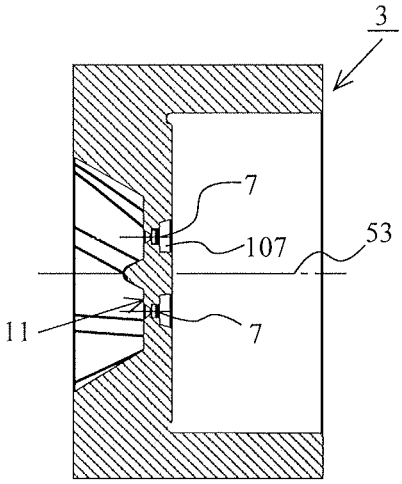
FIG. 50A and FIG. 50B are views showing a nozzle plate according to a third modification of the seventh embodiment.
Figure 50B:
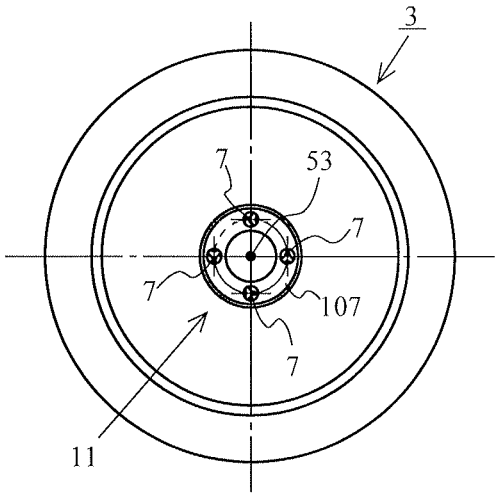

FIG. 50 illustrates views showing a third modification of the nozzle plate 3 according to the seventh embodiment of the present invention, and views showing a modification of the nozzle plate 3 according to the above-mentioned second modification. FIG. 50A is a cross-sectional view of the nozzle plate 3 which corresponds to FIG. 49B, and FIG. 50B is a back view of the nozzle plate 3 which corresponds to FIG. 49C.

In the nozzle plate 3 according to this modification shown in FIG. 50, the circular hole 104 formed on the back surface side of the bottom wall portion 11 of the nozzle plate 3 according to the above-mentioned second modification is replaced with a hole 107 having a ring shape so that an amount of fuel which stays in the hole 107 is set smaller than an amount of fuel which stays in the circular hole 104.

Fourth Modification of Seventh Embodiment

Figure 51A:
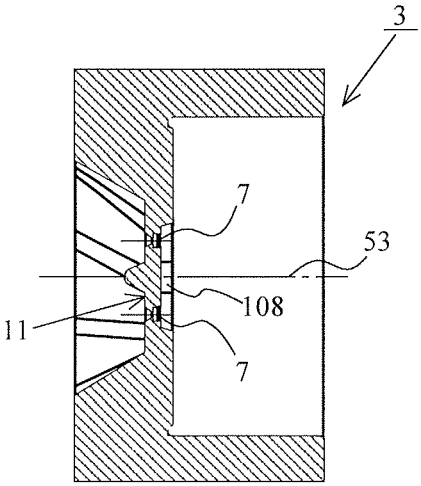
FIG. 51A and FIG. 51B are views showing a nozzle plate according to a fourth modification of the seventh embodiment.
Figure 51B:
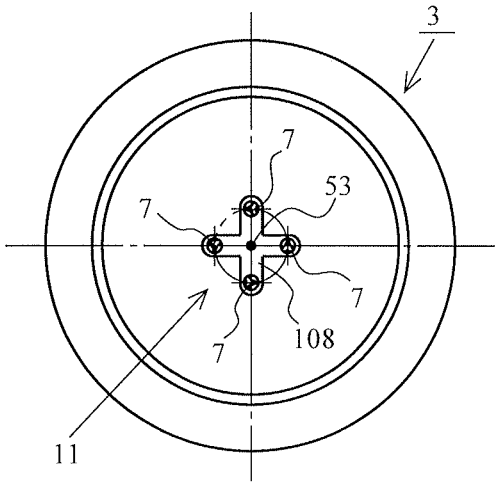

FIG. 51 illustrates views showing a fourth modification of the nozzle plate 3 according to the seventh embodiment of the present invention, and views showing a modification of the nozzle plate 3 according to the above-mentioned second modification. FIG. 51A is a cross-sectional view of the nozzle plate 3 which corresponds to FIG. 49B, and FIG. 51B is a back view of the nozzle plate 3 which corresponds to FIG. 49C.

In the nozzle plate 3 according to this modification shown in FIG. 51, the circular hole 104 formed on the back surface side of the bottom wall portion 11 of the nozzle plate 3 according to the above-mentioned second modification is replaced with a hole 108 having a cruciform so that an amount of fuel which stays in the hole 108 is set smaller than an amount of fuel which stays in the circular hole 104.

Eighth Embodiment

Figure 52A:
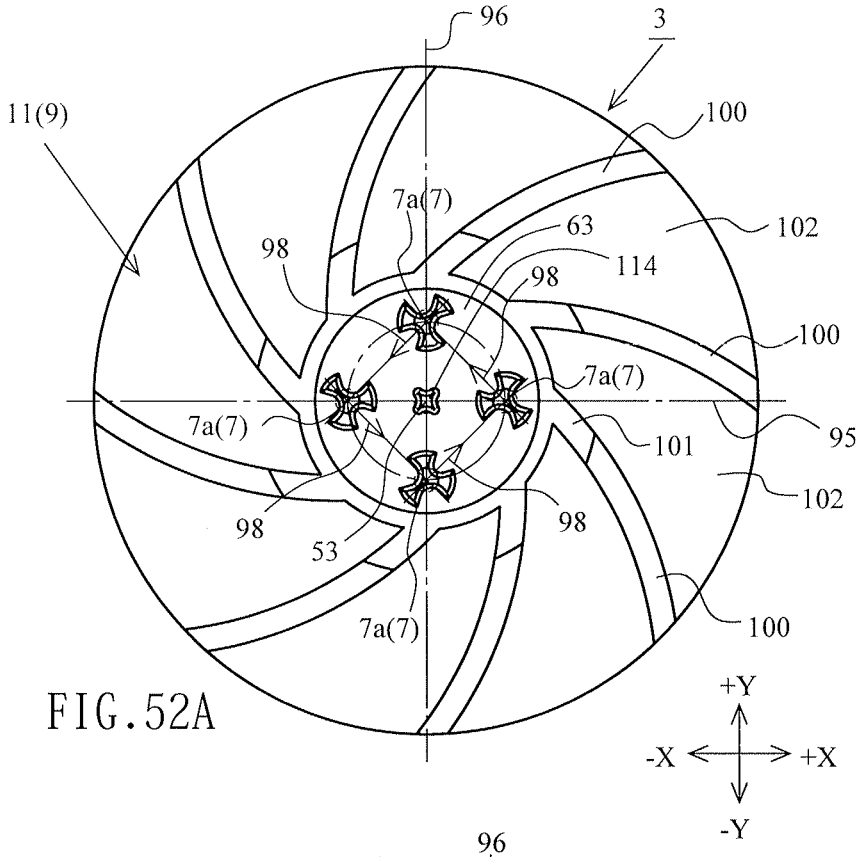
FIG. 52A and FIG. 52B are views showing a nozzle plate according to an eighth embodiment and views showing the structure of the nozzle plate according to the first modification of the seventh embodiment in a further modified manner.
Figure 52B:
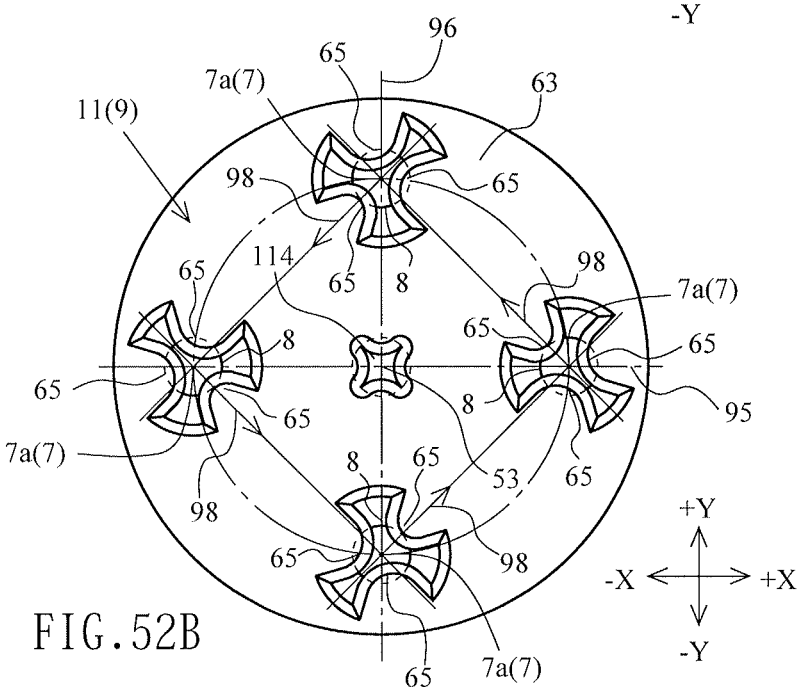
Figure 53A:
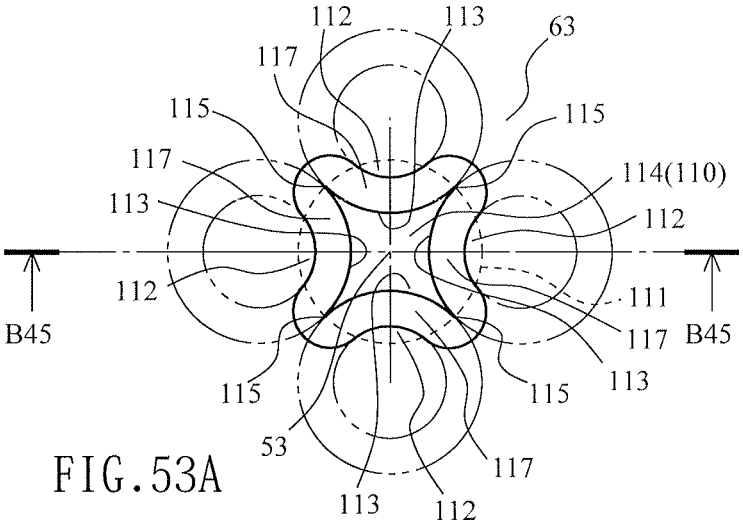
FIG. 53A and FIG. 53B are views showing a center portion of the nozzle plate shown in FIG. 52 in an enlarged manner.
Figure 53B:
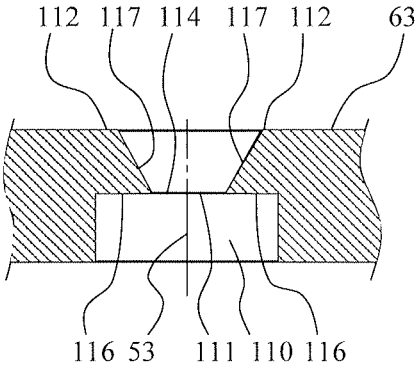
Figure 54A:
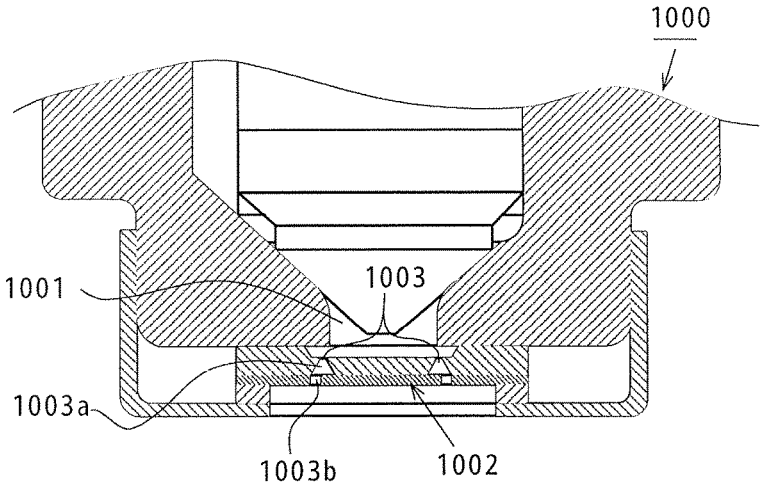
FIG. 54A to FIG. 54D are views showing a conventional nozzle plate which is mounted on a fuel injection port of a fuel injection device.
Figure 54B:
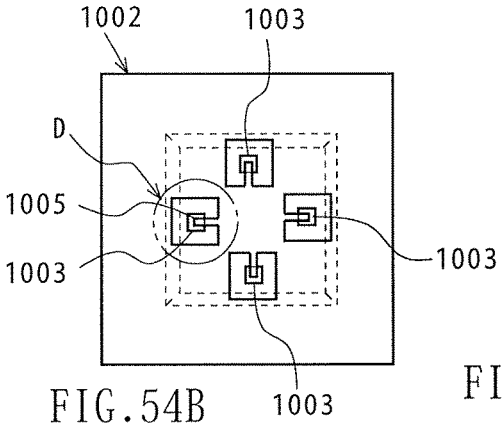
Figure 54C:
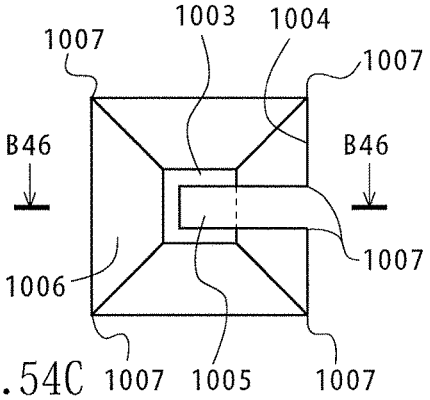
Figure 54D:
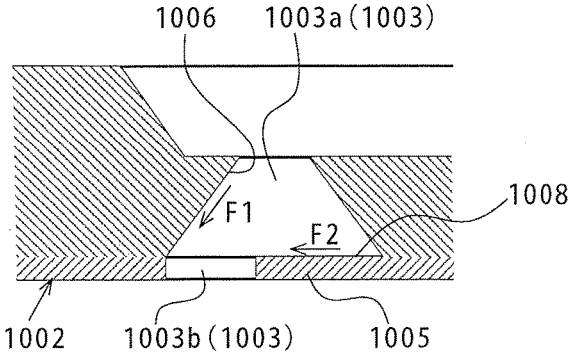

FIG. 52 illustrates views showing a nozzle plate 3 according to an eighth embodiment of the present invention. FIG. 52 illustrates views showing the structure where the nozzle plate 3 according to the first modification of the seventh embodiment is further modified. FIG. 53 illustrates views showing a center portion of the nozzle plate 3 shown in FIG. 52 in an enlarged manner.

As shown in these drawings, in the nozzle plate 3, a center nozzle hole 110 is formed at the center (position which is aligned with the center axis 53) of a bottom wall portion 11 in a penetrating manner along a center axis 53. An outlet-side opening portion 111 of the center nozzle hole 110 on an outer surface side is partially closed by interference bodies 112 in four places. Arcuate outer edge portions 113 of the interference bodies 112 in four places project inwardly in the radial direction of the center nozzle hole 110 so as to partially close the outlet-side opening portion 111 of the center nozzle hole 110 thus forming a center orifice 114. Arcuate outer edge portions 113, 113 of the interference bodies 112, 112 arranged adjacent to each other are brought into contact with each other on an opening edge of the outlet-side opening portion 111 of the center nozzle hole 110. Corner portions 115 are formed at intersecting portions of the pair of arcuate outer edge portions 113, 113. The corner portions 115 are formed on the opening edge of the center orifice 114 in four places at equal intervals from each other, and have a non-rounded sharpened and pointed shape respectively. As a result, the corner portion 115 can be formed into a sharpened and pointed shape by which an end portion of a liquid film of fuel which passes through the center orifice 114 can be easily atomized due to a friction between the end portion of the liquid film of fuel and air. Each interference body 112 has: a fuel impinging surface 116 which is a flat surface orthogonal to the center axis 53 of the center nozzle hole 110; and a side surface (inclined surface) 70 which is formed obliquely by cutting or the like from the arcuate outer edge portion 113. Side surfaces 117 of the interference bodies 112, 112 arranged adjacent to each other are smoothly connected to each other by the corner portion 115 in an arcuate shape.

In the nozzle plate 3 according to this embodiment, sprayed fuel generated by being injected from the center orifice 114 formed at the center of the bottom wall portion 11 is added to sprayed fuel generated by being injected from orifices 8 formed on the bottom wall portion 11 in four places. Accordingly, a peripheral spray fuel is sucked to a center sprayed fuel and, at the same time, a larger amount of momentum in the swirling direction is imparted to air swirled by a plurality of blades 100 by fine particles of fuel in the spray and hence, a stronger spiral air flow is formed.

The nozzle plate 3 according to this embodiment is also applicable to the nozzle plate 3 according to the seventh embodiment, and can acquire substantially the same advantageous effects as the nozzle plate 3 according to the seventh embodiment. Further, the shape of the center orifice 114 is not limited to the shape employed by this embodiment, and the shapes of the orifices employed by the above-mentioned other embodiments are also applicable.

Other Embodiment

In the nozzle plates 3 according to the above-mentioned seventh and eighth embodiments, the mode where the nozzle holes 7 are formed in four places, and the number of the blades 100 is set to the number twice as large as the number of the nozzle holes 7 (eight) is exemplified. However, the configuration of the nozzle plates 3 is not limited to the above, and the nozzle holes 7 may be formed in a plurality of (two or more) places, and the number of the blades 100 may be set to the number twice as large as the number of the nozzle holes 7. In the nozzle plates 33 according to the above-mentioned seventh and eighth embodiments, the number of the blade grooves 102 formed is set to a value twice as large as the number of the nozzle holes 7. However, the number of the blade grooves 102 formed is not limited to the above, and may be set equal to the number of the nozzle holes 7. In the nozzle plates 3 according to the above-mentioned seventh and eighth embodiments, the number of the blade grooves 102 is set to the number which is twice as large as the number of the nozzle holes 7. However, the number of the blade grooves 102 is not limited to the above, and may be set to any multiples of the number of the nozzle holes 7.

Further, in the nozzle plates 3 according to the above-mentioned seventh and eighth embodiments, the shape of the orifices 8 and the shape of the blades 100 (a shape of the blades 100 twisted in the rightward direction) are decided such that a swirling flow in the counterclockwise direction is generated around the center axis 53 of the bottom wall portion 11. However, the present invention is not limited to the nozzle plates 3 according to these seventh and eighth embodiments, and the orifices 8 and the blades 100 (the shape of the blade 100 twisted in the leftward direction) may be formed into a shape such that a swirling flow in the clockwise direction is generated around the center axis 53 of the bottom wall portion 11.

In the nozzle plates 3 according to the above-mentioned seventh and eighth embodiments, a shape of the blade 100 as viewed in a plan view is an arcuate shape. However, the shape of the blade 100 is not limited to an arcuate shape, and the shape of the blade 100 as viewed in a plan view may be a straight linear shape.

The nozzle plates 3 according to the above-mentioned third to eighth embodiments are not limited to the case where the nozzle plates 3 are manufactured using a synthetic resin material by injection molding, and the nozzle plates 3 may be manufactured by a metal injection molding method.

REFERENCE SIGNS LIST

1: fuel injection device, 3: nozzle plate (nozzle plate for a fuel injection device), 4: fuel injection port, 7: nozzle hole, 8: orifice, 15: outlet-side opening portion, 16, 16', 16", 51, 65, 76: interference body, **16*a*: V-shaped interference body (interference body), 21, 54, 66, 77: circular outer edge portion (arcuate outer edge portion, outer edge portion), 22, 22', 92: corner portion, 33, 33': semicircular outer edge portion (arcuate outer edge portion, outer edge portion), 34, 86**: straight outer edge portion (outer edge portion)

The invention claimed is:

1. A nozzle plate to be mounted on a fuel injection port of a fuel injection device, the nozzle plate comprising:

a bottom wall portion having a nozzle hole through which a fuel injected from the fuel injection port passes, the nozzle hole having an outlet-side opening portion which is an opening of a fuel flow-out side of the nozzle hole; and an interference body configured to partially close the outlet-side opening portion so that an orifice which throttles the flow of the fuel is formed by the outlet-side opening portion and the interference body;

wherein the interference body has an outer edge portion forming a part of an opening edge of the orifice, the interference body being shaped such that a first portion of the fuel passing through the nozzle hole is atomized by impinging on the interference body, and the interference body being further shaped such that the flow of the fuel is formed into a turbulent flow in which atomization of the fuel passing through the orifice in air is facilitated by sharply bending the flow of the first portion of the fuel passing through the nozzle hole to cause the flow of the first portion of the fuel to impinge on a second portion of the fuel flowing straightly through the nozzle hole and the orifice, wherein a corner portion of the opening edge of the orifice formed by the outlet-side opening portion of the nozzle hole and the interference body is formed into a non-rounded sharpened shape so as to form an end portion of a liquid film of the fuel passing through the orifice into a sharpened shape by which the end portion of the liquid film of the fuel is atomized by friction between the end portion of the liquid film of the fuel and air, wherein the interference body has a fuel impinging surface on which the first portion of the fuel passing through the nozzle hole impinges, and an inclined surface intersecting the fuel impinging surface at an acute angle, and wherein the interference body and the nozzle hole are formed such that an air layer is formed between the fuel passing through the orifice and the inclined surface so as to facilitate entrapping of air into the fuel passing through the orifice.

2. A nozzle plate to be mounted on a fuel injection port of a fuel injection device, the nozzle plate comprising:

a bottom wall portion having a nozzle hole through which a fuel injected from the fuel injection port passes, the nozzle hole having an outlet-side opening portion which is an opening of a fuel flow-out side of the nozzle hole; and an interference body at a downstream side of the nozzle hole, the interference body being configured to partially close the outlet-side opening portion of the nozzle hole at the downstream side thereof so that an orifice which throttles the flow of the fuel is formed by the outlet-side opening portion and the interference body;

wherein the interference body has an arcuate outer edge portion forming a part of an opening edge of the orifice, the interference body being shaped such that a first portion of the fuel passing through the nozzle hole is atomized by impinging on the interference body, and the interference body being further shaped such that the flow of the fuel is formed into a turbulent flow in which atomization of the fuel passing through the orifice in air is facilitated by sharply bending the flow of the first portion of the fuel passing through the nozzle hole to cause the flow of the first portion of the fuel to impinge on a second portion of the fuel flowing straightly through the nozzle hole and the orifice, wherein a corner portion of the opening edge of the orifice formed by the outlet-side opening portion of the nozzle hole and the interference body is formed into a non-rounded sharpened shape so as to form an end portion of a liquid film of the fuel passing through the orifice into a sharpened shape by which the end portion of the liquid film of the fuel is atomized by friction between the end portion of the liquid film of the fuel and air, and wherein the corner portion is formed by an intersection between an arcuate outer edge portion of the interference body and an opening edge of the outlet-side opening portion of the nozzle hole such that the orifice has a non-rounded outer periphery.

3. The nozzle plate according to claim 1, wherein the corner portion is formed by a straight outer edge portion of the interference body and the outlet-side opening portion of the nozzle hole having an arcuate shape.

4. The nozzle plate according to claim 1, wherein the corner portion is formed by an arcuate outer edge portion of the interference body and the outlet-side opening portion of the nozzle hole.

5. A nozzle plate to be mounted on a fuel injection port of a fuel injection device, the nozzle plate comprising:

a bottom wall portion having a nozzle hole through which a fuel injected from the fuel injection port passes, the nozzle hole having an outlet-side opening portion which is an opening of a fuel flow-out side of the nozzle hole; and an interference body configured to partially close the outlet-side opening portion so that an orifice which throttles the flow of the fuel is formed by the outlet-side opening portion and the interference body;

wherein the interference body has an arcuate outer edge portion forming a part of an opening edge of the orifice, the interference body being shaped such that a first portion of the fuel passing through the nozzle hole is atomized by impinging on the interference body, and the interference body being further shaped such that the flow of the fuel is formed into a turbulent flow in which atomization of the fuel passing through the orifice in air is facilitated by sharply bending the flow of the first portion of the fuel passing through the nozzle hole to cause the flow of the first portion of the fuel to impinge on a second portion of the fuel flowing straightly through the nozzle hole and the orifice, wherein a corner portion of the opening edge of the orifice formed by the outlet-side opening portion of the nozzle hole and the interference body is formed into a non-rounded sharpened shape so as to form an end portion of a liquid film of the fuel passing through the orifice into a sharpened shape by which the end portion of the liquid film of the fuel is atomized by friction between the end portion of the liquid film of the fuel and air, and wherein the corner portion is formed by an arcuate outer edge portion of the interference body and an opening edge of the outlet-side opening portion of the nozzle hole, wherein the interference body has a fuel impinging surface on which a portion of the fuel passing through the nozzle hole impinges, and an inclined surface intersecting the fuel impinging surface at an acute angle, and wherein the interference body and the nozzle hole are formed such that an air layer is formed between the fuel passing through the orifice and the inclined surface so as to facilitate entrapping of air into the fuel passing through the orifice.

6. The nozzle plate according to claim 1, wherein the opening edge of the orifice formed by the interference body has an arcuate shape.

7. The nozzle plate according to claim 6, wherein the outlet-side opening portion of the nozzle hole has a circular shape.

8. The nozzle plate according to claim 6, wherein the outlet-side opening portion of the nozzle hole has a quadrangular shape.

9. The nozzle plate according to claim 6, wherein the outlet-side opening portion of the nozzle hole has a triangular shape.

10. The nozzle plate according to claim 6, wherein the outlet-side opening portion of the nozzle hole has an elliptical shape.

11. The nozzle plate according to claim 7, wherein the opening edge of the orifice has a crescent shape, and corner portions which are positioned on respective opposite ends of the opening edge of the orifice have a non-rounded sharpened shape.

12. The nozzle plate according to claim 1, further comprising:

a cylindrical wall portion to be fitted onto a valve body of the fuel injection device having the fuel injection port formed therein, the bottom wall portion closing one end side of the cylindrical wall portion, wherein the bottom wall portion has a nozzle hole plate portion in which the nozzle hole opens, and an interference body plate portion on which the interference body is formed, and wherein the nozzle hole plate portion is shaped so that the interference body plate portion is partially counterbored.

13. The nozzle plate according to claim 1, further comprising:

a cylindrical wall portion to be fitted onto a valve body of the fuel injection device having the fuel injection port formed therein, the bottom wall portion closing one end side of the cylindrical wall portion, wherein the nozzle hole is one of a plurality of nozzle holes, and the interference body is one of a plurality of interference bodies, wherein the bottom wall portion has a nozzle hole plate portion in which the plurality of nozzle holes open, and an interference body plate portion on which a respective one of the interference bodies is formed for each one of the plurality of nozzle holes, and wherein the nozzle hole plate portion is shaped so that the interference body plate portion is partially counterbored.

14. The nozzle plate for a fuel injection device according to claim 12, further comprising a nozzle guard projection which projects in a direction along which a center axis of the valve body extends, the nozzle guard projection being formed on an outer surface of the bottom wall portion at a position surrounding the nozzle hole plate portion, and wherein the nozzle guard projection is formed of one of (i) an annular body formed on the bottom wall portion surrounding the nozzle hole plate portion, or (ii) a plurality of block bodies formed on the bottom wall portion surrounding the nozzle hole plate portion, and a distal end of the nozzle guard projection is formed so as to define a gap between an imaginary plane and the bottom wall portion and so as not to obstruct spraying of the fuel injected from the nozzle hole at the time of contacting the distal end with the imaginary plane.

15. The nozzle plate for a fuel injection device according to claim 13, further comprising a nozzle guard projection which projects in a direction along which a center axis of the valve body extends, the nozzle guard projection being formed on an outer surface of the bottom wall portion at a position surrounding the nozzle hole plate portion, and wherein the nozzle guard projection is formed of one of (i) an annular body formed on the bottom wall portion surrounding the nozzle hole plate portion, or (ii) a plurality of block bodies formed on the bottom wall portion surrounding the nozzle hole plate portion, and a distal end of the nozzle guard projection is formed so as to define a gap between an imaginary plane and the bottom wall portion and so as not to obstruct spraying of the fuel injected from the nozzle hole at the time of contacting the distal end with the imaginary plane.

16. The nozzle plate for a fuel injection device according to claim 2, wherein the opening edge of the orifice formed by the interference body has an arcuate shape.

17. The nozzle plate according to claim 16, wherein the outlet-side opening portion of the nozzle hole has a circular shape.

18. The nozzle plate according to claim 2, further comprising:

a cylindrical wall portion to be fitted onto a valve body of the fuel injection device having the fuel injection port formed therein, the bottom wall portion closing one end side of the cylindrical wall portion, wherein the bottom wall portion has a nozzle hole plate portion in which the nozzle hole opens, and an interference body plate portion on which the interference body is formed, and wherein the nozzle hole plate portion is shaped so that the interference body plate portion is partially counterbored.

19. The nozzle plate according to claim 2, further comprising:

a cylindrical wall portion to be fitted onto a valve body of the fuel injection device having the fuel injection port formed therein, the bottom wall portion closing one end side of the cylindrical wall portion, wherein the nozzle hole is one of a plurality of nozzle holes, and the interference body is one of a plurality of interference bodies, wherein the bottom wall portion has a nozzle hole plate portion in which the plurality of nozzle holes open, and an interference body plate portion on which a respective one of the interference bodies is formed for each one of the plurality of nozzle holes, and wherein the nozzle hole plate portion is shaped so that the interference body plate portion is partially counterbored.

20. A nozzle plate to be mounted on a fuel injection port of a fuel injection device, the nozzle plate comprising:

a bottom wall portion having a nozzle hole through which a fuel injected from the fuel injection port passes, the nozzle hole having an outlet-side opening portion which is an opening of a fuel flow-out side of the nozzle hole;

an interference body configured to partially close the outlet-side opening portion so that an orifice which throttles the flow of the fuel is formed by the outlet-side opening portion and the interference body;

a cylindrical wall portion to be fitted onto a valve body of the fuel injection device having the fuel injection port formed therein, the bottom wall portion closing one end side of the cylindrical wall portion; and a nozzle guard projection which projects in a direction along which a center axis of the valve body extends, the nozzle guard projection being formed on an outer surface of the bottom wall portion at a position surrounding the nozzle hole plate portion;

wherein the nozzle guard projection is formed of one of (i) an annular body formed on the bottom wall portion surrounding the nozzle hole plate portion, or (ii) a plurality of block bodies formed on the bottom wall portion surrounding the nozzle hole plate portion, and a distal end of the nozzle guard projection is formed so as to define a gap between an imaginary plane and the bottom wall portion and so as not to obstruct spraying of the fuel injected from the nozzle hole at the time of contacting the distal end with the imaginary plane, wherein the bottom wall portion has a nozzle hole plate portion in which the nozzle hole opens, and an interference body plate portion on which the interference body is formed, wherein the nozzle hole plate portion is shaped so that the interference body plate portion is partially counterbored, wherein the interference body has an outer edge portion forming a part of an opening edge of the orifice, the interference body being shaped such that a portion of the fuel passing through the nozzle hole is atomized by impinging on the interference body, and the interference body being further shaped such that the flow of the fuel is formed into a turbulent flow in which atomization of the fuel passing through the orifice in air is facilitated by sharply bending the flow of a first portion of the fuel passing through the nozzle hole to cause the flow of the first portion of the fuel to impinge on a second portion of the fuel flowing straightly through the nozzle hole and the orifice, and wherein a corner portion of the opening edge of the orifice formed by the outlet-side opening portion of the nozzle hole and the interference body is formed into a non-rounded sharpened shape so as to form an end portion of a liquid film of the fuel passing through the orifice into a sharpened shape by which the end portion of the liquid film of the fuel is atomized by friction between the end portion of the liquid film of the fuel and air.

21. A nozzle plate to be mounted on a fuel injection port of a fuel injection device, the nozzle plate comprising:

a bottom wall portion having a nozzle hole through which a fuel injected from the fuel injection port passes, the nozzle hole having an outlet-side opening portion which is an opening of a fuel flow-out side of the nozzle hole;

an interference body configured to partially close the outlet-side opening portion so that an orifice which throttles the flow of the fuel is formed by the outlet-side opening portion and the interference body;

a cylindrical wall portion to be fitted onto a valve body of the fuel injection device having the fuel injection port formed therein, the bottom wall portion closing one end side of the cylindrical wall portion;

a nozzle guard projection which projects in a direction along which a center axis of the valve body extends, the nozzle guard projection being formed on an outer surface of the bottom wall portion at a position surrounding the nozzle hole plate portion;

wherein the nozzle guard projection is formed of one of (i) an annular body formed on the bottom wall portion surrounding the nozzle hole plate portion, or (ii) a plurality of block bodies formed on the bottom wall portion surrounding the nozzle hole plate portion, and a distal end of the nozzle guard projection is formed so as to define a gap between an imaginary plane and the bottom wall portion and so as not to obstruct spraying of the fuel injected from the nozzle hole at the time of contacting the distal end with the imaginary plane, wherein the nozzle hole is one of a plurality of nozzle holes, and the interference body is one of a plurality of interference bodies, wherein the bottom wall portion has a nozzle hole plate portion in which the plurality of nozzle holes open, and an interference body plate portion on which a respective one of the interference bodies is formed for each one of the plurality of nozzle holes, and wherein the nozzle hole plate portion is shaped so that the interference body plate portion is partially counterbored, wherein each of the interference bodies has an outer edge portion forming a part of an opening edge of the respective orifice, the interference bodies being shaped such that a portion of the fuel passing through the nozzle holes is atomized by impinging on the interference bodies, and the interference bodies being further shaped such that the flow of the fuel is formed into a turbulent flow in which atomization of the fuel passing through the orifice in air is facilitated by sharply bending the flow of a first portion of the fuel passing through the nozzle holes to cause the flow of the first portion of the fuel to impinge on a second portion of the fuel flowing straightly through the nozzle hole and the orifice, and wherein a corner portion of the opening edge of the orifice formed by the outlet-side opening portion of each of the nozzle holes and the interference bodies is formed into a non-rounded sharpened shape so as to form an end portion of a liquid film of the fuel passing through the orifice into a sharpened shape by which the end portion of the liquid film of the fuel is atomized by friction between the end portion of the liquid film of the fuel and air.

22. The nozzle plate according to claim 2, wherein the bottom wall portion has a nozzle hole plate portion through which the nozzle hole is formed, the nozzle plate portion having a downstream surface co-planar with the fuel impinging surface of the interference body.

* * * * *